US011420100B2

(12) United States Patent
Wang et al.

(10) Patent No.: US 11,420,100 B2
(45) Date of Patent: Aug. 23, 2022

(54) GROOVES OF GOLF CLUB HEADS AND METHODS TO MANUFACTURE GROOVES OF GOLF CLUB HEADS

(71) Applicant: KARSTEN MANUFACTURING CORPORATION, Phoenix, AZ (US)

(72) Inventors: Calvin S. Wang, Chandler, AZ (US); Xiaojian Chen, Phoenix, AZ (US); David A. Higdon, Phoenix, AZ (US); Les J. Bryant, Peoria, AZ (US); Martin R. Jertson, Cave Creek, AZ (US); Anthony D. Serrano, Anthem, AZ (US); John A. Solheim, Phoenix, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 17/127,687

(22) Filed: Dec. 18, 2020

(65) Prior Publication Data

US 2021/0138322 A1 May 13, 2021

Related U.S. Application Data

(63) Continuation-in-part of application No. 16/056,391, filed on Aug. 6, 2018, now Pat. No. 11,083,938, (Continued)

(51) Int. Cl.
*A63B 53/04* (2015.01)
*A63B 53/06* (2015.01)

(52) U.S. Cl.
CPC ..... *A63B 53/0487* (2013.01); *A63B 53/065* (2013.01); *A63B 53/047* (2013.01); (Continued)

(58) Field of Classification Search
CPC ..... A63B 53/0445; A63B 53/0045
(Continued)

(56) References Cited

U.S. PATENT DOCUMENTS 1,289,553 A * 12/1918 Sanders ..... A63B 60/00 473/331
1,337,958 A * 4/1920 Reach ..... A63B 53/04 473/331

(Continued)

FOREIGN PATENT DOCUMENTS

GB 2293982 4/1996
JP 09047532 2/1997

(Continued)

OTHER PUBLICATIONS

International Search Report and Written Opinion for PCT Application No. PCT/US2018/045443 dated Dec. 11, 2018, filed Jun. 8, 2018.

(Continued)

*Primary Examiner* — Alvin A Hunter

(57) ABSTRACT

Putter type club head with vertical groove patterns are described herein. A putter type club head comprises a putter face having a plurality of first curved grooves and a plurality of second curved grooves. The first curved grooves and the second curved grooves extend in a general vertical direction, and intersect each other at a plurality of points across the putter face. The width and depth of the first curved grooves and the second curved grooves can vary across the putter face in a direction extending from a heel end to a toe end, and/or in a direction extending from a top rail to a sole. The vertical groove pattern provides consistent ball speed performance for any impact location on the putter face.

20 Claims, 38 Drawing Sheets

Related U.S. Application Data which is a continuation-in-part of application No. 15/962,969, filed on Apr. 25, 2018, now Pat. No. 10,583,338, which is a continuation of application No. 15/236,112, filed on Aug. 12, 2016, now Pat. No. 9,987,530, which is a continuation-in-part of application No. 14/529,590, filed on Oct. 31, 2014, now Pat. No. 9,849,351, which is a continuation-in-part of application No. 14/196,313, filed on Mar. 4, 2014, now Pat. No. 9,452,326, which is a continuation-in-part of application No. 13/761,778, filed on Feb. 7, 2013, now Pat. No. 8,790,193, which is a continuation of application No. 13/628,685, filed on Sep. 27, 2012, now Pat. No. 9,108,088, which is a continuation-in-part of application No. 13/591,620, filed on Aug. 22, 2012, now Pat. No. 8,764,578, which is a continuation of application No. 13/237,293, filed on Sep. 20, 2011, now Pat. No. 8,282,505, which is a continuation of application No. 12/535,868, filed on Aug. 5, 2009, now Pat. No. 8,066,586.

(60) Provisional application No. 62/950,841, filed on Dec. 19, 2019, provisional application No. 62/541,445, filed on Aug. 4, 2017, provisional application No. 62/277,358, filed on Jan. 11, 2016, provisional application No. 62/268,011, filed on Dec. 16, 2015, provisional application No. 62/233,099, filed on Sep. 25, 2015, provisional application No. 62/205,550, filed on Aug. 14, 2015, provisional application No. 61/697,994, filed on Sep. 7, 2012, provisional application No. 61/541,981, filed on Sep. 30, 2011, provisional application No. 61/087,158, filed on Aug. 7, 2008.

(52) U.S. Cl.
CPC ..... *A63B 53/0408* (2020.08); *A63B 53/0416* (2020.08); *A63B 53/0425* (2020.08); *A63B 53/0429* (2020.08); *A63B 53/0445* (2020.08); *A63B 53/0466* (2013.01); *Y10T 29/49* (2015.01)

(58) Field of Classification Search
USPC ..... 473/324–350
See application file for complete search history.

(56) References Cited

U.S. PATENT DOCUMENTS 1,854,548 A * 4/1932 Hunt ..... A63B 53/047 473/329
1,965,954 A * 7/1934 Davis ..... A63B 53/047 473/242
3,659,855 A * 5/1972 Hardesty ..... A63B 60/00 473/342
D240,949 S * 8/1976 Jones ..... D21/741
4,508,349 A 4/1985 Gebaur et al.
4,550,914 A 11/1985 McCallister
4,749,197 A 6/1988 Orlowski
4,753,440 A 6/1988 Chorne
4,792,140 A 12/1988 Yamaguchi et al.
4,858,929 A 8/1989 Long
4,884,808 A 12/1989 Retzer
5,090,702 A 2/1992 Viste
5,141,231 A 8/1992 Cox
5,255,918 A 10/1993 Anderson
5,282,624 A 2/1994 Viste
5,354,049 A 10/1994 Stuff
5,358,249 A 10/1994 Mendralla
5,423,535 A * 6/1995 Shaw ..... A63B 60/00 473/291
5,437,088 A * 8/1995 Igarashi ..... A63B 60/00 29/527.6
5,458,332 A 10/1995 Fisher
5,472,201 A * 12/1995 Aizawa ..... A63B 53/047 473/329
5,505,450 A 4/1996 Stuff
5,531,439 A 7/1996 Azzarella
5,591,092 A 1/1997 Gilbert
5,601,501 A 2/1997 Kobayashi
5,611,742 A * 3/1997 Kobayashi ..... A63B 53/04 473/345
5,637,044 A * 6/1997 Swash ..... A63B 53/0487 473/331
5,643,099 A 7/1997 Solheim
5,676,605 A 10/1997 Kobayashi
5,688,186 A 11/1997 Michaels
5,690,561 A 11/1997 Rowland
5,709,617 A 1/1998 Nishimura
5,711,722 A 1/1998 Miyajima et al.
5,735,755 A 4/1998 Kobayashi
5,755,626 A 5/1998 Shira
5,762,566 A 6/1998 King et al.
5,766,087 A 6/1998 Kawamatsu
6,200,229 B1 3/2001 Grace
6,224,497 B1 5/2001 Antonious
6,227,986 B1 5/2001 Fisher
6,257,994 B1 7/2001 Antonious
6,267,690 B1 * 7/2001 Salmon ..... A63B 53/04 473/325
6,273,831 B1 8/2001 Dewanjee
6,322,459 B1 * 11/2001 Nishimura ..... A63B 53/04 473/330
6,336,869 B1 * 1/2002 Hettinger ..... A63B 53/0487 473/324
6,398,665 B1 * 6/2002 Antonious ..... A63B 53/0466 473/330
6,406,379 B1 6/2002 Christensen
6,478,690 B2 11/2002 Helmstetter
6,488,594 B1 12/2002 Card
6,554,721 B1 4/2003 Woodward
6,592,467 B1 7/2003 Graym
D481,432 S 10/2003 Greene
6,710,287 B2 3/2004 Lu
6,719,644 B2 4/2004 Erb
6,719,645 B2 4/2004 Kouno
D490,129 S 5/2004 Greene
6,743,117 B2 * 6/2004 Gilbert ..... A63B 53/047 473/332
6,875,124 B2 * 4/2005 Gilbert ..... A63B 53/04 473/290
7,018,303 B2 3/2006 Yamamoto
7,056,226 B2 6/2006 Kennedy
7,066,833 B2 6/2006 Yamamoto
7,101,290 B2 9/2006 Tucker, Sr.
7,163,467 B1 1/2007 Chang et al.
7,166,039 B2 * 1/2007 Hettinger ..... A63B 53/0487 473/331
7,179,175 B2 2/2007 Kennedy, III
7,261,644 B2 8/2007 Burrows
7,273,422 B2 9/2007 Vokey et al.
7,285,057 B2 * 10/2007 Mann, Jr. ..... A63B 53/047 473/331
7,341,527 B1 * 3/2008 Fisher ..... A63B 53/0487 473/329
7,364,513 B2 4/2008 Krumme
7,413,517 B2 8/2008 Butler, Jr.
7,431,662 B2 10/2008 Tucker, Sr.
7,442,129 B2 10/2008 Bardha
7,452,283 B2 * 11/2008 Hettinger ..... A63B 53/0487 473/249
7,455,597 B2 11/2008 Matsunaga
7,473,186 B2 * 1/2009 Best ..... A63B 53/04 473/329
7,500,923 B2 3/2009 Tateno
7,540,810 B2 * 6/2009 Hettinger ..... A63B 53/0487 473/331

(56) References Cited

U.S. PATENT DOCUMENTS

| | | | | |
|---|---|---|---|---|
| D596,687 | S | 7/2009 | Bezilla et al. | |
| 7,566,276 | B2 * | 7/2009 | Billings | A63B 53/065 473/251 |
| 7,568,983 | B2 | 8/2009 | Gilbert | |
| 7,588,499 | B2 | 9/2009 | Tateno | |
| 7,594,863 | B2 | 9/2009 | Ban | |
| D603,009 | S | 10/2009 | Bezilla et al. | |
| 7,604,550 | B1 | 10/2009 | Currie | |
| D605,242 | S | 12/2009 | Franklin | |
| 7,662,049 | B2 | 2/2010 | Liu et al. | |
| 7,677,990 | B2 * | 3/2010 | Ban | A63B 53/047 473/331 |
| 7,691,006 | B1 | 4/2010 | Burke | |
| D615,140 | S | 5/2010 | Franklin | |
| 7,717,801 | B2 | 5/2010 | Franklin | |
| 7,749,098 | B2 | 7/2010 | Johnson | |
| 7,749,099 | B2 | 7/2010 | Ban et al. | |
| 7,758,449 | B2 | 7/2010 | Gilbert et al. | |
| 7,780,548 | B2 | 8/2010 | Solheim | |
| 7,794,335 | B2 | 9/2010 | Cole et al. | |
| 7,819,756 | B2 | 10/2010 | Ban et al. | |
| 7,862,450 | B2 | 1/2011 | Gilbert et al. | |
| 7,905,797 | B2 | 3/2011 | Gilbert | |
| 7,914,394 | B2 | 3/2011 | Cole et al. | |
| 7,922,602 | B2 | 4/2011 | Johnson | |
| 7,942,758 | B2 | 5/2011 | Nakamura | |
| D639,361 | S * | 6/2011 | Reinberg | D21/736 |
| D639,366 | S * | 6/2011 | Reinberg | D21/759 |
| D639,367 | S * | 6/2011 | Reinberg | D21/759 |
| D639,879 | S | 6/2011 | Lee | |
| 8,012,035 | B2 | 9/2011 | Franklin | |
| 8,021,245 | B2 | 9/2011 | Beach | |
| 8,033,931 | B2 * | 10/2011 | Wahl | A63B 53/047 473/342 |
| 8,066,586 | B2 * | 11/2011 | Solheim | A63B 53/047 473/330 |
| 8,083,605 | B2 | 12/2011 | Franklin | |
| 8,216,081 | B2 | 7/2012 | Snyder | |
| 8,282,505 | B2 * | 10/2012 | Solheim | A63B 60/00 473/331 |
| 8,287,401 | B2 | 10/2012 | Tateno | |
| 8,292,754 | B2 | 10/2012 | Snyder | |
| 8,353,780 | B2 | 1/2013 | Hatton | |
| 8,382,604 | B2 | 2/2013 | Billings | |
| 8,425,342 | B2 | 4/2013 | Snyder | |
| 8,480,513 | B2 | 7/2013 | Kuan | |
| 8,545,343 | B2 | 10/2013 | Boyd | |
| 8,579,717 | B2 | 11/2013 | Snyder | |
| 8,617,001 | B2 | 12/2013 | Sandival | |
| 8,636,607 | B2 | 1/2014 | Renna | |
| 8,641,549 | B2 | 2/2014 | Stites | |
| 8,641,556 | B2 | 2/2014 | Kuan | |
| 8,764,578 | B2 * | 7/2014 | Solheim | A63B 60/00 473/331 |
| 8,790,193 | B2 * | 7/2014 | Serrano | A63B 60/00 473/331 |
| 8,814,715 | B2 | 8/2014 | Franklin | |
| 8,858,361 | B2 * | 10/2014 | Ripp | B23C 3/28 473/331 |
| 9,108,088 | B2 * | 8/2015 | Serrano | A63B 53/0466 |
| 9,452,326 | B2 | 9/2016 | Serrano et al. | |
| 9,545,547 | B1 | 1/2017 | Abbott | |
| 9,561,407 | B2 | 2/2017 | Serrano et al. | |
| 9,849,351 | B2 | 12/2017 | Serrano | |
| 9,849,358 | B2 | 12/2017 | Franklin | |
| 9,889,353 | B2 | 2/2018 | Philip | |
| 9,943,735 | B2 * | 4/2018 | Rife | A63B 53/0487 |
| 9,987,530 | B2 * | 6/2018 | Jertson | A63B 53/065 |
| 10,092,802 | B2 | 10/2018 | Serrano | |
| 10,238,932 | B2 * | 3/2019 | Becktor | A63B 53/0487 |
| 10,398,947 | B2 | 9/2019 | Serrano | |
| 10,632,352 | B2 * | 4/2020 | Lambeth | A63B 53/0487 |
| 10,653,931 | B2 | 5/2020 | Philip | |
| 10,668,340 | B2 * | 6/2020 | Lambeth | A63B 53/0487 |
| 10,857,430 | B2 * | 12/2020 | Henrikson | A63B 53/0416 |
| 11,083,938 | B2 * | 8/2021 | Wang | A63B 53/0487 |
| 2005/0209020 | A1 * | 9/2005 | Burrows | A63B 53/0487 473/330 |
| 2007/0149311 | A1 | 6/2007 | Wright | |
| 2007/0149312 | A1 * | 6/2007 | Gilbert | A63B 60/00 473/330 |
| 2007/0243949 | A1 | 10/2007 | Solari | |
| 2008/0171613 | A1 * | 7/2008 | Gilbert | A63B 53/047 473/331 |
| 2008/0234066 | A1 | 9/2008 | Jones | |
| 2008/0242442 | A1 * | 10/2008 | Gilbert | A63B 60/02 473/331 |
| 2008/0242443 | A1 * | 10/2008 | Gilbert | A63B 53/047 473/331 |
| 2009/0156328 | A1 | 6/2009 | Reese | |
| 2010/0035702 | A1 * | 2/2010 | Solheim | A63B 53/047 473/330 |
| 2011/0165963 | A1 | 7/2011 | Cackett | |
| 2012/0071269 | A1 * | 3/2012 | Rahrig | A63B 60/00 473/331 |
| 2013/0085011 | A1 * | 4/2013 | Serrano | A63B 53/04 473/331 |
| 2013/0157776 | A1 * | 6/2013 | Serrano | A63B 53/04 473/331 |
| 2013/0331197 | A1 * | 12/2013 | Hackenberg | A63B 60/02 473/251 |
| 2014/0187343 | A1 * | 7/2014 | Serrano | A63B 53/04 473/288 |
| 2015/0209629 | A1 * | 7/2015 | Serrano | A63B 53/0466 473/331 |
| 2016/0016050 | A1 * | 1/2016 | Rife | A63B 53/0487 473/331 |
| 2017/0239534 | A1 * | 8/2017 | Rife | A63B 53/0487 |
| 2018/0200588 | A1 * | 7/2018 | Rife | A63B 53/0487 |

FOREIGN PATENT DOCUMENTS

| | | | | |
|---|---|---|---|---|
| JP | 09047532 | A * | 2/1997 | |
| JP | H0975486 | | 3/1997 | |
| JP | 2813969 | | 10/1998 | |
| JP | 10263118 | | 10/1998 | |
| JP | 11047317 | | 2/1999 | |
| JP | 11047317 | A * | 2/1999 | |
| JP | 2000176058 | | 6/2000 | |
| JP | 2000176058 | A * | 6/2000 | A63B 53/0466 |
| JP | 2002153575 | | 5/2002 | |
| JP | 2002239040 | | 8/2002 | |
| JP | 2003000776 | | 1/2003 | |
| JP | 2003000777 | A * | 1/2003 | |
| JP | 2005287534 | | 10/2005 | |
| JP | 3901788 | | 4/2007 | |

OTHER PUBLICATIONS

International Search Report and Written Opinion for PCT Application No. PCT/US2020/044782 dated Oct. 16, 2020, filed Aug. 3, 2020.

Vintage Rare Lilac Bros. No Scuff Putter Dearborn Mich., https://www.worthpoint.com/worthopedia/vintage-lilac-bros-scuff-putter-46140117, Nov. 19, 2012.

Putter, Laser Light by Clayton, https://www.worthpoint.com/worthopedia/putter-laser-light-clayton-151457342, May 6, 2011.

Never Comprise Milled Series, https://forums.golfwrx.com/discussion/2491/never-compromise-milled-series, Jun. 30, 2005.

International Search Report and Written Opinion dated Jan. 14, 2016 for PCT Application No. PCT/US2015/058127, filed Oct. 29, 2015.

International Search Report and Written Opinion dated Jun. 5, 2016 for PCT Application No. PCT/US2015/018813, filed Mar. 4, 2015.

Jeffery B. Ellis, The Club Maker's Art, Antique Golf Clubs and Their History, vol. 1, p. 253, C and C Offset Printing Co., Ltd. (Portland, Oregon 2007).

Truth Digest MyGolfSpy, Machine M2A Converter Putter—Part 1, The Story and the Putter, https://forum.mygolfspy.com/topic/4634-

(56) References Cited

OTHER PUBLICATIONS machine-m2a-converter-putter-%C3%A2%E2%82%AC%E2%80%9C-part-1-%C3%A2%E2%82%AC%E2%80%9C-the-story-and-the-putter/, Nov. 2011.
Dave Billings' Golf Locker—Tales and Treasure from 25 years in Golf, http://daveysgolflocker.blogspot.com/, Oct. 5, 2012.
Machine Putters Picture Thread, https://forums.golfwrx.com/discussion/171701/machine-putters-picture-thread/p4, Jan. 9, 2007.
Machine Putters Picture Thread, https://forums.golfwrx.com/discussion/171701/machine-putters-picture-thread/p10, Feb. 1, 2007.
Machine Putters Picture Thread, https://forums.golfwrx.com/discussion/171701/machine-putters-picture-thread/p31, Sep. 19, 2009.
International Search Report and Written Opinion for PCT Application No. PCT/US2012/057503 dated Feb. 27, 2013, filed Sep. 27, 2012.
International Search Report and Written Opinion for PCT Application No. PCT/US2016/046866 dated Oct. 28, 2016, filed Aug. 12, 2016.

* cited by examiner

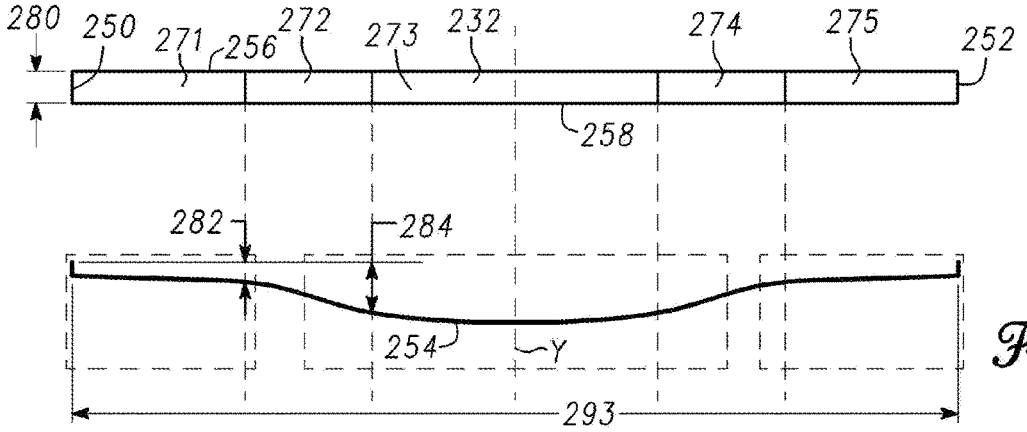
Fig. 4
Fig. 5
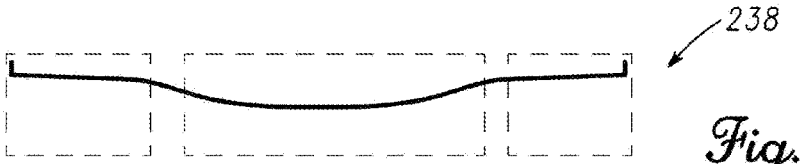
Fig. 6
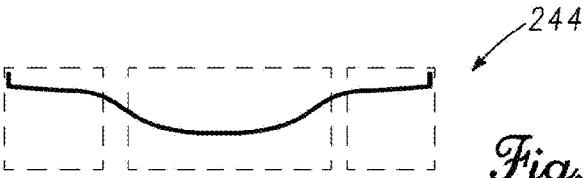
Fig. 7
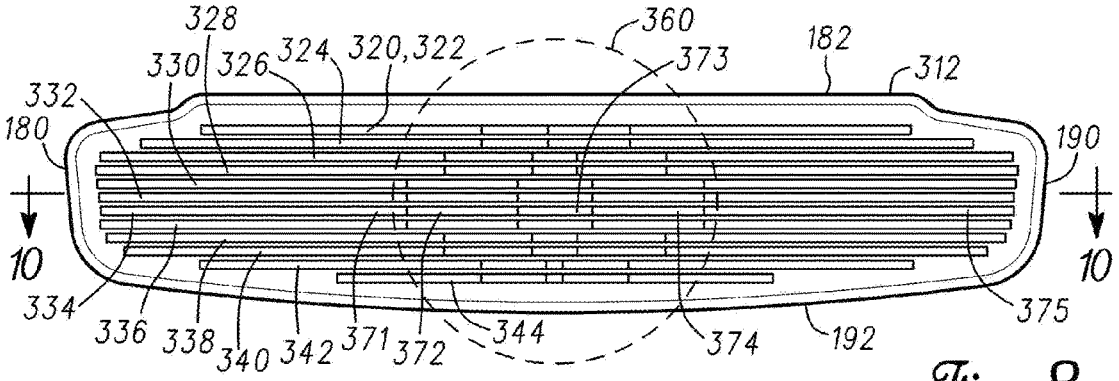
Fig. 8

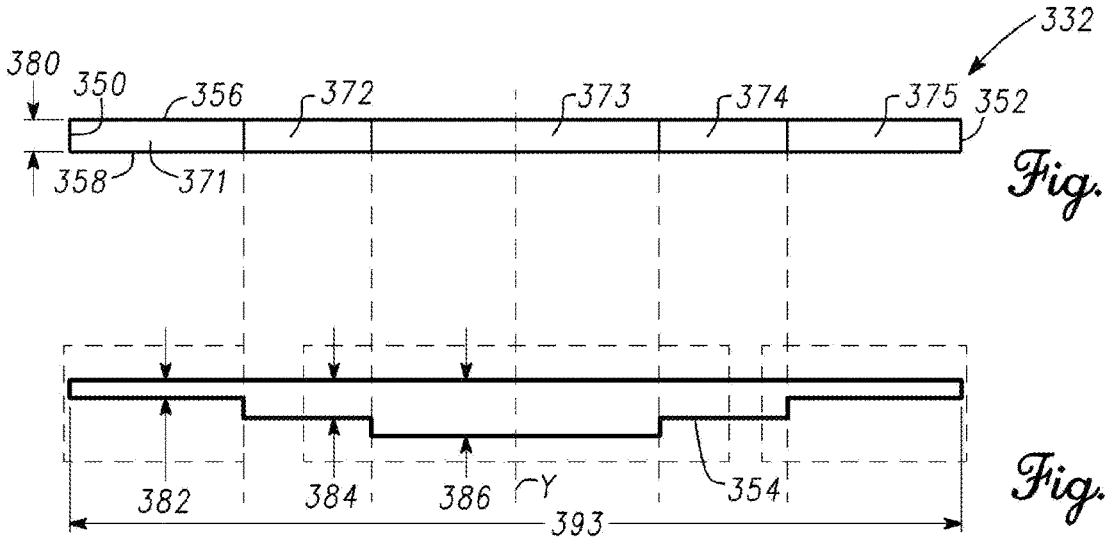
Fig. 9
Fig. 10
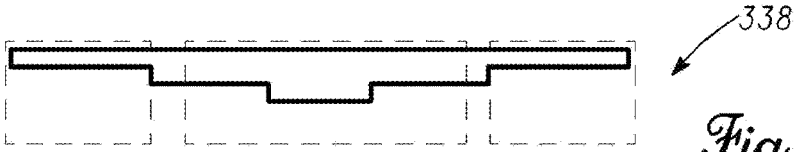
Fig. 11
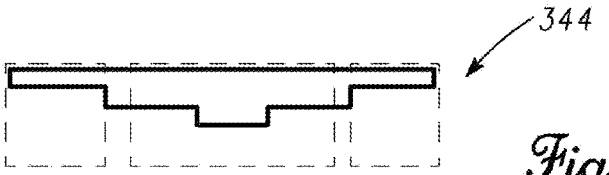
Fig. 12
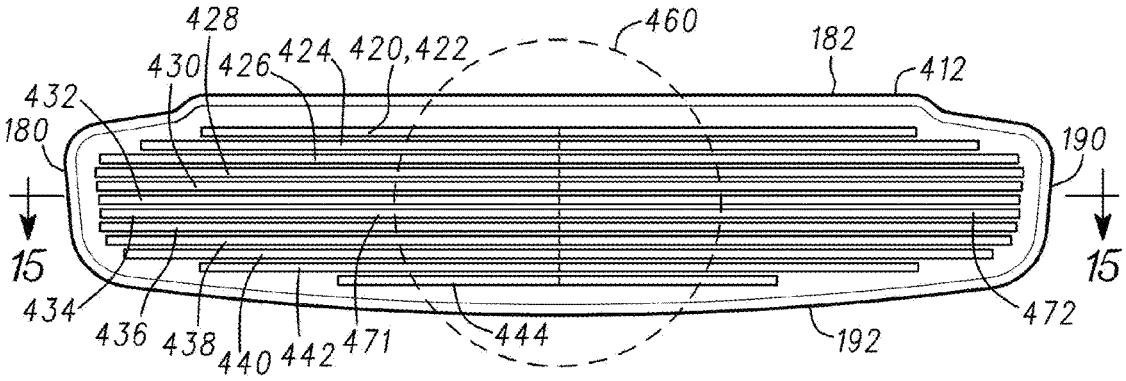
Fig. 13

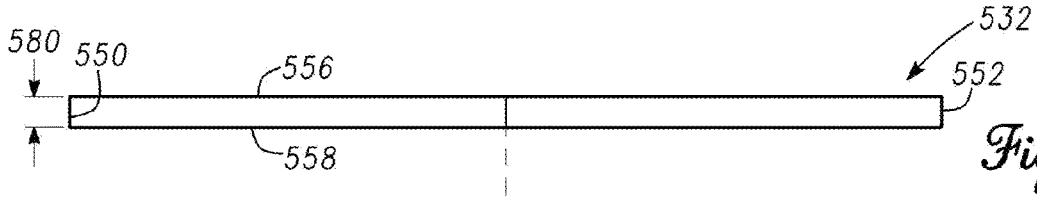
Fig. 19
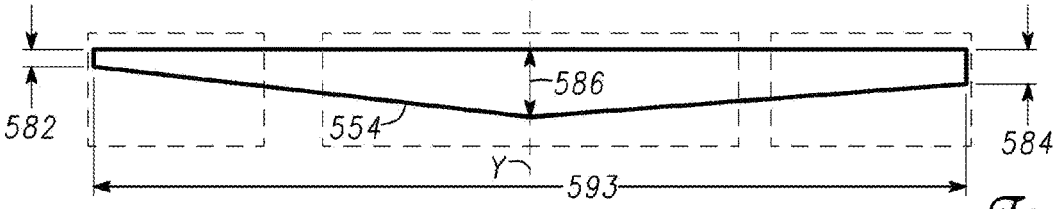
Fig. 20
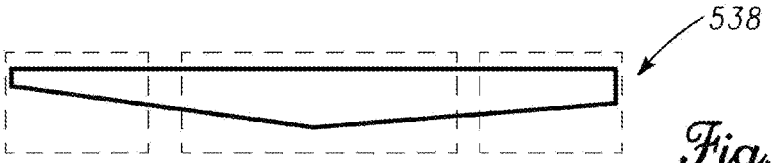
Fig. 21
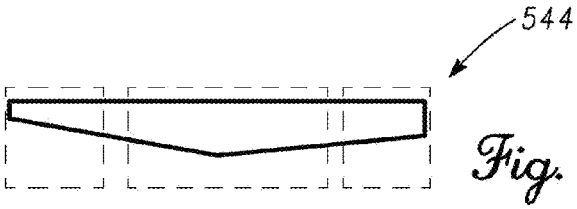
Fig. 22
Fig. 23
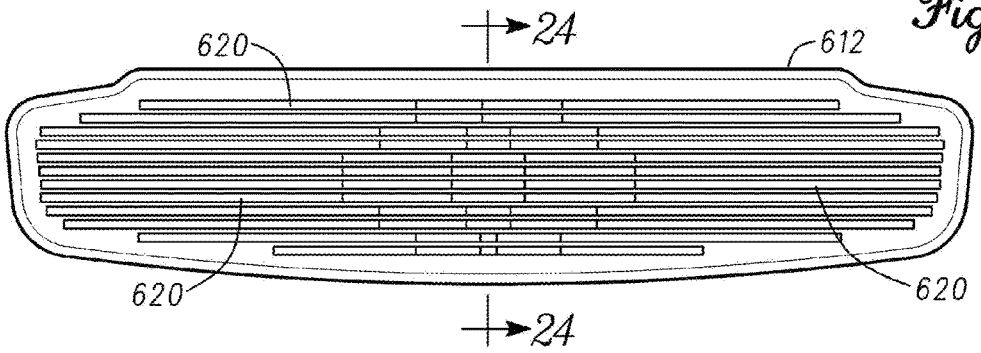
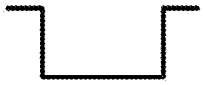
Fig. 24
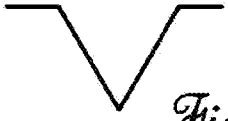
Fig. 25
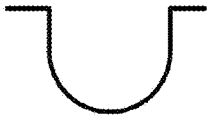
Fig. 26

GROOVES OF GOLF CLUB HEADS AND METHODS TO MANUFACTURE GROOVES OF GOLF CLUB HEADS

RELATED APPLICATIONS

This claims the benefit of U.S. Provisional Patent Application No. 62/950,841, filed on Dec. 19, 2020, and is a continuation-in-part of U.S. patent application Ser. No. 16/056,391, filed on Aug. 6, 2018, which claims the benefit of U.S. Provisional Patent Application No. 62/541,445, filed on Aug. 4, 2017, and is a continuation-in-part of U.S. patent application Ser. No. 15/962,969, filed on Apr. 25, 2018, and is issued as U.S. Pat. No. 10,583,338 on Mar. 10, 2020, which is a continuation of U.S. patent application Ser. No. 15/236,112, filed on Aug. 12, 2016, and is issued as U.S. Pat. No. 9,987,530 on Jun. 5, 2018, which claims the benefit of U.S. Provisional Patent Application No. 62/277,358, filed on Jan. 11, 2016, U.S. Provisional Patent Application No. 62/268,011, filed on Dec. 16, 2015, U.S. Provisional Patent Application No. 62/233,099, filed on Sep. 25, 2015, and U.S. Provisional Application No. 62/205,550, filed on Aug. 14, 2015. U.S. patent application Ser. No. 15/236,112 is also a continuation-in-part of U.S. patent application Ser. No. 14/529,590, filed on Oct. 31, 2014, and is issued as U.S. Pat. No. 9,849,351 on Dec. 26, 2017, which is a continuation-in-part of U.S. patent application Ser. No. 14/196,313, filed on Mar. 4, 2014, and is issued as U.S. Pat. No. 9,452,326 on Sep. 27, 2016, which is a continuation in part of U.S. patent application Ser. No. 13/761,778, filed on Feb. 7, 2013, and is issued as U.S. Pat. No. 8,790,193 on Jul. 29, 2014, which is a continuation of U.S. patent application Ser. No. 13/628,685, filed on Sep. 27, 2012, and is issued as U.S. Pat. No. 9,108,088 on Aug. 18, 2015, which claims the benefit of U.S. Provisional Patent Application No. 61/697,994, filed on Sep. 7, 2012, and U.S. Provisional Patent Application No. 61/541,981 filed on Sep. 30, 2011.

U.S. patent application Ser. No. 13/628,685 is also a continuation-in-part of U.S. patent application Ser. No. 13/591,620, filed on Aug. 22, 2012, and is issued as U.S. Pat. No. 8,764,578 on Jul. 1, 2014, which is a continuation of U.S. patent application Ser. No. 13/237,293, filed on Sep. 20, 2011, and is issued as U.S. Pat. No. 8,282,505 on Oct. 9, 2012, which is a continuation of U.S. patent application Ser. No. 12/535,868, filed on Aug. 5, 2009, and is issued as U.S. Pat. No. 8,066,586 on Nov. 29, 2011, which claims the benefit of U.S. Provisional Patent Application No. 61/087,158, filed Aug. 7, 2008, all of which are incorporated herein by reference.

FIELD

The present disclosure relates generally to golf equipment, and more particularly, to grooves of golf club heads and methods to manufacture grooves of golf club heads.

BACKGROUND

Typically, a golf club head may include a club face with a plurality of parallel grooves extending between the toe end and the heel end. In particular, the plurality of grooves in an iron-type club head may clear out water, sand, grass, and/or other debris between a golf ball and the club face. Golf club faces may have grooves with various shapes such as squared or box-shaped grooves, V-shaped grooves, or U-shaped grooves.

BRIEF DESCRIPTION OF THE DRAWINGS

FIG. 4 shows a schematic top view of a groove of the ball striking face of FIG. 3.

FIG. 5 shows a horizontal cross-sectional diagram of the groove of FIG. 4 taken at section 5-5 of FIG. 3.

FIG. 6 shows a horizontal cross-sectional diagram of another groove of the ball striking face FIG. 3.

FIG. 7 shows a horizontal cross-sectional diagram of another groove of the ball striking face FIG. 3.

FIG. 8 shows a schematic diagram of a ball striking face of a putter according to one example.

FIG. 9 shows a schematic top view of a groove of the ball striking face of FIG. 8.

FIG. 10 shows a horizontal cross-sectional diagram of the groove of FIG. 9 taken at section 10-10 of FIG. 8.

FIG. 11 shows a horizontal cross-sectional diagram of another groove of the ball striking face FIG. 8.

FIG. 12 shows a horizontal cross-sectional diagram of another groove of the ball striking face FIG. 8.

FIG. 13 shows a schematic diagram of a ball striking face of a putter according to one example.

FIG. 19 shows a schematic top view of a groove of the ball striking face of FIG. 18.

FIG. 20 shows a horizontal cross-sectional diagram of the groove of FIG. 19 taken at section 20-20 of FIG. 18.

FIG. 21 shows a horizontal cross-sectional diagram of another groove of the ball striking face FIG. 18.

FIG. 22 shows a horizontal cross-sectional diagram of another groove of the ball striking face FIG. 18.

FIG. 23 shows a schematic diagram of a ball striking face of a putter according to one example.

FIGS. 24-26 show different examples of vertical cross sections of grooves of the ball striking face of FIG. 23 taken at section 24-24 of FIG. 23.

DESCRIPTION

The present embodiments discussed below are directed to putter type club heads comprising a vertical groove pattern to provide consistent ball speed performance for any impact location on a putter face. The vertical groove pattern can comprise a plurality of first curved grooves and a plurality of second curved grooves. The plurality of first curved grooves can extend in a first direction, and the plurality of second curved grooves can extend in a second direction opposite the first direction. The first curved grooves and the second curved grooves intersect each other at a plurality of points across the putter face. Further, land portions can be positioned between the first curved grooves and the second curved grooves. The land portions are portions of the putter face that contact a golf ball during impact, and the curved grooves are portions of the putter face that do not contact the golf ball during impact. As described in more detail below, the groove width and depth can vary across the putter face in a direction extending from the heel end to the toe end, and/or in a direction extending from the top rail to the sole.

The first curved grooves and the second curved grooves can be disposed on metallic putter face, and/or a polymeric face insert that is secured to the putter face. In embodiments where the putter face comprises the polymeric face insert, the face insert forms a portion of a striking surface and a sole of the putter golf club head. In other embodiments, the face insert can form a portion of a heel end, a toe end, a top rail, a sole, or any combination thereof. In some embodiments, the face insert can comprise a single component such as ball striking face plate. In other embodiments, the face insert can comprise multiple components such as a ball striking face plate and a face insert base. The face insert can be secured to the putter face with an adhesive such as tape, very high bond tape, glue, epoxy, or any type of adhesive compound. The polymeric face insert can provide a softer, unique sound/feel during golf ball impacts over conventional metallic putter faces. The combination of the vertical groove pattern and the polymeric face insert can provide improved ball speed performance for any impact location on the putter face.

In general, grooves of golf club heads and methods to manufacture grooves of golf club heads are described herein. Golf equipment related to the methods, apparatus, and/or articles of manufacture described herein may be conforming or non-conforming to the rules of golf at any particular time. Further, the figures provided herein are for illustrative purposes, and one or more of the figures may not be depicted to scale. The apparatus, methods, and articles of manufacture described herein are not limited in this regard.

Figure 1:
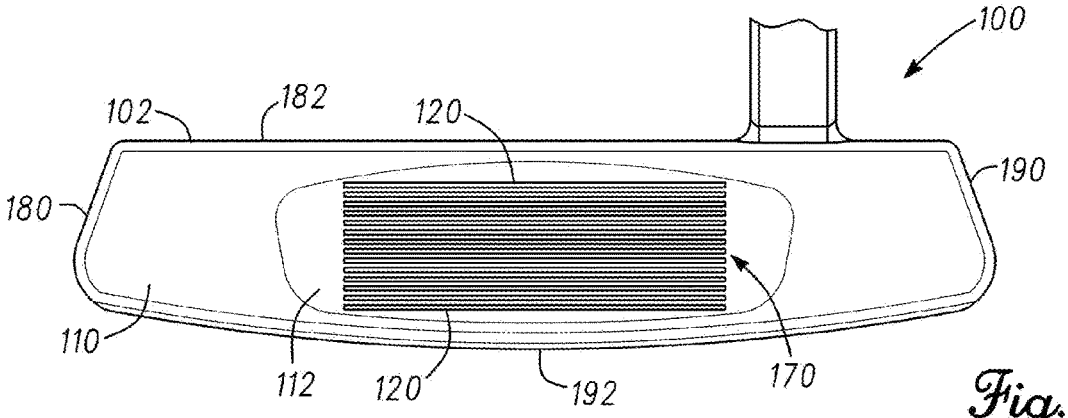
FIG. 1 shows a putter according to one example.

In the examples of FIG. 1, a putter 100 is shown. Although grooves and face inserts for a putter 100 are described herein, the apparatus, methods, and articles of manufacture described herein may be applicable other types of club head (e.g., a driver-type club head, a fairway wood-type club head, a hybrid-type club head, an iron-type club head, etc.). A putter type golf club head, however, is not a driver-type club head, a fairway wood-type club head, a hybrid-type club head, an iron-type club head, and a wedge-type club head.

The putter golf club head comprises a loft angle. The loft angle of the putter golf club head is the angle between a generally planar surface on the face and a shaft centerline. The loft angle of the putter golf club head is the rearward angle of the face from the shaft of the putter golf club head. In many embodiments, the loft angle of the putter golf club head can be less than or equal to 10 degrees. In some embodiments, the loft angle of the putter golf club head can be less than 9 degrees, less than 8 degrees, less than 7 degrees, less than 6 degrees, less than 5 degrees, less than 4 degrees, less than 3 degrees, or less than 2 degrees. In some embodiments, the loft angle of the putter golf club head can range from 0 to 10 degrees, 0 to 9 degrees, 0 to 8 degrees, 1 to 10 degrees, 1 to 9 degrees, 1 to 8 degrees, 1 to 3 degrees, 2 to 10 degrees, 2 to 9 degrees, 2 to 8 degrees, 3 to 10 degrees, 3 to 9 degrees, or 3 to 8 degrees. For example, the loft angle of the putter golf club head can be 0, 1, 2, 3, 4, 5, 6, 7, 8, 9, or 10 degrees.

The ball striking face plate can be horizontally separated into three portions, which are a toe portion proximate the toe end 180, a heel portion proximate the heel end 190, and a center portion positioned between the toe portion and the heel portion. The ball striking face plate can be further vertically separated into three portions, which are a top rail portion proximate the top rail 182, the sole portion proximate the sole 192, and a mid portion positioned between the top rail portion and the sole portion. The toe portion, the heel portion, the center portion, the top rail portion, the sole portion, and the mid portion of the ball striking face plate can be similar to the toe portion 1970, the heel portion 1974, the center portion 1972, the top rail portion 1976, the sole portion 1980, and the mid portion 1978 of the ball striking face plate 1912 described below for FIGS. 81 and 84.

The front striking surface of the putter golf club head can comprise a plurality of grooves. The plurality of grooves of the front striking surface can be similar to plurality of grooves on ball striking face/ball striking surface/front striking surface: 112, 212, 312, 412, 512, 612, 712, 1012, 1312, 1412, 1500, 1612, 1728, 1812, 1911, 2212, 2312, 4212, 5212, 6011, 6111, 6211, 6311, 6411, 6511, 6611, 6711, 6811, 6911, 7011, 7111, 7211, or 7311 as described below. In some embodiments, the grooves of the front striking surface can be similar to grooves described in U.S. patent application Ser. No. 14/196,313 (U.S. Pat. No. 9,452,326), where the grooves can comprise variable depths, variable widths, or variable depths and widths. The grooves of the face insert can be any pattern, such as straight-lined grooves, parabolic grooves, double parabolic grooves, or any other type of patterned groove. In some embodiments, the grooves comprise a depth, wherein the depth of the grooves vary in a direction extending between the top rail 182 and the sole 192 in a direction extending between the heel end 190 and the toe end 180. More specifically, the grooves vary from the toe portion toward the heel portion and from the top rail portion toward the sole portion. The depth of the grooves increases from the toe portion and the heel portion toward the center portion. Similarly, the depth of the grooves increases from the top rail portion and the sole portion toward the mid portion. The deepest portion of at least one groove is defined by a general planar surface portion of the groove. The general planar surface portion is located at a combined center portion and mid portion of the grooves.

In many embodiments, the grooves of the face insert can provide the advantage of correcting ball trajectory during off center hits or mishits. The grooves of the face insert can provide more shot forgiveness to the player thereby providing more accurate shots. Further, the varying depth and/or varying width of the grooves increase forgiveness by allowing for more normalized hits across the front striking surface.

Further, in some embodiments, the grooves of the front striking surface can comprise a variable width extending from the heel end 190 to the toe end 180. In some embodiments, the grooves of the front striking surface can comprise a variable width extending from the sole 192 to the top rail 182. The groove width can be measured as a transverse width. In some embodiments, the grooves of the front striking surface can comprise a variable width extending from the heel end 190 to the toe end 180, and a variable width extending from the sole 192 to the top rail 182.

The putter 100 includes a putter head 102 having a putter face 110. The putter face 110 may be generally planar and extend in a generally vertical orientation at an address position. The putter face 110 includes a ball striking face 112 that may be generally on the same plane as the putter face 110 or slightly projected outward from the putter face 110. The ball striking face 112 may be the same size or smaller (as shown in FIG. 1) than the putter face 110. The ball striking face 112 may be a region on the putter face 110 that is generally used to strike a golf ball (not shown). However, an individual may also strike a ball with a section of the putter face 110 that is outside the ball striking face 112.

The ball striking face 112 may be a continuous or integral part of the putter face 110 or formed as an insert that is attached to the putter face 110. Such an insert may be constructed from the same material or different materials as the putter face 110 and then be attached to the putter face 110. The ball striking face 112 may include one or more grooves, generally shown as grooves 120, and one or more land portions 170. For example, the ball striking face 112 is shown to have twelve grooves, generally shown as 122, 124, 126, 128, 130, 132, 134, 136, 138, 140, 142, and 144. The grooves 120 may be generally referred to with a single reference number such as 120. However, when specifically describing one of the grooves on the ball striking face 112, the reference number for that specific groove may be used.

Two adjacent grooves may be separated by a land portion 170. A land portion 170 between each groove 120 and an adjacent groove 120 may have the same or different width as a land portion 170 between another pair of adjacent grooves 120. The land portions 170 may also define the top surface of the ball striking face 112. As described in more detail below, the width of the land portions 170 can vary from the toe end 180 to the heel end 190, or from a top rail 192 to a sole 192 of the putter head 102. In one example, the width of the land portions 170 can increase in a direction extending from a center portion of the putter face 110 to the toe end 180, and in a direction extending from the center portion of the putter face 110 to the heel end 190.

In general, two or more of the grooves 120 may be parallel to each other. For example, the grooves 122 and 124 may be parallel to each other. However, the grooves 120 may be oriented relative to each other in any manner. For example, any of the grooves 120 may be diagonally, vertically and/or horizontally oriented. As shown in the example of FIG. 2, one or more of the grooves 120 may be substantially linear and generally parallel to an adjacent groove 120 and extend between a toe end 180 and a heel end 190 of the putter face 110.

As described in detail below, the depth, length, width, a horizontal cross-sectional shape, and/or a vertical cross-sectional shape of the grooves 120 may linearly, nonlinearly, in regular or irregular step-wise intervals, arcuately and/or according to one or more geometric shapes increase, decrease and/or vary from the toe end 180 to the heel end 190 and/or from the top rail 182 to the sole 192 of the putter head 102. The apparatus, methods, and articles of manufacture described herein are not limited in this regard.

Figure 2:
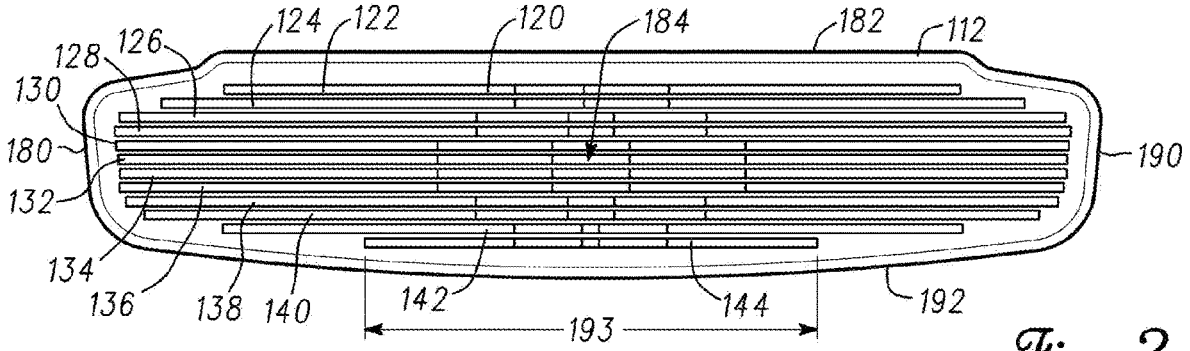
FIG. 2 shows a schematic diagram of a ball striking face of a putter according to one example.

Referring to FIG. 2, the ball striking face 112 is shown having grooves 122-144. The ball striking face 112 may be an integral part of the putter face 110 such as to be co-manufactured with the putter face 110. Alternatively, the ball striking face 112 may be an insert that is attached to the putter face 110. Each of the grooves 120 may extend from the toe end 180 to the heel end 190 to define a corresponding length 193 (only the length 193 of groove 144 is shown in FIG. 2). The lengths 193 of some or all of the grooves 120 may vary in a direction from the top rail 182 to the sole 192 so that each groove 120 may generally conform to the shape of the perimeter of the ball striking face 112. For example, the length of the grooves may increase from near the top rail 182 to a center 184 of the ball striking face 112 and decrease from the center 184 to near the sole 192. The center 184 may be a geometric center of the ball striking face 112. Alternatively, the center 184 may represent an inertial or weight related center of the ball striking face 112. However, the center 184 may be generally defined by a region of the ball striking face 112 that typically strikes the ball. As shown in FIG. 1, the length 193 of the grooves 120 may be similar. In other examples, such as the example shown in FIG. 2, the length 193 of the grooves may decrease from near the top rail 182 to the center 184 and decrease from near the sole 192 to the center 184. Thus, any groove length arranged on the ball striking face 112 is within the scope of the disclosure.

Figure 3:
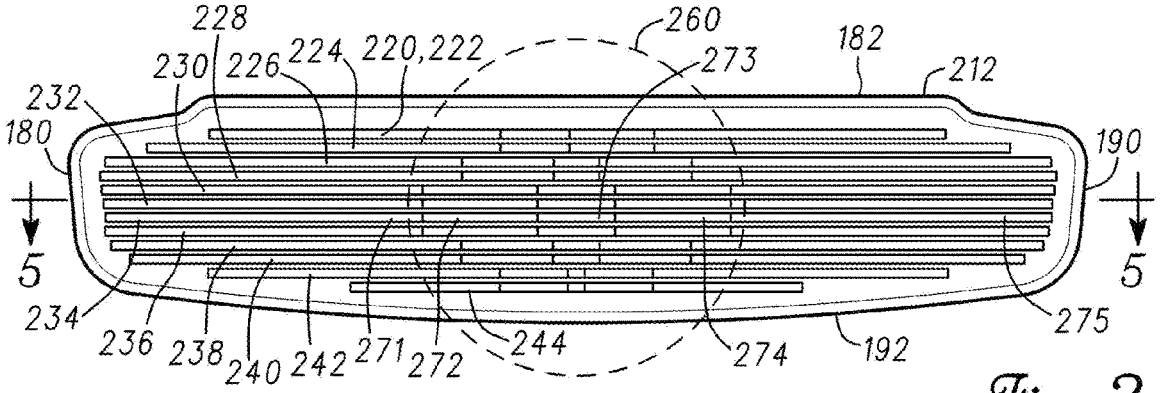
FIG. 3 shows a schematic diagram of a ball striking face of a putter according to one example.

In another example shown in FIG. 3, a ball striking face 212 may include grooves 220 (shown specifically as grooves 222-244). The ball striking face 212 may be an integral part of the putter face 110 or a separate piece that is attached to the putter face 110. Accordingly, when describing the ball striking face 212, parts of the putter 100 and the putter head 102 are referred to with the same reference numbers described above.

FIG. 4 shows a schematic view of the groove 232 and FIG. 5 shows a horizontal cross section of the groove 232 taken at section line 5-5 of FIG. 3. The groove 232 is shown to be divided into horizontally spanning regions, generally shown as regions 271-275, which are visually defined in FIGS. 3 and 4 by vertical boundary lines. The horizontal regions 271-275 may define variations in the horizontal cross-sectional profile of the groove 232 from near the toe end 180 to near the heel end 190 and/or from near the top rail 182 to near the sole 192. Horizontal cross-sectional profile of a groove may refer to any property of the groove along the length 293 of the groove, such as length of a certain section of the groove, depth, width, cross-sectional shape, and/or construction materials. In the example of FIGS. 3-7, the grooves 220 include a first vertical wall 250 and a second vertical wall 252 that define the length 293 of the grooves 220. Each of the grooves 220 has a bottom surface 254 which defines a depth of the groove 220. The depth of each groove may vary from the first wall 250 to the second wall 252 according to the cross-sectional profile of the groove 220 in the regions 271-275. Each groove 220 also includes a first horizontal wall 256 and a second horizontal wall 258 that define the vertical boundaries of the groove 220. The distance between the first horizontal wall 256 and the second horizontal wall 258 defines a width 280 of the groove 220. The width 280 may vary from the first vertical wall 250 to the second vertical wall 252 as shown in the examples of FIGS. 38-45, where a groove may have a length 590, a first width 594, a second width 595 and/or a third width 596. The groove width 280 can be measured as a transverse width from the first vertical wall 250 to the second vertical wall 252. In the example of FIGS. 3-7, however, the first horizontal wall 256 and the second horizontal wall 258 are generally parallel to define a generally constant width 280.

Referring to FIG. 5, the bottom surface 254 at the region 271 is downwardly sloped or curved to define a first depth 282 at the boundary between regions 271 and 272. The bottom surface 254 in the region 272 transitions with a steeper downward curve from the first depth 282 to a second depth 284 at the boundary between regions 272 and 273. If the bottom surface 254 is flat in the region 273, the second depth 284 may generally define the greatest depth of the groove 232. However, if the bottom surface 254 is not flat, the greatest depth of the groove 232 may be defined in another part of the region 273. Any of the grooves 220 may be symmetric about the vertical axis y. Accordingly, the shape of the groove 220 on each side of the y axis may mirror the shape of the groove 232 on the other side of the y axis. However, any of the grooves 220 may be asymmetric. The regions 271 and 275 define shallow portions of the groove 232 and the region 273 defines the deeper center portion of the groove 232. The deepest part of any of the grooves 220 may be at the center of the groove 220. The regions 272 and 274 facilitate transition of the bottom surface 254 from the depth 282 to the depth 284.

Referring to FIGS. 3 and 5, the general cross-sectional profile of each of the grooves 220 may remain generally similar from the top rail 182 to the sole 190. However, the cross-sectional profile including lengths, widths and/or depths of the regions 271-275 of each of the grooves 220 may progressively vary from the top rail 182 to the sole 192.

In FIGS. 6 and 7, the horizontal cross sections of the grooves 238 and 244, respectively, are shown. For example, the regions 271-275 of the groove 238 are smaller in length than the regions 271-275 of the groove 232, respectively. Similarly, the regions 271-275 of the groove 244 are smaller in length than the regions 271-275 of the groove 238, respectively. In another example, the regions 271-275 of the groove 238 may have smaller depths than the regions 271-275 of the groove 232, respectively. Similarly, the regions 271-275 of the groove 244 may have smaller depths than the regions 271-275 of the groove 238, respectively.

The progressive increase in the length, depth and/or width of the regions 271-275 of the grooves 222-232 from the top rail 182 to generally the center of the ball striking face 212 and/or the decrease in the size of the regions 271-275 of the grooves 232-244 from generally the center of the ball striking face 212 to the sole 192 forms a central strike zone 260 (shown in FIG. 3), which may resemble the shape of a golf ball when viewed by an individual in an address position. The approximate visual representation of a golf ball can assist an individual with lining up the ball striking face 212 with the ball. The regions 273, which define the deepest parts of the grooves 220 may be larger in length at the center of the ball striking face 212 and progressively reduce in length toward the top rail 182 and the sole 192. Similarly, the transition regions 272 and 274 may have the greatest length at the center of the ball striking face 212 and progressively reduce in length toward the top rail 182 and the sole 192. Although the lengths of the regions 271-275 may vary depending on the location of the grooves 220 on the ball striking face 212, the depth of similar regions for each groove 220 may be similar or different. For example, the greatest depth of the groove 232 may be similar to the greatest depth of the groove 244. Alternatively, the depth of the grooves 222-244 may vary based on the location of the groove 220 relative to ball striking face 212. Alternatively yet, the depths of the grooves 222-244 may vary in any manner from the top rail 182 to the sole. Although the above examples may describe a particular number of horizontal regions, the apparatus, methods, and articles of manufacture described herein may include more or less horizontal regions.

In another example shown in FIG. 8, a ball striking face 312 includes grooves 320 (shown specifically as grooves 322-344). The ball striking face 312 may be an integral part of the putter face 110 or a separate piece that is attached to the putter face 110. Accordingly, when describing the ball striking face 312, parts of the putter 100 and the putter head 102 are referred to with the same reference numbers described above.

FIG. 9 shows a schematic view of the groove 332 and FIG. 10 shows a horizontal cross section of the groove 332 taken at section line 10-10 of FIG. 8. The groove 332 is shown to be divided into horizontally spanning regions 371-375, which are visually defined in FIGS. 8 and 9 by vertical boundary lines. The horizontal regions 371-375 may define variations in the horizontal cross-sectional profile of the groove 332 from near the toe end 180 to near the heel end 190 and/or from near the top rail 182 to near the sole 192. Horizontal cross-sectional profile of a groove may refer to any property of the groove along the length 393 of the groove, such as length of a certain section of the groove, depth, width, cross-sectional shape, and/or construction materials. In the example of FIGS. 8-12, the grooves 320 include a first vertical wall 350 and a second vertical wall 352 that define the length 393 of the grooves 320. Each of the grooves 320 has a bottom surface 354 which defines a depth of the groove 320. The depth of each groove may vary from the first wall 350 to the second wall 352 according to the cross-sectional profile of the groove 320 in the regions 371-375. Each groove 320 also includes a first horizontal wall 356 and a second horizontal wall 358 that define the vertical boundaries of the groove 320. The distance between the first horizontal wall 356 and the second horizontal wall 358 defines a width 380 of the groove 320. The width 380 may vary from the first vertical wall 350 to the second vertical wall 352 as shown in the examples of FIGS. 38-45. In the example of FIGS. 8-12, however, the first horizontal wall 256 and the second horizontal wall 258 are generally parallel to define a generally constant width 380.

Referring to FIG. 10, the bottom surface 354 at the region 371 may be generally flat and/or slightly sloped to define a first depth 382 at the boundary between 371 and 372. The bottom surface 354 in the region 372 transitions with a step downward from the first depth 382 to a second depth 384 at the boundary between the regions 372 and 373. The bottom surface 354 in the region 372 may be generally flat and/or slightly sloped such that the groove 320 has a generally uniform depth 384 in the region 372. The bottom surface 354 in the region 372 transitions with a step downward from the second depth 384 to a third depth 386. The bottom surface 354 in the region 373 may be generally flat or slightly sloped such that the groove 320 has a generally uniform depth 386 in the region 373. Any of the grooves 320 may be symmetric about the vertical axis y. Accordingly, the shape of the groove 320 on each side of the y axis mirrors the shape of the groove 320 on the other side of the y axis. However, any of the grooves 320 may be asymmetric. The depth 386 represents the greatest depth of the grooves 320.

Referring to FIGS. 10-12, the general cross-sectional profile of the grooves 320 may remain generally similar from the top rail 182 to the sole 190. However, the cross-sectional profile including the lengths, widths and/or the depths of the regions 371-375 of each of the grooves 320 may progressively vary from the top rail 182 to the sole 192. In FIGS. 11 and 12, the horizontal cross sections of the grooves 338 and 344, respectively, are shown. For example, the regions 371-375 of the groove 338 are smaller in length than the regions 371-375 of the groove 332, respectively. Similarly, the regions 371-375 of the groove 344 are smaller in length than the regions 371-375 of the groove 338, respectively. In another example, the regions 371-375 of the groove 338 may have smaller depths than the regions 371-375 of the groove 332, respectively. Similarly, the regions 371-275 of the groove 344 may have smaller depths than the regions 371-375 of the groove 338, respectively.

The progressive increase in the length, depth and/or width of the regions 371-375 of the grooves 322-332 from the top rail 182 to the center of the ball striking face 312 and/or the decrease in the size of the regions 371-375 of the grooves 332-344 form the center of the ball striking face 312 to the sole 192 forms a central strike zone 360 (shown in FIG. 8), which may discretely resemble the shape of a golf ball when viewed by an individual in an address position. The approximate visual representation of a golf ball can assist an individual with lining up the ball striking face 312 with the ball. The regions 373, which define the deepest parts of the grooves 360 may be larger in length at the center of the ball striking face 312 and progressively reduce in length toward the top rail 182 and the sole 192. Similarly, the transition regions 372 and 374 may have the greatest length at the center of the ball striking face 312 and progressively reduce in length toward the top rail 182 and the sole 192. Although the lengths of the regions 371-375 vary depending on the location of the grooves 320 on the ball striking face 312, the depth of similar regions for each groove 320 may be similar or different. For example, the greatest depth of the groove 344 may be similar to the greatest depth of the groove 332. Alternatively, the depth of the grooves 322-344 may vary based on the location of grooves 320 on the ball striking face 312. Alternatively yet, the depths of the grooves 322-344 may vary in any manner from the top rail 182 to the sole. Although the above examples may describe a particular number of horizontal regions, the apparatus, methods, and articles of manufacture described herein may include more or less horizontal regions.

In another example shown in FIG. 13, a ball striking face 412 includes grooves 420 (shown specifically as grooves 422-444). The ball striking face 412 may be an integral part of the putter face 110 or a separate piece that is attached to the putter face 110. Accordingly, when describing the ball striking face 412, parts of the putter 100 and the putter head 102 are referred to with the same reference numbers described above.

Figure 14:
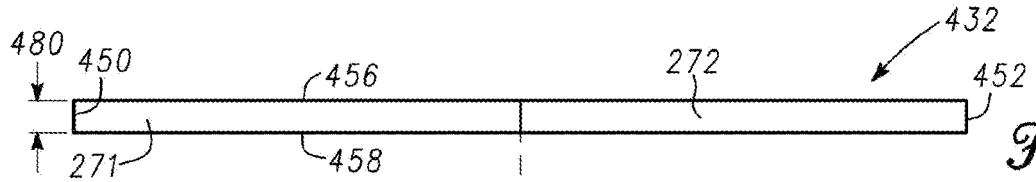
FIG. 14 shows a schematic top view of a groove of the ball striking face of FIG. 13.
Figure 15:
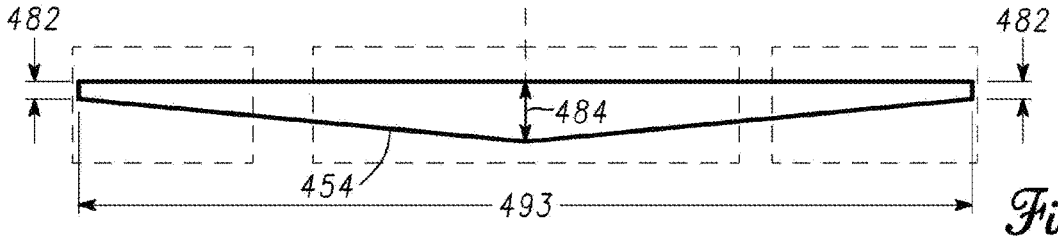
FIG. 15 shows a horizontal cross-sectional diagram of the groove of FIG. 14 taken at section 15-15 of FIG. 13.

FIG. 14 shows a schematic view of the groove 432 and FIG. 15 shows a horizontal cross section of the groove 432 taken at section line 15-15 of FIG. 13. The groove 432 is shown to be divided into horizontally spanning regions 471 and 472, which are visually defined in FIGS. 13 and 14 by the boundary lines of the groove 432 and a vertical line at the center of the groove 432. The horizontal regions 471 and 472 may define variations in the horizontal cross-sectional profiles of the groove 432 from near the toe end 180 to near the heel end 190 and/or from near the top rail 182 to near the sole 192. Horizontal cross-sectional profile of a groove refers to any property of the groove along the length 493 of the groove, such as length of a certain section of the groove, depth, width, cross-sectional shape, and/or construction materials. In the example of FIGS. 13-17, the grooves 420 include a first vertical wall 450 and a second vertical wall 452 that define the length 493 of the grooves 420. Each of the grooves 420 has a bottom surface 454 which defines a depth of the groove 420. The depth of each groove may vary from the first wall 450 to the second wall 452 according to the cross-sectional profile of the groove 420 in the regions 471 and 472. Each groove 420 also includes a first horizontal wall 456 and a second horizontal wall 458 that define the vertical boundaries of the groove 420. The distance between the first horizontal wall 456 and the second horizontal wall 458 defines a width 480 of the groove 420. The width 480 may vary from the first vertical wall 450 to the second vertical wall 452 as shown in the examples of FIGS. 38-45. In the example of FIGS. 13-17, however, the first horizontal wall 456 and the second horizontal wall 458 are generally parallel to define a generally constant width 480.

Referring to FIG. 15, the bottom surface 454 at the region 471 has a linear profile and is downwardly sloped. The grooves 450 are symmetric about the center vertical axis y. Accordingly, the bottom surface 454 at the region 472 has a similar linear profile and is similarly downwardly sloped as the bottom surface 454 at the region 471. Accordingly, the depth of the grooves 420 gradually increase from a depth 482 at the first wall 452 and second wall 454 to a depth 484 at the center of the grooves 420. The depth 484 represents the deepest part of the grooves 420, which may be at the center of the groove 420.

Figure 16:
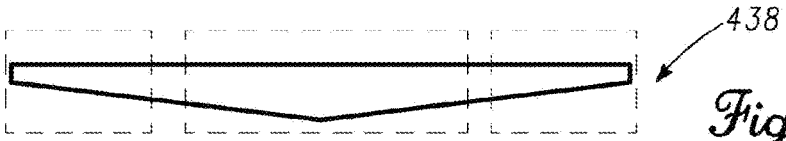
FIG. 16 shows a horizontal cross-sectional diagram of another groove of the ball striking face FIG. 13.
Figure 17:
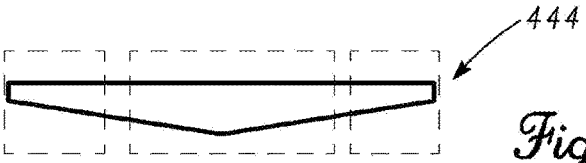
FIG. 17 shows a horizontal cross-sectional diagram of another groove of the ball striking face FIG. 13.

Referring to FIGS. 15-17, the general cross-sectional profile of the grooves 420 may remain generally similar from the top rail 182 to the sole 190. However, the cross-sectional profile including the lengths and/or the depths of the regions 471 and 472 of each of the grooves 420 may progressively vary from the top rail 182 to the sole 192. For example, the regions 471 and 472 of the groove 438 are smaller in length than the regions 471 and 472 of the groove 332, respectively. Similarly, the regions 471 and 471 of the groove 444 are smaller in length than the regions 471 and 472 of the groove 438, respectively. In another example, the regions 471 and 472 of the groove 438 may have smaller depths than the regions 471 and 472 of the groove 432, respectively. Similarly, the regions 471 and 472 of the groove 444 may have smaller depths than the regions 471 and 472 of the groove 438, respectively.

The progressive increase in the length, depth and/or width of the regions 471 and 472 of the grooves 422-432 from the top rail 182 to the center of the ball striking face 412 and/or the decrease in the size of the regions 471 and 472 of the grooves 432-444 form the center of the ball striking face 412 to the sole 192 forms a central strike zone 460 (shown in FIG. 13). The regions 471 and 472 may have the greatest length at the center of the ball striking face 412 and progressively reduce in length toward the top rail 182 and the sole 192. Although the lengths of the regions 471 and 472 vary depending on the location of the grooves 420 on the ball striking face 412, the depth of similar regions for each groove 420 may be similar or different. For example, the greatest depth of the groove 444 may be similar to the greatest depth of the groove 432. Alternatively, the depth of the grooves 422-444 may vary based on the location of grooves 420 on the ball striking face 412. Alternatively yet, the depths of the grooves 422-444 may vary in any manner from the top rail 182 to the sole. Although the above examples may describe a particular number of horizontal regions, the apparatus, methods, and articles of manufacture described herein may include more or less horizontal regions.

Figure 18:
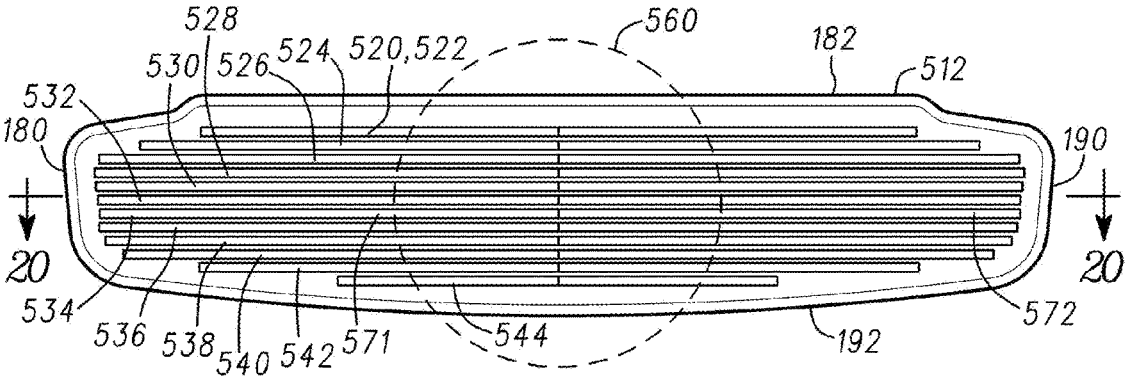
FIG. 18 shows a schematic diagram of a ball striking face of a putter according to one example.

In another example shown in FIG. 18, a ball striking face 512 includes grooves 520 (shown specifically as grooves 522-544). The ball striking face 512 may be an integral part of the putter face 110 or a separate piece that is attached to the putter face 110. Accordingly, when describing the ball striking face 512, parts of the putter 100 and the putter head 102 are referred to with the same reference numbers described above.

FIG. 19 shows a schematic view of the groove 532 and FIG. 20 shows a horizontal cross section of the groove 532 taken at section line 20-20 of FIG. 18. The groove 532 is shown to be divided into horizontally spanning regions 571 and 572, which are visually defined in FIGS. 18 and 19 by the boundary lines of the groove 532 and a vertical line at the center of the groove 532. The horizontal regions 571 and 572 may define variations in the horizontal cross-sectional profiles of the groove 532 from near the toe end 180 to near the heel end 190 and/or from near the top rail 182 to near the sole 192. Horizontal cross-sectional profile of a groove refers to any property of the groove along the length 593 of the groove, such as a length of a certain section of the groove, depth, width, cross-sectional shape, and/or construction materials. In the example of FIGS. 18-22, the grooves 520 include a first vertical wall 550 and a second vertical wall 552 that define the length 593 of the grooves 520. Each of the grooves 520 has a bottom surface 554 which defines a depth of the groove 520. The depth of each groove may vary from the first wall 550 to the second wall 552 according to the cross-sectional profile of the groove 520 in the regions 571 and 572. Each groove 520 also includes a first horizontal wall 556 and a second horizontal wall 558 that define the vertical boundaries of the groove 520. The distance between the first horizontal wall 556 and the second horizontal wall 558 defines a width 580 of the groove 520. The width 580 may vary from the first vertical wall 550 to the second vertical wall 552 as shown in the examples of FIGS. 38-45. In the example of FIGS. 18-22, however, the first horizontal wall 556 and the second horizontal wall 558 are generally parallel to define a generally constant width 580.

Referring to FIG. 20, the bottom surface 554 at the region 571 has a linear profile and is downwardly sloped. The bottom surface 554 in the region 572 also has a linear profile and is downwardly sloped. However, because the second wall 552 is longer than the first wall 550, the bottom surface 554 in the region 572 has a smaller slope than the bottom surface 554 in the region 571. Accordingly, the grooves 550 of this example are asymmetric about the vertical center axis y. Thus, the grooves 250 have a first depth 582 defined by the first wall 550, a second depth 584 defined by the second wall 552 and a center depth 586, which is gradually reached from the depths 582 and 584 according to the downwardly sloped bottom surface 554 of the regions 571 and 572, respectively. The center depth 586 may be the depth of the deepest part of the groove 520.

Referring to FIGS. 20-22, the general cross-sectional profile of the grooves 520 may remain generally similar from the top rail 182 to the sole 190. However, the cross sectional profile including the lengths, widths and/or the depths of the regions 571 and 572 of each of the grooves 520 may progressively vary from the top rail 182 to the sole 192. In FIGS. 21 and 22, the horizontal cross sections of the grooves 538 and 544, respectively, are shown. For example, the regions 571 and 572 of the groove 538 are smaller in length than the regions 571 and 572 of the groove 532, respectively. Similarly, the regions 571 and 572 of the groove 544 are smaller in length than the regions 571 and 572 of the groove 538, respectively. In another example, the regions 571 and 572 of the groove 538 may have smaller depths than the regions 571 and 572 of the groove 532, respectively. Similarly, the regions 571 and 572 of the groove 544 may have smaller depths than the regions 571 and 572 of the groove 538, respectively.

The progressive increase in the length, depth and/or width of the regions 571 and 572 of the grooves 522-532 from the top rail 182 to the center of the ball striking face 512 and/or the decrease in the size of the regions 571 and 572 of the grooves 532-544 form the center of the ball striking face 512 to the sole 192 forms a central strike zone 560 (shown in FIG. 18). The regions 571 and 572 may have the greatest length at the center of the ball striking face 512 and progressively reduce in length toward the top rail 182 and the sole 192. Although the lengths of the regions 571 and 572 vary depending on the location of the grooves 520 on the ball striking face 512, the depth of similar regions for each groove 520 may be similar or different. For example, the greatest depth of the groove 544 may be similar to the greatest depth of the groove 532. Alternatively, the depth of the grooves 522-544 may vary based on the location of grooves 520 on the ball striking face 512. Alternatively yet, the depths of the grooves 522-544 may vary in any manner from the top rail 182 to the sole. Although the above examples may describe a particular number of horizontal regions, the apparatus, methods, and articles of manufacture described herein may include more or less horizontal regions.

The grooves 220, 320, 420 and 520 described above illustrate four examples of horizontal cross-sectional profile of grooves for use with the putter 100. Other examples of horizontal cross sectional profiles are shown in FIGS. 29-37, where each groove may have a length 590, a first depth 591, a second depth 592 and/or a third depth 593. A groove may be defined by any number of horizontal regions, where any one or more regions have similar properties or dissimilar properties. A groove that may be symmetric or asymmetric about the y axis, for example, may have a bottom surface with a complex combination of linear and nonlinear shapes defining similar or various depths from the toe end 180 to the heel end 190. Such a groove may be described with a large number of horizontal regions, where each region defines one or more of the noted complex shapes. Accordingly, the number, arrangement, sizes and the other properties of the horizontal ranges described above are in no way limiting to the groove cross-sectional profiles according to the disclosure.

In the above examples, the grooves on each corresponding ball striking face have similar shapes. However, the grooves on ball striking face may have dissimilar shapes. For example, a ball striking face may include a combination of grooves 220 and 320. In another example, the ball striking face may include a combination of grooves 420 and 520. Thus, any combination of groove cross-sectional profiles may be used on a ball striking face to impart a particular ball striking property to the putter.

The horizontal cross-sectional profiles of the grooves may progressively and proportionally vary from the top rail 182 to the center of the ball striking face and may progressively vary from the center of the ball striking face to the sole 192. The noted progressive variation may define a ball strike zone that is larger at the center of the ball striking face than near the top rail 182 and the sole 192. Furthermore, the progressive noted variation of the grooves' horizontal cross-sectional profiles provides grooves at the center of the ball striking face and around the center of the ball striking face that have longer deep groove sections than grooves near the top rail 182 and the sole 192. However, the above-described progressive variation of the grooves is exemplary and other progressive variation schemes may be used to impart particular ball striking properties to various portions of the ball striking face.

Referring to FIG. 23, a ball striking face 612 according to another example is shown having grooves 620. FIGS. 24-26 show a vertical cross-sectional shape of the grooves 620 as viewed from section line 24-24 of FIG. 23. In FIG. 24, the vertical cross-sectional shape of the groove 620 is box-shaped, rectangular or square. In FIG. 25, the vertical cross-sectional shape of the groove 620 is V-shaped. In FIG. 26, the vertical cross-sectional shape of the groove 620 is U-shaped. The vertical cross-sectional groove shapes of FIGS. 24-26 are applicable to any groove according to the disclosure. For example, the vertical cross-sectional shape of the grooves 220 may be rectangular or square according to the grooves 620 of FIG. 24. In another example, the vertical cross-sectional shape of the grooves 620 may be V-shaped according to the groove 620 of FIG. 25. Furthermore, the vertical cross-sectional shape of a groove may vary from the toe end 180 to the heel end 190. For example, with reference to FIGS. 4 and 5, a groove 220 may be have a square or rectangular vertical cross-sectional shape in regions 271 and 275, U-shaped vertical cross-sectional shape in regions 271 and 274, and V-shaped vertical cross-sectional shape in region 273. Additionally, the vertical cross-sectional shapes of the grooves may also vary from the top rail 182 to the sole 190. For example, grooves near the top rail 182 and the sole 192 may have a square vertical cross-sectional shape, while the grooves at the center of the club face may have a U-shaped vertical cross-sectional shape.

The ball striking face of the putter in the above examples is shown to have grooves from the top rail 182 to the sole 192. However, a ball striking face may have more or less grooves, or have sections that are without grooves. For example, a ball striking face may have several grooves at the center section of the ball strike face and be without grooves at sections near the top rail 182 or the sole 192.

The grooves are not limited to extending horizontally across the ball striking face. The ball striking face may have vertical grooves that vary in depth as described above or a combination of vertical and horizontal grooves with varying horizontal and/or vertical cross-sectional profiles. The orientation of the grooves may be such that a matrix-like ball striking face is provided on the putter.

Figure 27:
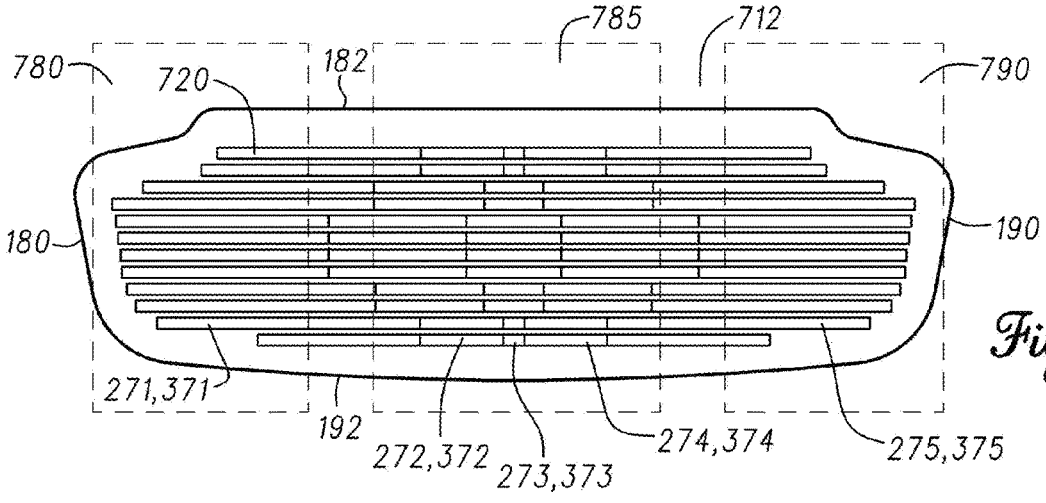
FIG. 27 shows a schematic diagram of a ball striking face of a putter according to one example.

Referring to FIG. 27, a ball striking face 712 having grooves 720 may be horizontally separated into three portions, which are the toe portion 780, a center portion 785 and a heel portion 790. The ball striking face 712 may be similar to the ball striking face 212 and 312 described above. Accordingly the grooves 720 have regions 271-275 and 371-375 similar to grooves 220 and 320, respectively, described above. The three portions described above horizontally separate the ball striking face 712 and span vertically from the top rail 182 to the sole 192. The toe portion 780 is near the toe end 180, the heel portion 790 is near the heel end 190, and the center portion 785 is between the toe portion 780 and the heel portion 790. According to various examples, the depth of the grooves 720 at the toe portion 780 and the heel portion 790 may not be greater than the depth of the grooves 720 at the center portion 785. In one example, the shallowest depth of the grooves 720, which may be nearest to the toe end 180 or nearest to the heel end 190, may be approximately 0.003 inch. At or near the center portion 785, the depth of the grooves 720 may increase as described above to a depth of approximately 0.017 inch. The variable depth may include a portion with a depth of at least 0.020 inches but less than 0.022 inches. The variable width may include a portion with a width of at least 0.035 inches but less than 0.037 inches.

Figure 28:
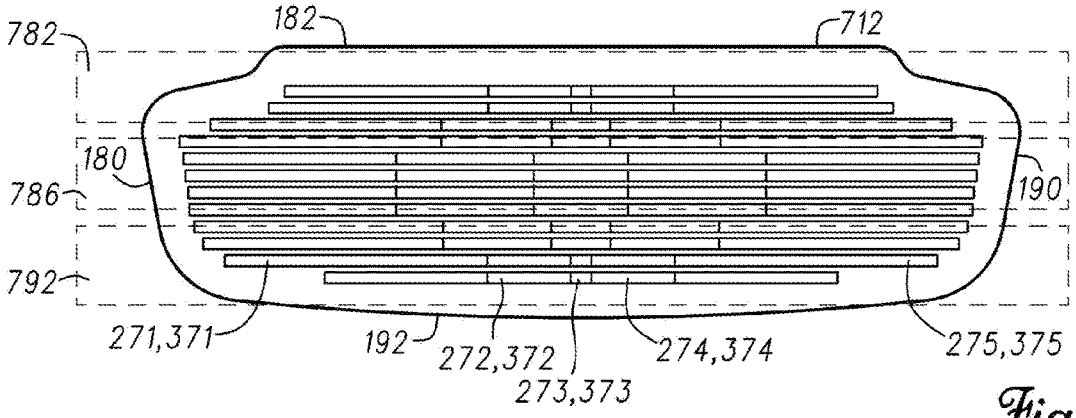
FIG. 28 shows a schematic diagram of a ball striking face of a putter according to one example.
Figure 29:
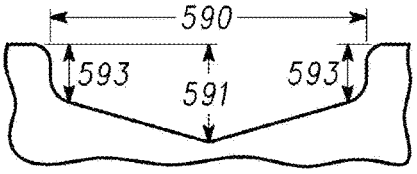
FIGS. 29-37 show schematic diagrams of exemplary horizontal cross sections of a groove of a ball striking face of a putter.
Figure 30:
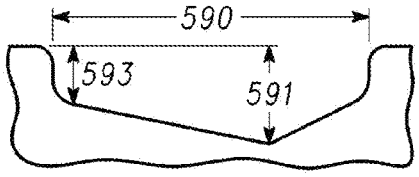
Figure 31:
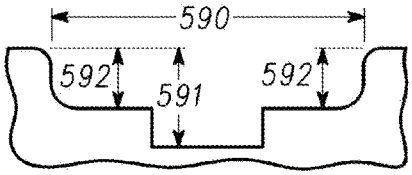
Figure 32:
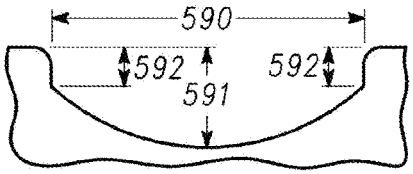
Figure 33:
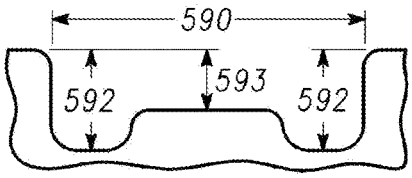
Figure 34:
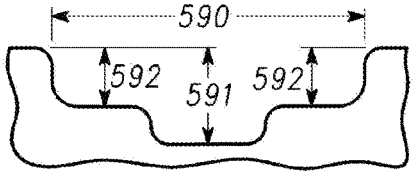
Figure 35:
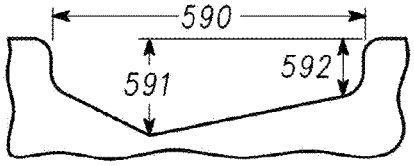
Figure 36:
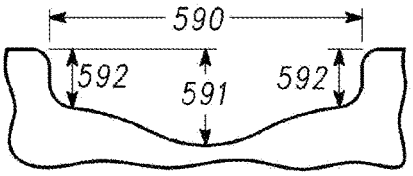
Figure 37:
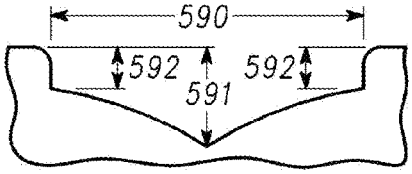
Figure 38:
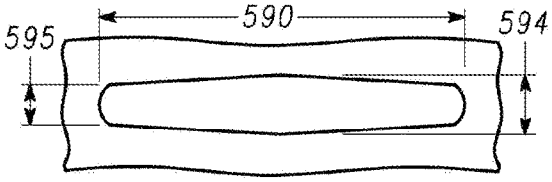
FIGS. 38-45 show schematic top views of exemplary grooves of a ball striking face of a putter.
Figure 39:
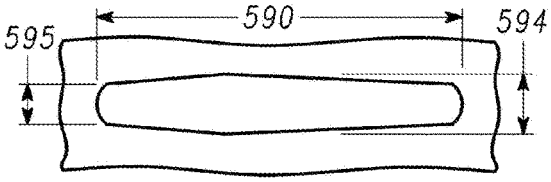
Figure 40:
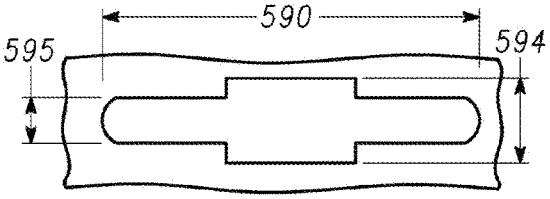
Figure 41:
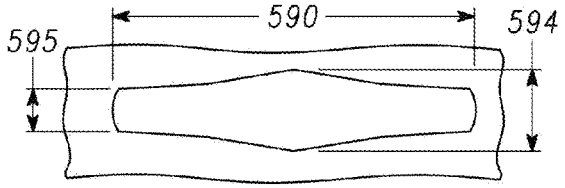
Figure 42:
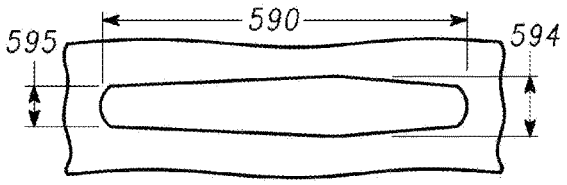
Figure 43:
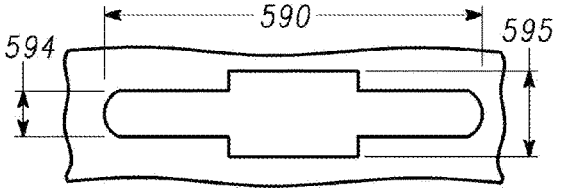
Figure 44:
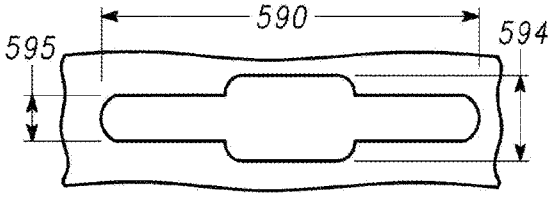
Figure 45:
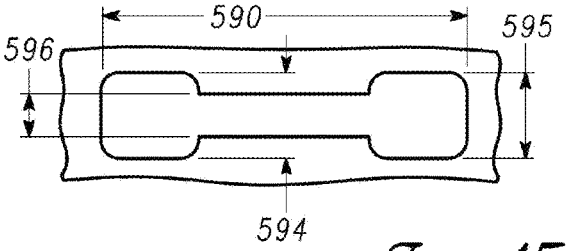

Referring to FIG. 28, the ball striking face 712 may be vertically separated into three portions, which are the top rail portion 782, the mid portion 786 and the sole portion 792. These portions vertically separate the ball striking face 712 and span horizontally from the toe end 180 to the heel end 190. The top rail portion 782 is near the top rail 182, the sole portion 792 is near the sole 192, and the mid portion 786 is between the top rail portion 782 and the sole portion 792. The length of the deepest portion of a groove 720 may vary from the top rail portion 782 to the mid portion 786 and from the mid portion 786 to the sole portion 792. For example, with respect to the examples described above, the length of the deepest portion of a groove may refer to the groove 720 that is proximately centrally located between the top rail portion 782 and the sole portion 792. As shown in FIGS. 27 and 28, the length of the grooves 710 may be greatest at the mid portion 786 and gradually reduce toward the top rail portion 782 and toward the sole portion 792.

FIGS. 29-37 show examples of different groove horizontal cross-sectional profiles according to the disclosure. In the above examples, the width of the grooves 220, 320, 420 and 520 is shown to have a rectangular profile. However, a groove according to the disclosure may have different width profiles as shown by the examples of FIGS. 38-45. Accordingly, a groove according to the disclosure may have any horizontal cross-sectional profile, vertical cross-sectional profile, width profile and/or depth profile.

A cross-sectional profile of a groove including variations in lengths, depth, width and/or cross-sectional shape of the groove may affect ball speed, control, and/or spin. The disclosed variable depth grooves may improve the consistency of the ball speed after being struck by the putter face by about 50% over a plastic putter face insert, and by about 40% over a non-grooved aluminum putter face insert. Striking a ball with a putter having grooves according to the disclosure: (1) may result in lower ball speeds, which may result in decreased ball roll out distance; (2) may result in heel and toe shots to have decreased ball speeds compared to center hits, and also may result in shorter ball roll out distance; (3) allow relatively lower and higher handicap players to strike the ball with different locations on the putter face (higher handicap players tend to hit lower on the ball striking face whereas lower handicap player tend to hit higher on the ball striking face. Also, relatively higher handicap players may have a wider range of hit locations whereas relatively lower handicap players may have a closer range of hit locations; and/or (4) a putter face with grooves in the center of the face may result in reduced ball speed/roll out distance for center shots, which may result in a more consistent ball speed/roll out distances for center/heel/toe shots.

Figure 46:
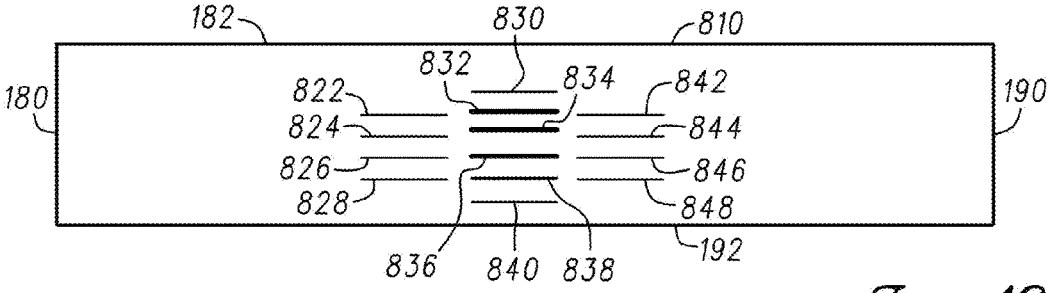
FIG. 46 shows a schematic diagram of a ball striking face of a putter according to one example.

Referring to FIG. 46, another example of a putter face 810 having grooves of variable cross-sectional profiles is shown. The putter face 810 is shown to have fourteen grooves, which are grouped into grooves 822-828 near the toe end 180, grooves 830-840 at the center of the putter face 810, and grooves 842-848 near the heel end 190. In this example, the more prominent grooves are located at the center of the putter face 810, and less prominent grooves are on the periphery of the center. A more prominent groove may refer to a groove that has a greater depth and/or width as compared to a less prominent groove. As shown in FIG. 46, the grooves 832-838 may be more prominent that the remaining grooves on the putter face 810. Furthermore, portions of the putter face 810 may be without grooves. These portions are referred to with reference number 850.

Figure 47:
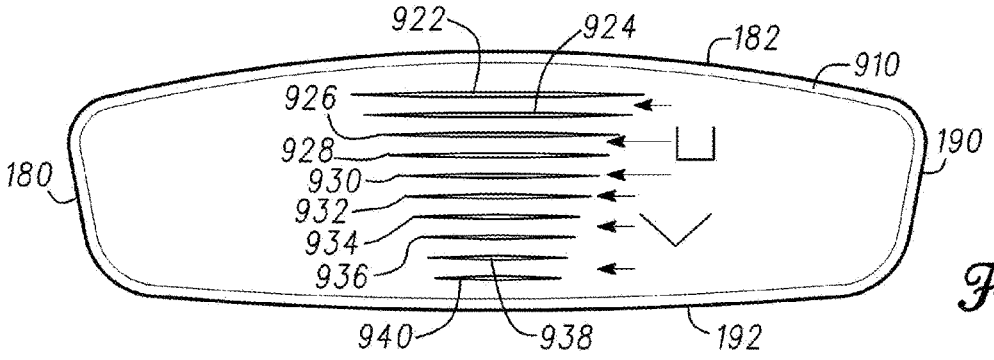
FIG. 47 shows a schematic diagram of a ball striking face of a putter according to one example.

Referring to FIG. 47, another example of a putter face 910 having grooves of variable cross-sectional profile is shown. The putter face 910 is shown to have ten grooves 922-940. The length of each groove progressively increases from the top rail 182 to the sole 190. Each of the grooves 922-940 or groups of the grooves 922-940 may have different vertical cross-sectional shapes. For example, grooves 922-930 are shown to have box-shaped vertical cross sections, while grooves 932-940 are shown to have V-shaped vertical cross sections.

Further referring to FIG. 47, the putter face 910 comprises variable width grooves 922-940, and variable width land portions positioned between the grooves 922-940. The width of the grooves 922-940 and the land portions between the grooves 922-940 can comprise a variable width between the toe end 180 and the heel end 190. Specifically, the width of the grooves 922-940 can decrease in a direction extending from the center portion of the putter face 910 to the toe end 180, and in a direction extending from the center portion of the putter face 910 to the heel end 190. The width of the land portions can increase in a direction extending from the center portion of the putter face 910 to the toe end 180, and in a direction extending from the center portion of the putter face 910 to the heel end 190. Further, in one embodiment, the width of the land portions can be greater than the width of the grooves 922-940 at the center portion. In another embodiment, the width of the land portions can be less than the width of the grooves 922-940 at the center portion.

Stated another way, the width of the grooves 922-940 can be greater than the width of the land portions at the center portion.

Figure 48:
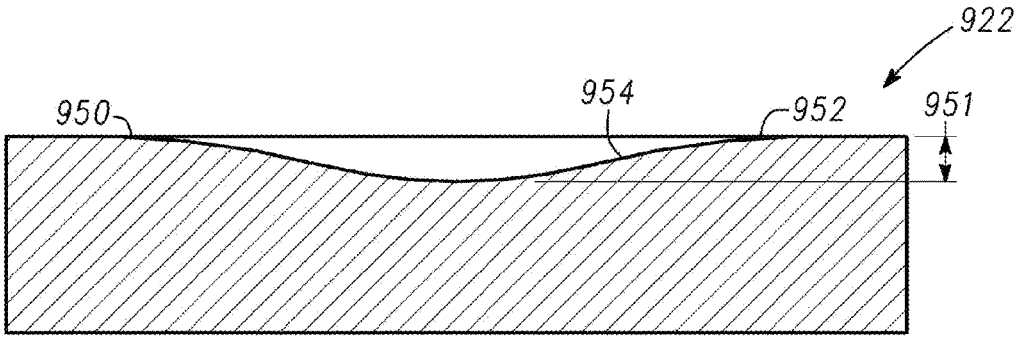
FIG. 48 is a horizontal cross-sectional view of a groove of a putter according to one example.

Referring to FIG. 48, a horizontal cross section of a groove 922 according to another embodiment is shown. A bottom surface 954 of the groove 922 is shown to gradually recede from the edges 950 and 952 of the groove to a greatest depth 951 of the groove 922. Any of the grooves according to the disclosure may have the same horizontal cross-sectional shape as the groove 922. Any of the grooves according to the disclosure may have the same depth 951. However, the depth 951 may be proportionally reduced as the length of the groove is reduced.

Figure 49:
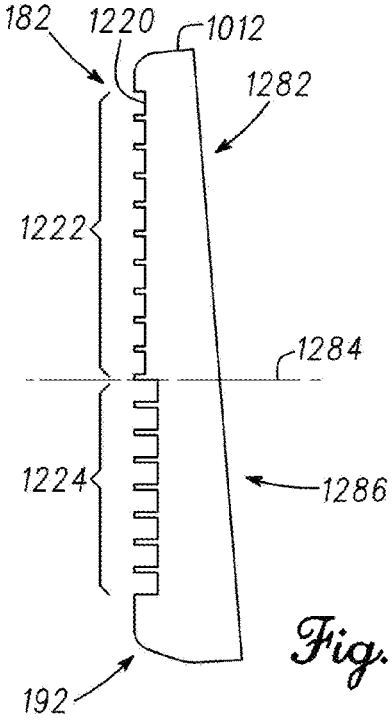
FIG. 49 shows a vertical schematic cross-sectional diagram of a putter according to one example.

In another example shown in FIG. 49, a ball striking face 1012 may include grooves 1220 (shown specifically as grooves 1222-1256). The ball striking face 1012 may be for use with the putter 100. Accordingly, parts of the putter 100 and the putter head 102 are referred to with the same reference numbers presented above. The grooves may have any cross sectional shape, length and width according to the disclosure.

Referring to FIG. 49, a side cross-sectional view of a ball striking face 1012 having grooves 1220 according to another example is shown. The ball striking face 1012 may be separated into two portions with respect to the grooves 1220. The ball striking face 1012 may include a top rail portion 1282 and the sole portion 1286. The top rail portion 1282 and the sole portion 1286 may vertically separate the ball striking face 1012 and span horizontally from the toe end 180 to the heel end 190. The top rail portion 1282 may extend generally from a center portion of the ball striking face 1012, which is represented by the center line 1284, to near the top rail 182 and include the grooves 1222. The sole portion 1286 may extend generally from near the sole 192 to the center portion 1284 and include the grooves 1224. The grooves 1224 of the sole portion 1286 may have a greater depth at one or more locations along each groove 1224 than the grooves 1222 of the top rail portion 1282. By having shallower grooves 1222 at the top rail portion 1282, the speed by which a golf ball rolls forward after being struck by the putter may increase so as to provide a more consistent and smooth ball roll out. Alternatively, the depth of the grooves 1220 may progressively reduce in one or more groove steps from the center portion 1284 to the top rail 182 (not shown). In another example, the depth of pairs of grooves may progressively reduce from the center portion 1284 to the top rail 182 (not shown). Accordingly, the reduction in groove depth from the sole 192 to the top rail 182 may be for each groove, for pairs of grooves or for various groupings of the grooves.

Figure 50:
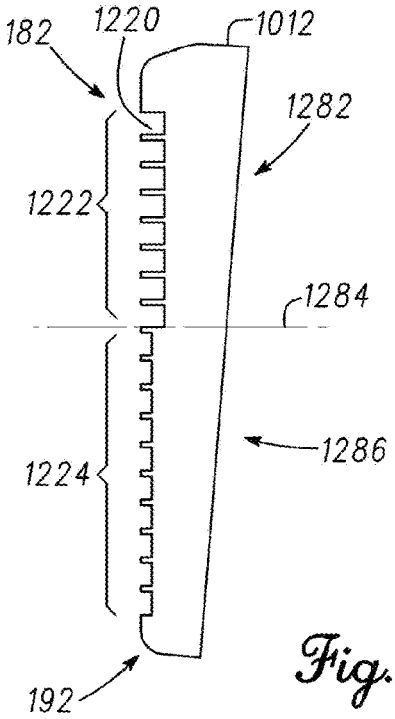
FIG. 50 shows a vertical schematic cross-sectional diagram of a putter according to one example.

Referring to FIG. 50, the grooves 1224 of the sole portion 1286 may have a smaller depth at one or more locations along each groove 1224 than the grooves 1222 of the top rail portion 1282. Alternatively, the depth of the grooves 1220 may progressively increase in one or more groove steps from the center portion 1284 and/or the sole 192 to the top rail 182 (not shown). In another example, the depth of pairs of grooves may progressively increase from the center portion 1284 and/or the sole 192 to the top rail 182 (not shown). Accordingly, the increase in groove depth from the center portion 1284 and/or the sole 192 to the top rail 182 may be for each groove, for pairs of grooves or for various groupings of the grooves.

Diagonal Grooves

Figure 51:
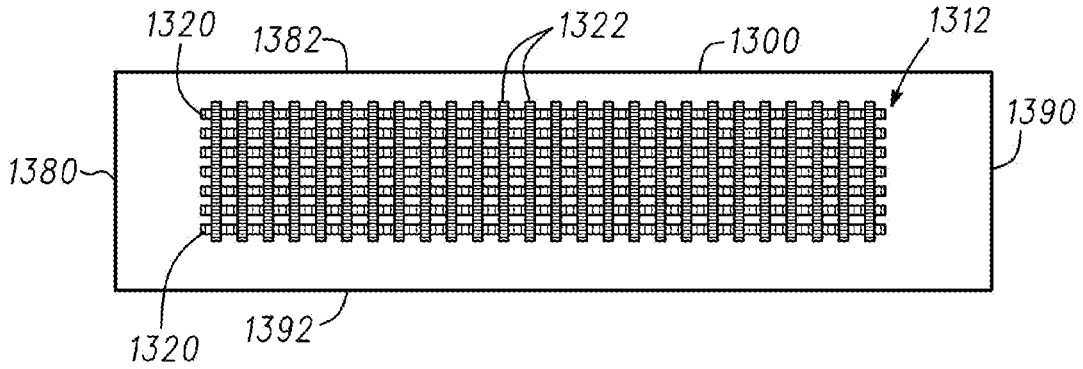
FIG. 51 shows a putter face according to another example.
Figure 52:
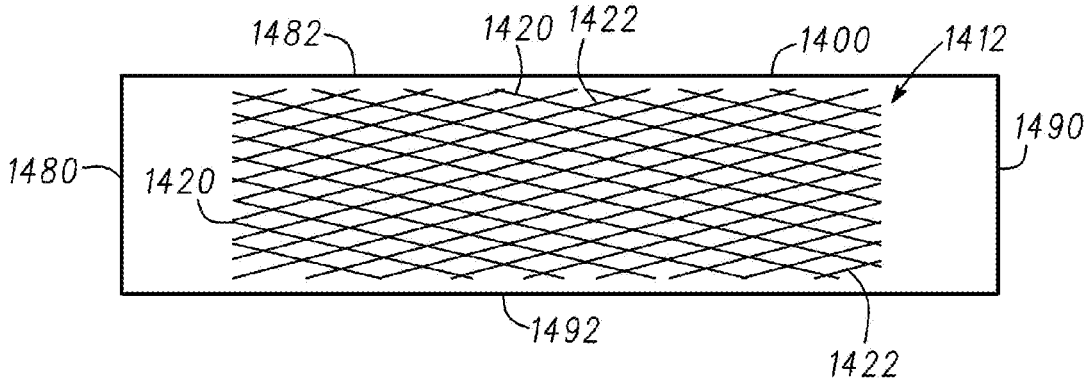
FIG. 52 shows a putter face according to another example.
Figure 53:
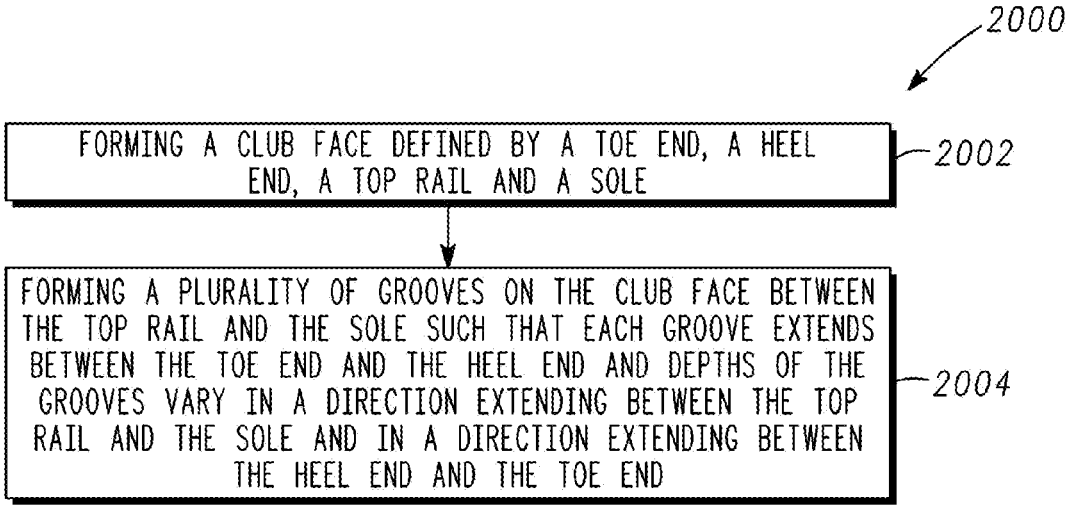
FIG. 53 shows a method of manufacturing a golf club according to one example.

FIGS. 51 and 52 show other examples according to the disclosure. Referring to FIG. 51, a putter head 1300 includes a ball striking face 1312, which has a plurality of horizontal grooves 1320 and vertical grooves 1322. Each of the grooves 1320 and 1322 may have a different configuration as compared to another groove, such as variable cross-sectional profiles, depth profiles, width profiles, length profiles and/or other groove characteristics from the toe end 1380 to near the heel end 1390 and/or from a top rail 1382 to a sole 1392. For example, the depth of the horizontal grooves 1320 may progressively increase in one or more groove steps from the top rail 1382 to the sole 1386. The apparatus, methods, and articles of manufacture described herein are not limited in this regard.

Figure 68:
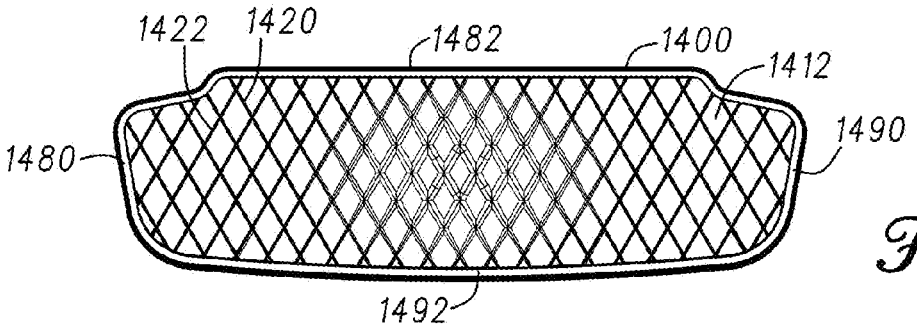
FIG. 68 shows a schematic diagram of a ball striking face of a putter according to one example.
Figure 69:
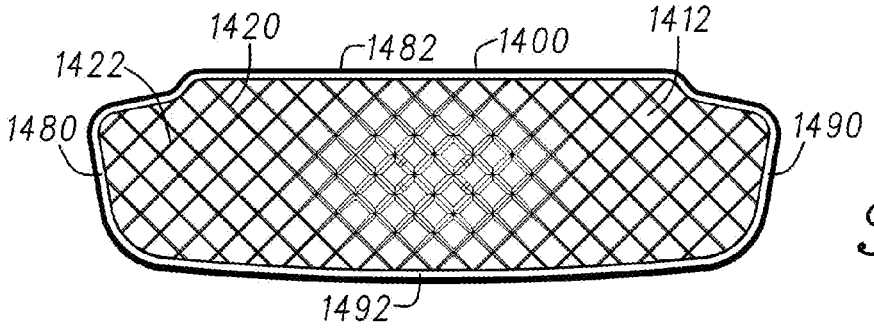
FIG. 69 shows a schematic diagram of a ball striking face of a putter according to one example.

Referring to FIG. 52, a putter head 1400 includes a ball striking face 1412, which has a plurality of first diagonal grooves 1420 and second diagonal grooves 1422. The first diagonal grooves 1420 may be generally parallel to each other. Similarly, the second diagonal grooves 1422 may be generally parallel to each other. The first diagonal grooves 1420 and the second diagonal grooves 1422 may be transverse to each other as shown in FIG. 52. For example, the first diagonal grooves 1420 may intersect the second diagonal grooves 1422 at an angle of 30°, 45°, 60° or 90°. Each of the grooves 1420 and 1422 may have a different configuration as compared to another groove, such as variable cross-sectional profiles, depth profiles, width profiles, length profiles and/or other groove characteristics from the toe end 1480 to near the heel end 1490 and/or from a top rail 1482 to a sole 1492. For example, the depth of the first diagonal grooves 1420 may progressively increase in one or more groove steps from the top rail 1482 to the sole 1486. FIGS. 68 and 69 illustrate variations of embodiments for putter head 1400. The apparatus, methods, and articles of manufacture described herein are not limited in this regard.

Figure 54:
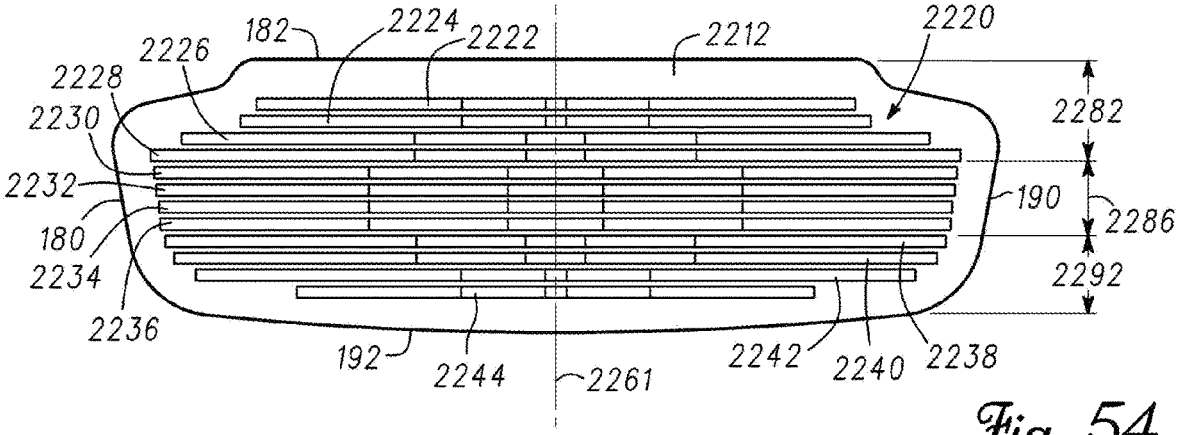
FIG. 54 shows a schematic diagram of a ball striking face of a putter according to one example.

Referring to FIG. 54, a ball striking face 2212 according to another example is shown. The ball striking face 2212 may be vertically separated into and defined by three portions, which are the top rail portion 2282, the mid portion 2286 and the sole portion 2292. The top rail portion 2282, the mid portion 2286 and the sole portion 2292 vertically separate the ball striking face 2212 and span horizontally from the toe end 180 to the heel end 190. The top rail portion 2282 is near the top rail 182, the sole portion 2292 is near the sole 192, and the mid portion 2286 is between the top rail portion 2282 and the sole portion 2292. In FIG. 54, the ball striking face 2212 may have twelve grooves 2222-2244, which may be collectively referred to as the grooves 2220. For example, grooves 2222, 2224, 2226 and 2228 may be considered to be in the top rail portion 2282; grooves 2230, 2232, 2234 and 2236 may be considered to be in the mid portion 2286; and grooves 2238, 2240, 2242 and 2244 may be considered to be in the sole portion 2292. However, one or more of the grooves 2220 may be considered to be in two adjacent portions of the three vertically separated portions, i.e., part of a groove 2220 overlaps and adjacent portion. The length of the grooves 2220 may be greatest at the mid portion 2286 and gradually reduce toward the top rail portion 2282 and toward the sole portion 2292. Alternatively, the length of the grooves 2220 may vary according to the peripheral profile of the ball striking face 2212. The top rail portion 2282, the mid portion 2286 and the sole portion 2292 are exemplary and may define portions on the ball striking face 2212 where the grooves 2220 that may be located in such portions have one or more similar configurations or characteristics. Accordingly, the ball striking face 2212 may be defined by various vertical and/or horizontal portions associated with one or more groove configurations or characteristics. The apparatus, methods, and articles of manufacture described herein are not limited in this regard.

Figure 55:
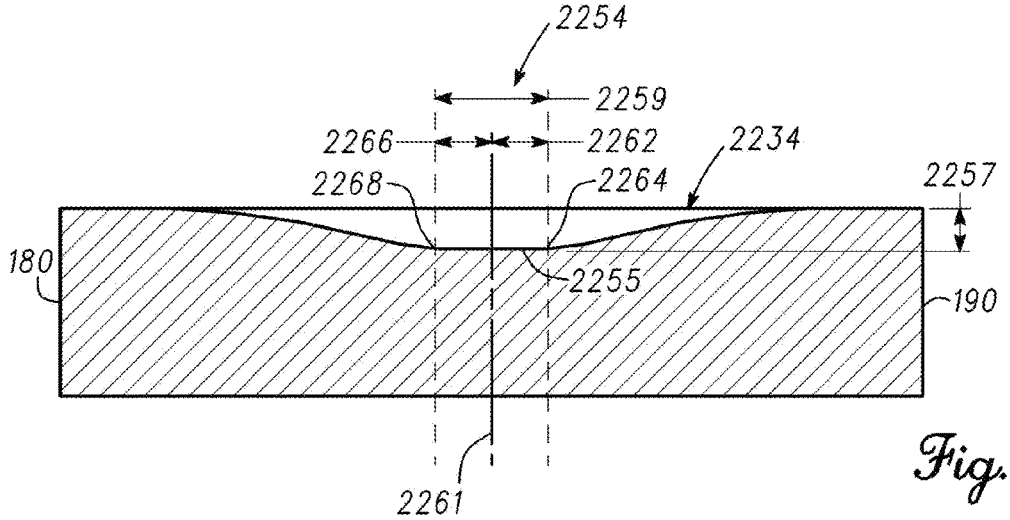
FIG. 55 shows a cross section of a groove of the ball striking face of FIG. 54.

FIG. 55 shows a horizontal cross section of the ball striking face 2212 taken at the groove 2234. Each groove 2220 may include a center portion 2254 having a bottom surface 2255, which may define a greatest depth 2257 of the groove 2220. The center portion 2254 has a length 2259, which may vary depending on the location of the groove 2220 on the ball striking face 2212. In the example of FIG. 54, the center portions 2254 of the grooves 2220 of the mid portion 2286 have generally the same length. The apparatus, methods, and articles of manufacture described herein are not limited in this regard.

A center of the ball striking face 2212 may be defined by a y-axis 2261. The y-axis 2261 may also define a center axis of the center portion 2254 as shown in FIGS. 54 and 55. However, the center portion 2254 may be offset (not shown) relative to the y-axis 2261. According to the example of FIG. 55, each of the bottom surfaces 2255 of the grooves 2230, 2232, 2234 and 2236 extends substantially equally from the y-axis 2261 toward the toe end 180 and toward the heel end 190. As shown in FIG. 55, a distance between the y-axis 2261 and the toe edge portion 2264 of the center portion 2254 may be defined as a length 2262. The toe edge portion 2264 may be defined as a portion of a groove between the y-axis 2261 and the toe end 190 where the depth of the groove increases from the depth 2257 and transitions to the opening or the top of the groove. A distance between the y-axis 2261 and the heel edge portion 2268 of the center portion 2254 may be defined as a length 2266. The heel edge portion 2268 may be defined as a portion of a groove between the y-axis 2261 and the heel end 180 where the depth of the groove increases from the depth 2257 and transitions to the opening or the top of the groove. According to the example of FIGS. 54 and 55, the length 2262 is substantially the same as the length 2266. A putter having a ball striking face 2212 as shown in FIG. 54 may be suitable for an individual who has a straight putting stroke.

Figure 56:
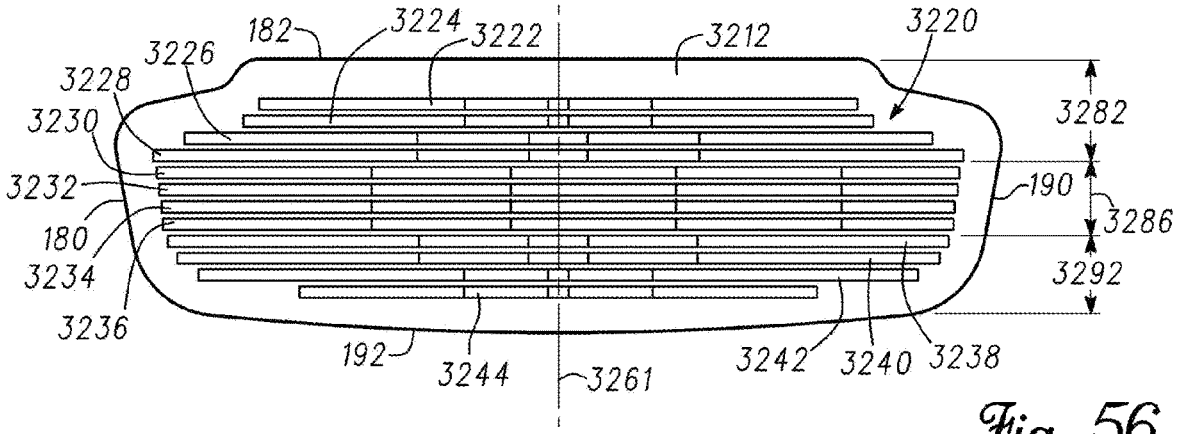
FIG. 56 shows a schematic diagram of a ball striking face of a putter according to one example.

Referring to FIG. 56, a ball striking face 3212 according to another example is shown. The ball striking face 3212 may be vertically separated into and defined by three portions, which are the top rail portion 3282, the mid portion 3286 and the sole portion 3292. The top rail portion 3282, the mid portion 3286 and the sole portion 3292 vertically separate the ball striking face 3212 and span horizontally from the toe end 180 to the heel end 190. The top rail portion 3282 is near the top rail 182, the sole portion 3292 is near the sole 192, and the mid portion 3286 is between the top rail portion 3282 and the sole portion 3292. In FIG. 56, the ball striking face 3212 may have twelve grooves 3222-3244, which may be collectively referred to as the grooves 3220. For example, grooves 3222, 3224, 3226 and 3228 may be considered to be in the top rail portion 3282; grooves 3230, 3232, 3234 and 3236 may be considered to be in the mid portion 3286; and grooves 3238, 3240, 3242 and 3244 may be considered to be in the sole portion 3292. However, one or more of the grooves 3220 may be considered to be in two adjacent portions of the three vertically separated portions, i.e., part of a groove 3220 overlaps and adjacent portion. The length of the grooves 3220 may be greatest at the mid portion 3286 and gradually reduce toward the top rail portion 3282 and toward the sole portion 3292. Alternatively, the length of the grooves 3220 may vary according to the peripheral profile of the ball striking face 3212. The top rail portion 3282, the mid portion 3286 and the sole portion 3292 are exemplary and may define portions on the ball striking face 3212 where the grooves 3220 that may be located in such portions have one or more similar configurations or characteristics. Accordingly, the ball striking face 3212 may be defined by various vertical and/or horizontal portions associated with one or more groove configurations or characteristics. The apparatus, methods, and articles of manufacture described herein are not limited in this regard.

Figure 57:
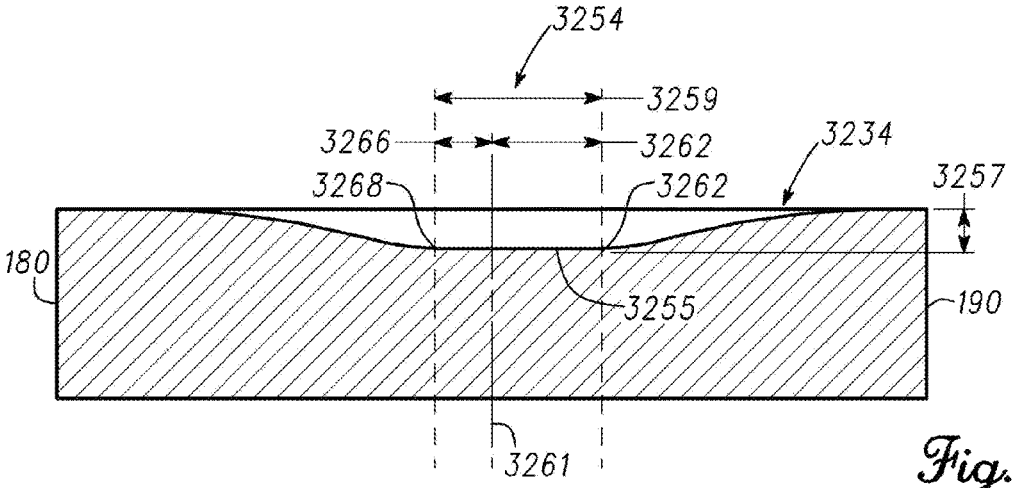
FIG. 57 shows a cross section of a groove of the ball striking face of FIG. 56.

FIG. 57 shows a horizontal cross section of the ball striking face 3212 taken at the groove 3234. Each groove 3220 may include a center portion 3254 having a bottom surface 3255, which may define a greatest depth 3257 of the groove 3220. The center portion 3254 has a length 3259, which may vary depending on the location of the groove 3220 on the ball striking face 3212. In the example of FIG. 56, the center portions 3254 of the grooves 3220 of the mid portion 3286 have generally the same length. The apparatus, methods, and articles of manufacture described herein are not limited in this regard.

A center of the ball striking face 3212 may be defined by a y-axis 3261. The y-axis 3261 may also define a center axis of the center portion 3254 as shown in FIGS. 56 and 57. However, the center portion 3254 may be offset (not shown) relative to the y-axis 3261. According to the example of FIG. 57, each of the bottom surfaces 3255 of the grooves 3230, 3232, 3234 and 3236 extends toward the toe end 180 from the y-axis 3261 at a greater length than the bottom surface 2255 of the groove 2234 of FIG. 54. As shown in FIG. 57, a distance between the y-axis 3261 and the toe edge portion 3264 of the center portion 3254 may be defined as a length 3262. The toe edge portion 3264 may be defined as a portion of a groove between the y-axis 3261 and the toe end 190 where the depth of the groove increases from the depth 3257 and transitions to the opening or the top of the groove. A distance between the y-axis 3261 and the heel edge portion 3268 of the center portion 3254 may be defined as a length 3266. The heel edge portion 3268 may be defined as a portion of a groove between the y-axis 3261 and the heel end 180 where the depth of the groove increases from the depth 3257 and transitions to the opening or the top of the groove. According to the example of FIG. 57, the length 3262 is greater than the length 2266 of FIG. 55. The length 3262 may also be greater than the length 3266. Alternatively, the length 3262 may be substantially similar to the length 3266, but greater than the length 2266 of FIG. 55. Thus, the deepest portions of some or all of the grooves 3220 of the ball striking face 3212 of FIG. 56 extend more toward the toe end 190 than the deepest portions of the grooves 2220 of the ball striking face 2212 of FIG. 54. A putter having a ball striking face 3212 as shown in FIG. 56 may be suitable for an individual who has a slight arc putting stroke.

Figure 58:
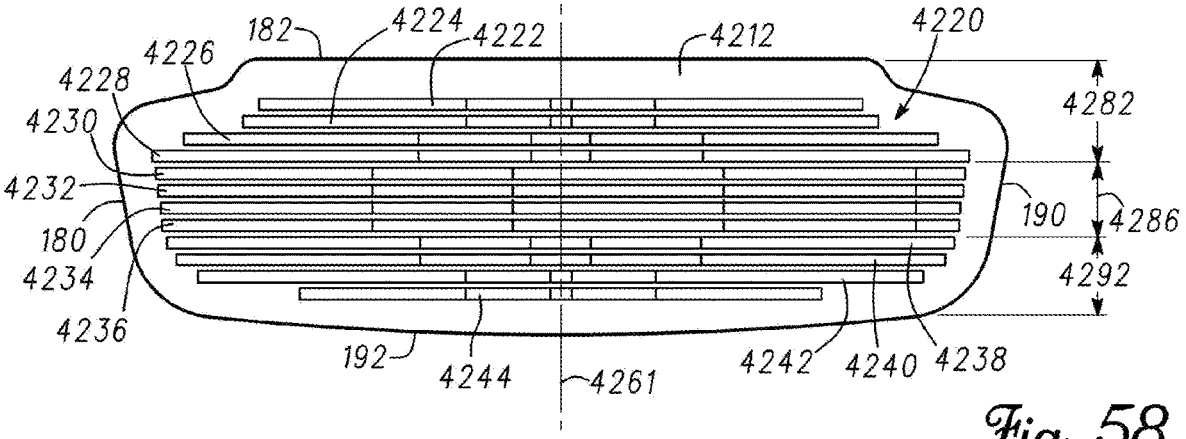
FIG. 58 shows a schematic diagram of a ball striking face of a putter according to one example.

Referring to FIG. 58, a ball striking face 4212 according to another example is shown. The ball striking face 4212 may be vertically separated into and defined by three portions, which are the top rail portion 4282, the mid portion 4286 and the sole portion 4292. The top rail portion 4282, the mid portion 4286 and the sole portion 4292 vertically separate the ball striking face 4212 and span horizontally from the toe end 180 to the heel end 190. The top rail portion 4282 is near the top rail 182, the sole portion 4292 is near the sole 192, and the mid portion 4286 is between the top rail portion 4282 and the sole portion 4292. In FIG. 58, the ball striking face 4212 may have twelve grooves 4222-4244, which may be collectively referred to as the grooves 4220. For example, grooves 4222, 4224, 4226 and 4228 may be considered to be in the top rail portion 4282; grooves 4230, 4232, 4234 and 4236 may be considered to be in the mid portion 4286; and grooves 4238, 4240, 4242 and 4244 may be considered to be in the sole portion 4292. However, one or more of the grooves 4220 may be considered to be in two adjacent portions of the three vertically separated portions, i.e., part of a groove 4220 overlaps and adjacent portion The length of the grooves 4220 may be greatest at the mid portion 4286 and gradually reduce toward the top rail portion 4282 and toward the sole portion 4292. Alternatively, the length of the grooves 4220 may vary according to the peripheral profile of the ball striking face 4212. The top rail portion 4282, the mid portion 4286 and the sole portion 4292 are exemplary and may define portions on the ball striking face 4212 where the grooves 4220 that may be located in such portions have one or more similar configurations or characteristics. Accordingly, the ball striking face 4212 may be defined by various vertical and/or horizontal portions associated with one or more groove configurations or characteristics. The apparatus, methods, and articles of manufacture described herein are not limited in this regard.

Figure 59:
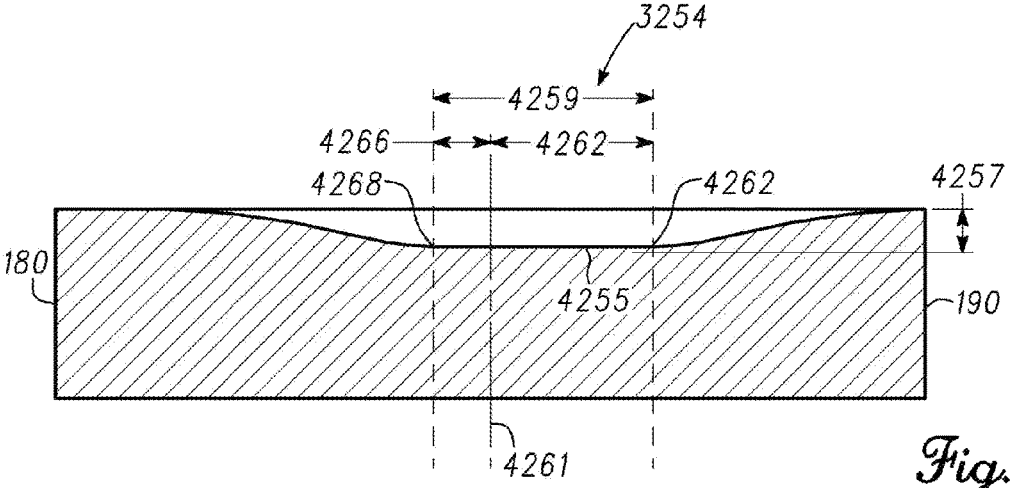
FIG. 59 shows a cross section of a groove of the ball striking face of FIG. 58.

FIG. 59 shows a horizontal cross section of the ball striking face 4212 taken at the groove 4232. Each groove 4220 may include a center portion 4254 having a bottom surface 4255, which may define a greatest depth 4257 of the groove 4220. The center portion 4254 has a length 4259, which may vary depending on the location of the groove 4220 on the ball striking face 4212. In the example of FIG. 58, the center portions 4254 of the grooves 4220 of the mid portion 4286 have generally the same length. The apparatus, methods, and articles of manufacture described herein are not limited in this regard.

A center of the ball striking face 4212 may be defined by a y-axis 4261. The y-axis 4261 may also define a center axis of the center portion 4254 as shown in FIGS. 58 and 59. However, the center portion 4254 may be offset (not shown) relative to the y-axis 4261. According to the example of FIG. 59, each of the bottom surfaces 4255 of the grooves 4230, 4232, 4234 and 4236 extends toward the toe end 180 from the y-axis 4261 at a greater length than the bottom surface 3255 of the groove 3234 of FIG. 56. As shown in FIG. 59, a distance between the y-axis 4261 and the toe edge portion 4264 of the center portion 4254 may be defined as a length 4262. The toe edge portion 4264 may be defined as a portion of a groove between the y-axis 4261 and the toe end 190 where the depth of the groove increases from the depth 4257 and transitions to the opening of the groove. A distance between the y-axis 4261 and the heel edge portion 4268 of the center portion 4254 may be defined as a length 4266. The heel edge portion 4268 may be defined as a portion of a groove between the y-axis 4261 and the heel end 180 where the depth of the groove increases from the depth 4257 and transitions to the opening of the groove. According to the example of FIG. 59, the length 4262 is greater than the length 3266 of FIG. 57, hence greater than the length 2266 of FIG. 55. The length 4262 may be greater than the length 4266. Alternatively, the length 4262 may be substantially similar to the length 4266, but greater than the length 3266 of FIG. 57. Thus, the deepest portions of some or all of the grooves 4220 of the ball striking face 4212 of FIG. 58 extend more toward the toe end 190 than the deepest portions of the grooves 3220 of the ball striking face 3212 of FIG. 56. A putter having a ball striking face 4212 as shown in FIG. 58 may be suitable for an individual who has a strong arc putting stroke.

According to the examples of FIGS. 54-59, grooves on a putter may be configured to optimize performance of an individual based on the individual's putting stroke. Depending on the degree of arc in an individual's putting stroke, any of the grooves described herein may be provided on a putter such that portions of some of all of the grooves that generally define the depth of the grooves extend from the center portion of the striking face of the putter to the toe end at a certain length to optimize the performance of an individual when using the putter. Thus, the length of the deepest part of a groove may be proportional to a degree of arc in an individual's putting stroke. For example, for an individual having a putting stroke that is between a strong arc putting stroke and a slight arc putting stroke, the portions of the grooves that generally define the depth of the grooves may extend from the y-axis toward the toe end 190 at a greater length than the grooves 3230, 3232, 3234 and 3236 of the ball striking face 3212, but less than the grooves 4230, 4232, 4034 and 4036 of the ball striking face 4212. In the examples of FIGS. 54-59, the portions of the grooves in the mid portion of the striking face that define the depth of the groove differ based on the putting stroke type of an individual. However, all of the grooves on the striking face including the grooves in the top rail portion and the sole portion may be configured according to the above examples based on the putting stroke type of an individual. Furthermore, the grooves according to the examples of FIGS. 54-59 may have any shape or configuration. For example, a ball striking face according to the examples of FIGS. 54-59 may have groove cross sectional shapes according to the groove examples of FIGS. 5-7, 10-12, 15-17 and/or 31-35. The apparatus, methods, and articles of manufacture described herein are not limited in this regard.

A golf club head, a ball striking face and/or grooves according to the examples of FIGS. 54-59 may be manufactured by any of the methods and/or with any of the materials described herein. Each groove may have a width of about 0.032 inches (0.081 cm) and have a depth of between about 0.003 inches (0.008 cm) to about 0.017 inches (0.043 cm). As described in detail herein, any of the ball striking faces 2212, 3212 or 4212 may be in the form of an insert that is to a golf club head or a correspondingly shaped recess in a golf club head. The insert may be flush with the remaining portions of the face of the golf club head, which may define a reference plane. Accordingly, the grooves of the ball striking face deviate into the golf club head or are below the reference plane. Alternatively, all or portions of the insert may protrude from the reference plane such that all or portions of the grooves are positioned above the reference plane. By having interchangeable ball striking faces for one or more golf clubs such putters, a ball striking face of a golf club head can be exchanged with another ball striking face so as to improve an individual's performance based on his or her putting style. For example, an individual whose putting style has changed over a certain period of time can exchange the ball striking face of his or her putter with another ball striking face according to the disclosure so that the putter is better adapted to the individual's current putting style. Instead of having interchangeable ball striking faces, any of the grooves described herein including the exemplary grooves of FIGS. 54-59 may be manufactured on the golf club head. The apparatus, methods, and articles of manufacture described herein are not limited in this regard.

Groove Depth & Groove Width Relationships

Figure 60:
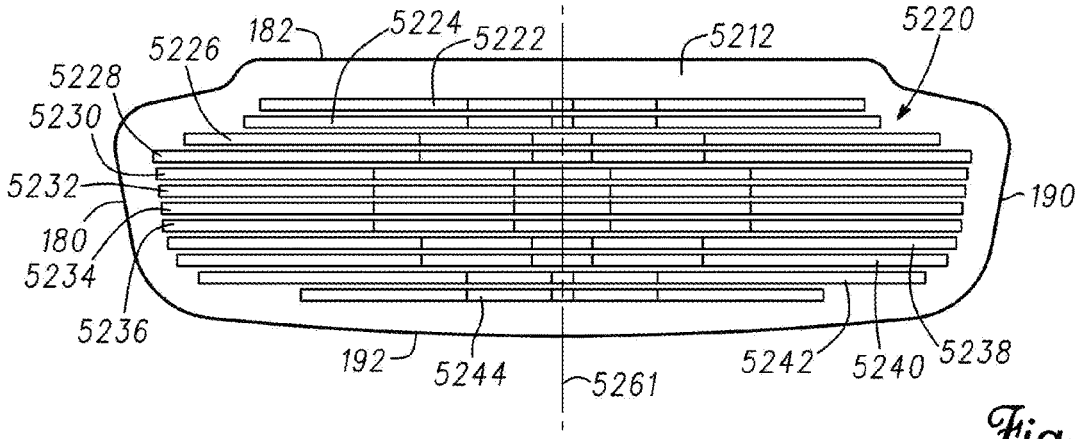
FIG. 60 shows a schematic diagram of a ball striking face of a putter according to one embodiment.

In another example shown in FIG. 60, a ball striking face 5212 may include grooves 5220 (shown specifically as grooves 5222-5244). The ball striking face 5212 may be an integral part of the putter face 110 or a separate part that is attached to the putter face 110. Accordingly, when describing the ball striking face 5212, parts of the putter 100 and the putter head 102 are referred to with the same reference numbers described above. Similar to the other examples described herein, the depth, length and/or width of each groove 5220 may increase, decrease and/or vary from the toe end 180 to the heel end 190 and/or from a top rail 182 to a sole 192 of the putter head 102. The apparatus, methods, and articles of manufacture described herein are not limited in this regard.

Figure 61:
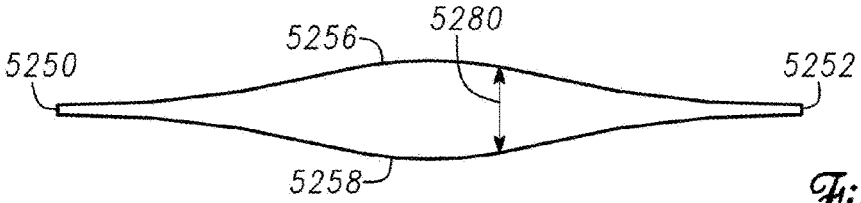
FIG. 61 shows a schematic top view of a groove of the ball striking face of FIG. 60.
Figure 62:
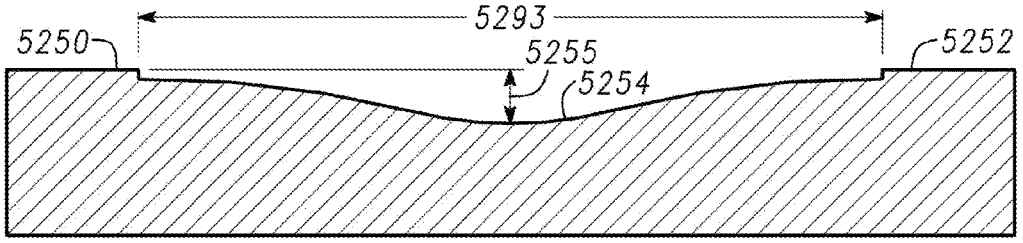
FIG. 62 shows a horizontal cross-sectional diagram of the groove of FIG. 61 taken at section 62-62 of FIG. 60.

FIG. 61 shows a schematic top view of the groove 5232 and FIG. 62 shows a horizontal cross section of the groove 5232 to illustrate the configuration of the grooves 5220 as described below. Each of the grooves 5220 includes a first horizontal wall 5256 and a second horizontal wall 5258 that define the vertical boundaries of the grooves. Each groove 5220 may also include a first end wall 5250 and a second end wall 5252. Each of the grooves 5220 has a bottom surface 5254 which defines a depth 5255 of the groove 5220. The depth 5255 of each groove 5220 may vary from the first wall 5250 to the second wall 5252. The grooves 5220 may not have any end walls as the depth of each groove 5220 may gradually diminish until the bottom surface 5254 meets the ball striking face 5212. The distance between the first horizontal wall 5256 and the second horizontal wall 5258 at any location along the groove defines a width 5280 of the groove 5220 at that location. The distance between the first end wall 5250 and the second end wall 5252 defines a length 5293 of the grooves 5220.

The variation in the depth 5255 of each groove 5220 relative to the variation in the width 5280 of each groove 5220 may depend on the cutting tool that is used to manufacture the groove 5220. According to one example, the variation in the width of the groove may be similar to the variation in the depth of the groove along the length of the groove. For example, for every one millimeter increase in the depth of the groove, the width of the groove also increases by one millimeter. According to another example, the depth of the groove may vary at a multiple of the variation of the width of the groove along the length of the groove. For example, for every one millimeter increase in the depth of the groove, the width of the groove increases by 0.5 millimeter. Thus, the variation in the depth of each groove may linearly relate to the variation in the width of each groove along the length of each groove.

Figure 63:
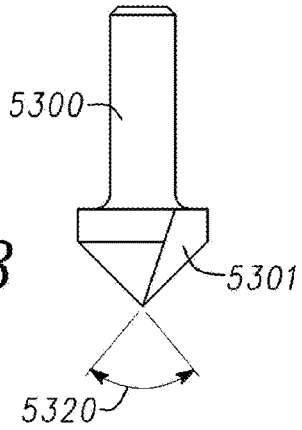
FIG. 63 shows a tool for cutting a groove.
Figure 65:
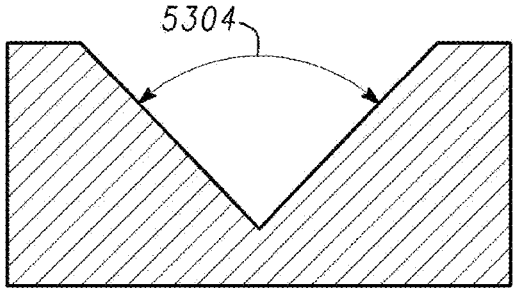
FIG. 65 shows a V-shaped groove according to one example.
Figure 64:
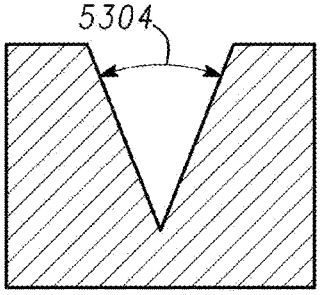
FIG. 64 shows a V-shaped groove according to one example.

FIG. 63 shows a typical cutting bit 5300 having a cutting blade 5301 for cutting a groove in a material. A machine spins the cutting bit 5300 so that the cutting blade 5301 can cut a hole in a material, and the machine moves the material being cut or moves the cutting bit 5300 to create a groove along the path of movement. The cutting bit 5300 has an angle 5302, which defines the angle 5304 of the groove cut by the cutting blade 5301 as shown in FIGS. 64 and 65. The example cutting bit of FIG. 63 has an angle 5302 of about 90°, which can cut a groove as shown in FIG. 65 with an angle 5304 of about 90°. FIG. 64 shows a groove having a groove angle 5304 of about 60°. A cutting bit (not shown) for cutting the groove of FIG. 64 has a cutting bit with an angle of about 60°.

Denoting the depth of each groove by y, the width of each groove by x, and the angle of the cutting blade by α, a relationship between the depth of each groove and the width of each groove along the length of each groove may be expressed by:

$$x = 2y\tan\left(\frac{\alpha}{2}\right) \tag{1}$$

The variation of the width of each groove relative to the depth of each groove along the length of the groove may be expressed by:

$$\frac{dx}{dy} = 2\tan\left(\frac{\alpha}{2}\right) \tag{2}$$

According to equation (2), when the cutting blade 5301 has an angle of 90°, the width of the groove varies relative to depth of the groove by a factor of 2 along the length of the groove. For example, for every 1 millimeter increase in the depth of the groove, the width of the groove increases by 2 millimeters. When the cutting blade has an angle of 60°, the width of the groove varies relative to the depth of the groove by a factor of about 1.15. For example, for every 1 millimeter increase in the depth of the groove, the width of the groove increases by 1.15 millimeters. When the cutting blade has an angle of 30°, the width of the groove varies relative to the depth of the groove by a factor of about 0.54. For example for every 1 millimeter increase in the depth of the groove, the width of the groove increases by about 0.54 millimeters. Thus, cutting each groove with a cutting tool provides a groove having a width and depth that vary linearly relative to each other along the length of the groove.

According to equation (2), the width profile of a groove as shown in FIG. 61 may be similar in shape to the depth profile of the groove according to FIG. 62. In other words, as the groove becomes deeper from one end wall 5250 or 5252 to the center portion of the groove, the width of the groove also increases by a factor that is associated with the angle of the groove or the cutting tool. Thus, the width of the groove varies linearly relative to a variation in the depth of the groove along the length of the groove, and the width and depth profiles of the groove may be similar.

According to equation (2), the variation in the depth of the groove relative to the variation in the width of the groove is linear. However, the variation in the depth of the groove relative to the variation in the width of the groove may be constant or nonlinear. One or more cutting tools for manufacturing a groove may be used such that the depth of the groove varies relative to a variation in the width of the groove according to a non-linear relationship. For example, the variation in the depth of a groove relative to variation in the width of the groove may be defined by the following equation:

$$\frac{dx}{dy} = \frac{1}{\sqrt{y}} \tag{3}$$

According to equation (3), the width of the groove is twice the square root of the depth of the groove, which can be represented by the following equation:

$$x=2\sqrt{y} \tag{4}$$

Thus, the relationship between the variation in depth and the variation in width of the groove may be nonlinear. According to another embodiment, the depth and/or the cross-sectional shape of a groove may vary, but the width of the groove may remain constant. For example, the groove may have a square cross-sectional shape with the depth of the groove varying from one end of the groove to the other end of the groove while the width of the groove remains constant. According to another example, the width of the groove may remain constant from one end of the groove to the other end of the groove, but the cross-sectional shape and/or depth of the groove may vary from one end of the groove to the other end of the groove. According to another embodiment, the depth of the groove from one end of the groove to the other end of the groove may remain constant, while the width of the groove varies and/or remains constant from one end of the groove to the other end of the groove.

Figure 66:
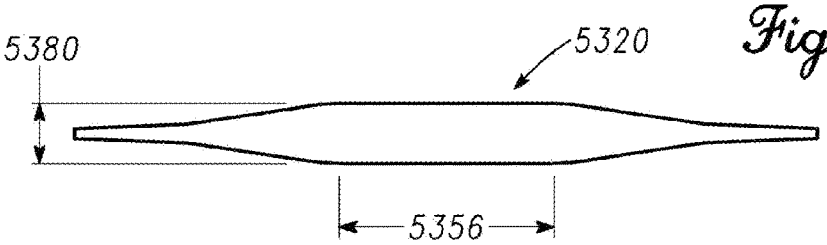
FIG. 66 shows a schematic top view of a groove according to one example.
Figure 67:
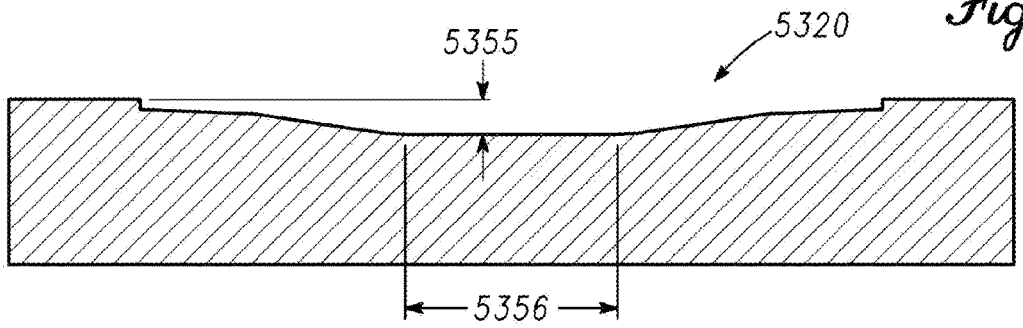
FIG. 67 shows a horizontal cross-sectional diagram of the groove of FIG. 66.

According to another example shown in FIGS. 66 and 67, the depth 5355 of a groove 5320 may be constant along a portion of the groove, such as a center portion 5356 of the groove. Accordingly, the width 5380 of the groove is also constant as described in detail above along the center portion of the groove 5356. To manufacture the groove 5320 of FIGS. 66 and 67, a cutting tool such as the cutting tool 5300 is used at a constant depth 5355 at the center portion 5356 of the groove, hence resulting in a constant width 5380 at the center portion 5356 of the groove 5320.

The groove areas with deeper and wider grooves near the center of mass of a putter may provide a higher expected ball speed, while shallower and narrower groove areas near the toe portion and the heel portion may provide a lower expected ball speed. Furthermore, the greater groove width and depth at a center portion of a putter may reduce the mass at a point of contact with the golf ball, thereby normalizing the ball speed across the putter face by equating point mass at each possible point of contact, such that even on off-center hits: toe, heel, high, or low, the ball speed would be generally the same as if impacted on the center of the putter face.

The cutting tool of FIG. 63 is an example cutting tool. Other cutting tools may be used that may have different shapes, and therefore resulting in different shape grooves. The cutting tool of FIG. 63 is V-shaped, which results in a V-shaped groove. However, a U-shaped cutting tool (not shown) may result in a U-shaped groove. According to one embodiment, a cutting tool may be used that has a flat tip or point for manufacturing a flat-bottom groove. For example, the cutting tool may be a V-shaped cutting tool that has a flat tip instead of a pointed tip. Accordingly, a V-shaped groove can be manufactured having a flat bottom. Thus, the bottom of a groove may be substantially a point (i.e., having almost no width) to being as wide as the width of the groove (i.e., rectangular or square cross-sectional groove shape). According to one example, the bottom of the groove may be flat and have a width of about 0.003 inches (0.0076 centimeters). A groove having a flat bottom may improve putting performance. A groove may be manufactured by using one cutting tool as described above or a plurality of cutting tools. For example, a plurality of cutting tools may be used to manufacture a single groove to provide different groove cross-sectional shapes and/or dimensions from one end of the groove to the other end of the groove.

Vertical Milled Grooves

Figure 70:
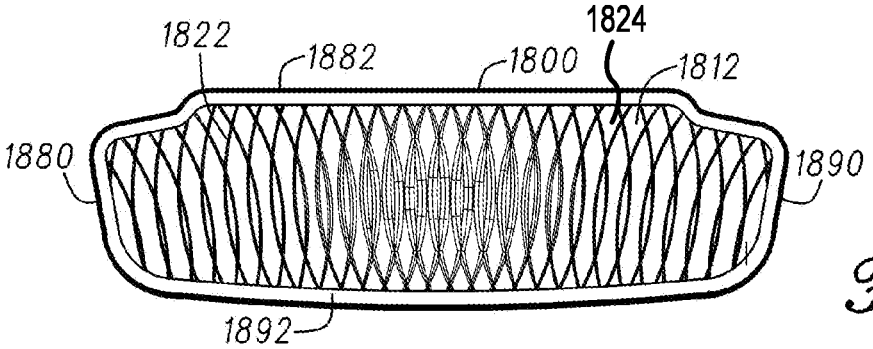
FIG. 70 shows a schematic diagram of a ball striking face of a putter according to one example.
Figure 71:
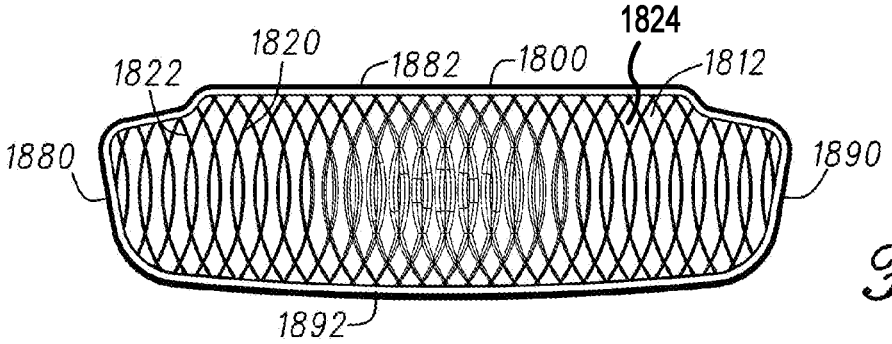
FIG. 71 shows a schematic diagram of a ball striking face of a putter according to one example.

Referring to FIGS. 70 and 71, a putter head 1800 includes a ball striking face or putter face 1812 defined by a toe end 1880, a heel end 1890, a top rail 1882, and a sole 1892. The putter face 1812 can comprise a center portion located near a geometric center of the putter face 1812. The putter face 1812 comprises a plurality of first curved grooves 1820 and a plurality of second curved grooves 1822. The first curved grooves 1820 and the second curved grooves 1822 extend generally in a direction from the top rail 1882 to the sole 1892 in an arcuate fashion. The plurality of first curved grooves 1820 can be parallel to each other. The plurality of second curved grooves 1822 can be parallel to each other. The first curved grooves 1820 can extend in a first direction of curvature (i.e. along a circle), and the second curved grooves 1822 can extend in a second direction of curvature (i.e. along a circle) generally opposite the first direction. The first curved grooves 1820 can intersect the second curved grooves 1822 at any point or at a plurality of points along one or more of the second curved grooves 1822. Each of the curved grooves 1820 and 1822 can have a different configuration as compared to another groove, such as variable cross-sectional profiles, depth profiles, width profiles, length profiles in a direction from the toe end 1880 to near the heel end 1890 and/or in a direction from the top rail 1882 to the sole 1892, similar to the grooves in the putter heads discussed above (e.g. 1300 and 1400). For example, the depth of the first curved grooves 1820 or the second curved grooves 1822 can progressively increase in one or more groove steps from the top rail 1882 to the sole 1892. In another example, the depth of the first curved grooves 1820 or the second curved grooves 1822 can progressively increase in a direction extending from the heel end 1890 to the center portion of the putter face 1812, and/or in a direction extending from the toe end 1880 to the center portion of the putter face 1812. The apparatus, methods, and articles of manufacture described herein are not limited in this regard.

Referring to FIGS. 70 and 71, the first curved grooves 1820 and the second curved grooves 1822 can comprise a variable width in a direction extending from the top rail 1882 to the sole 1892, and/or in a direction extending from the toe end 1880 to the heel end 1890. The grooves 1820 and 1822 located near the center portion of the putter face 1800 can comprise a larger width than the grooves 1820 and 1822 located away from the center portion. In one embodiment, the width of the grooves 1820 and 1822 can decrease in a direction extending from the center portion to the toe end 1880, and in a direction extending from the center portion to the heel end 1890. Stated another way, the width of the grooves 1820 and 1822 can increase in a direction extending from the toe end 1880 to the center portion, and in a direction extending from the heel end 1890 to the center portion. Further, the width of the grooves 1820 and 1822 can increase in a direction extending from the top rail 1882 to the center portion, and in a direction extending from the sole 1892 to the center portion. Stated another way, the width of the grooves 1820 and 1822 can decrease in a direction extending from the center portion to the top rail 1882, and in a direction extending from the center portion to the sole 1892.

The grooves 1820 and 1822 can comprise a variable depth in a direction extending from the top rail 1882 to the sole 1892, and/or in a direction extending from the toe end 1880 to the heel end 1890. The grooves 1820 and 1822 located near the center portion of the putter face 1800 can comprise a greater depth than the grooves 1820 and 1822 located away from the center portion. In one embodiment, the depth of the grooves 1820 and 1822 can increase in a direction extending from the toe end 1880 to the center portion, and in a direction extending from the heel end 1890 to the center portion. In another embodiment, the depth of the grooves 1820 and 1822 can increase in a direction extending from the top rail 1882 to the center portion, and in a direction extending from the sole 1892 to the center portion. Stated another way, the depth of the grooves 1820 and 1822 can decrease in a direction extending from the center portion to the top rail 1882, and in a direction extending from the center portion to the sole 1892. The depth of the grooves 1820 and 1822 can range from 0.003 inch to 0.017 inch. In some embodiments, the depth of the grooves 1820 and 1822 can range from 0.003 inch to 0.014 inch, 0.004 inch to 0.015 inch, 0.005 inch to 0.016 inch, or 0.005 inch to 0.017 inch. For example, the depth of a portion of the grooves 1820 and 1822 can be 0.003 inch, 0.004 inch, 0.005 inch, 0.006 inch, 0.007 inch, 0.008 inch, 0.009 inch, 0.01 inch, 0.011 inch, 0.012 inch, 0.013 inch, 0.014 inch, 0.015 inch, 0.016 inch, or 0.017 inch.

With continued reference to FIGS. 70 and 71, land portions 1824 can be positioned between the first curved grooves 1820 and the second curved grooves 1822. The land portions 1824 separate the plurality of first curved grooves 1820 or the plurality of second curved grooves 1822. The land portions 1824 form portions of the putter face 1812 that contact a golf ball during impact, and the grooves 1820 and 1822 form portions of the putter face 1812 that do not contact the golf ball during impact. The grooves 1820 and 1822 can form a plurality of separate or discrete land portions 1824 that are located across the putter face 1812 in a top rail 1882 to sole 1892 direction, and in a toe end 1880 to heel end 1890 direction. The land portions 1824 can comprise an area that varies in a direction extending from the toe end 1880 to the heel end 1890, or in a direction extending from the sole 1892 to the top rail 1882 (i.e. adjacent land portions 1824 can have a different area). The area of each land portion 1824 can be measured as a surface area. In one embodiment, the area of the land portions 1824 can decrease in a direction extending from the toe end 1880 to the center portion of the putter face 1812, and/or in a direction extending from the heel end 1890 to the center portion. Stated another way, the area of the land portions 1824 can increase in a direction extending from the center portion to the toe end 1880, and/or in a direction extending from the center portion to the heel end 1890. In some embodiments, the area of the land portions 1824 can be equal in a direction extending from the heel end 1890 to the toe end 1880. In other embodiments still, the area of the land portions 1824 can be equal along a portion of the putter face 1812, and then decrease in a direction extending from the heel end 1890 to the center portion. In other embodiments still, the area of the land portions can be equal along a portion of the putter face 1812, and then decrease in a direction extending from the toe end 1880 to the center portion.

Further referring to FIGS. 70 and 71, the land portions 1824 can comprise a shape. The shape of the land portions 1824 can be similar across the putter face 1812 or different across the putter face 1812. The land portions 1824 can comprise a shape in the form of a diamond, square, rectangle, hourglass, four-sided ridge, oval, ellipse, or lens (i.e. convex shape bounded by two circular arcs joined at their endpoints, wherein the circular arcs are convex relative to a center of the lens shape). As illustrated in FIGS. 70 and 71, the land portions 1824 can comprise a four-side ridge shape, a hourglass shape, or a lens shape. In one embodiment, the putter face 1812 can comprise land portions 1824 with a similar shape in a direction extending from the toe end 1880 to the heel end 1890. In another embodiment, the putter face 1812 can comprise land portions 1824 with different shapes in a direction extending from the top rail 1882 to the sole 1892. In one embodiment, the putter face 1812 can comprise a diamond or four-sided ridge shaped land portions 1824 near the top rail 1882 and/or the sole 1892. The putter face 1812 can comprise elliptical or lens shaped land portions 1824 near the center portion of the putter face 1812.

Figure 108:
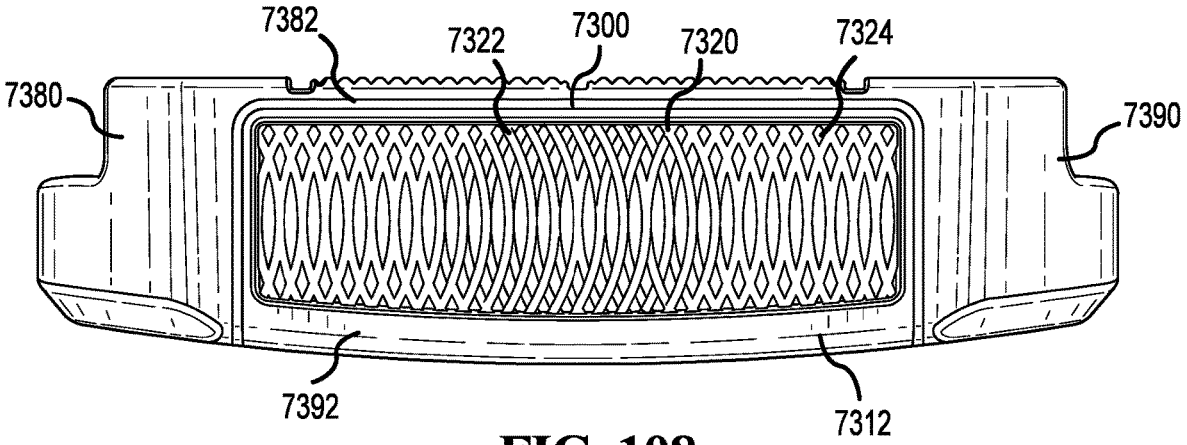
FIG. 108 shows a front view of a putter face according to another embodiment.

Moving ahead in the figures, FIG. 108 illustrates another vertical milled groove or vertical groove pattern embodiment. Referring to FIG. 108, a putter head 7300 comprises a ball striking face or putter face 7312 defined by a top rail 7382, a toe end 7380, a heel end 7390, and a sole 7392. The putter face 7312 can comprise a center portion located near a geometric center of the putter face 7312. Further, the putter face 7312 can define a centerline extending through the geometric center of the putter face from a heel end 7390 to a toe end 7380. The putter face 7312 can include a plurality of first curved grooves 7320 and a plurality of second curved grooves 7322. The first curved grooves 7320 and the second curved grooves 7322 can extend in a direction from the top rail 7382 to the sole 7392 in an arcuate fashion. The plurality of first grooves 7320 can be parallel to each other. The plurality of second grooves 7322 can be parallel with each other. The second curved grooves 7322 can be substantially a mirror image of the first curved grooves 7320, where the second curved grooves 7322 are overlaid onto the first curved grooves. The first grooves 7320 intersect the plurality of second curved grooves 7322 at a plurality of points along the plurality of second curved grooves 7322.

The first curved grooves 7320 and the second curved grooves 7322 can comprise a width measured as transverse width (i.e. each of the first curved grooves 7320 and second curved grooves 7322 can comprise a first edge and a second edge opposite the first edge, wherein the width of the first curved grooves 7320 or the second curved grooves 7322 can be measured between the first edge and the second edge). The width of the first curved grooves 7320 can be generally constant, and the width of the second curved grooves 7322 can be generally constant. The width of each first curved groove of the plurality of first curved grooves 7320 can comprise a similar width. The width of each second curved groove of the plurality of second curved grooves 7322 can comprise a similar width. In one embodiment, the width of the first curved grooves 7320 and the width of the second curved grooves 7322 can be similar or equal. In other embodiments, the width of the first curved grooves 7320 and the width of the second curved grooves 7322 can be different. In other embodiments, the width of the first curved grooves 7320 can comprise a greater width than the second curved grooves 7322. In other embodiments still, the width of the first curved grooves 7320 can comprise a width less than the second curved grooves 7322.

The first curved grooves 7320 and the second curved grooves 7322 can comprise a variable depth in a direction extending from the top rail 7382 to the sole 7392, and/or in a direction extending from the toe end 7380 to the heel end 7390. The depth of the first curved grooves 7320 and the second curved grooves 7322 can be greatest at the center portion of the putter face 7312. The first curved grooves 7320 and the second curved grooves 7322 located at the center portion can comprise a greater depth than the first curved grooves 7320 and the second curved grooves 7322 located outside the center portion. The first curved grooves 7320 and the second curved grooves 7322 located near the toe end 7380 and the heel end 7390 can comprise a depth less than the grooves 7320 and 7322 located at the center portion. The depth of the first curved grooves 7320 and the second curved grooves 7322 can decrease in a direction extending from the center portion to the toe end 7380, and in a direction extending from the center portion to the heel end 7390. Stated another way, the depth of the grooves 7320 and 7322 can increase in a direction extending from the toe end 7380 to the center portion, and in a direction extending from the heel end 7390 to the center portion. The depth of the grooves 7320 and 7322 can range from 0.003 inch to 0.017 inch. The depth of the grooves 7320 and 7322 can be similar to the depth of grooves 1820 and 1822 described above.

Further referring to FIG. 108, land portions 7324 can be positioned between the first curved grooves 7320 and the second curved grooves 7322. The land portions 7324 separate the plurality of first grooves 7320 or the plurality of second grooves 7322. The land portions 7324 form portions of the putter face 7312 that contact a golf ball during impact, and the grooves 7320 and 7322 form portions of the putter face 1812 that do not contact the golf ball during impact. The grooves 7320 and 7322 can form a plurality of separate or discrete land portions 7324 that are located across the putter face 7312 in a top rail 7382 to sole 7392 direction, and in a toe end 7380 to heel end 7390 direction. Each land portion 7324 can comprise an area that contacts a golf ball during impact. The area of each land portion 7324 can be measured as a surface area. The area of the land portions 7324 can be equal in a direction extending from the toe end 7380 to the heel end 7390, and/or vary in a direction extending from the top rail 7382 to the sole 7392. In some embodiments, the area of the land portions 7324 can increase in a direction extending from the top rail 7382 to the center portion, and/or in a direction extending from the sole 7392 to the center portion. In some embodiments, the area of land portions 7324 along the heel-toe centerline of the putter face 7312 is greater than the area of the land portions 7324 near the top rail 7382 and the sole 7392.

With continued reference to FIG. 108, the land portions 7324 can comprise a shape. The shape of the land portions 7324 can be similar across the putter face 7312 or different across the putter face 7312. The land portions 7324 can comprise a shape in the form of a diamond, square, rectangle, hourglass, four-sided ridge, oval, ellipse, or lens (i.e. convex shape bounded by two circular arcs joined at their endpoints, wherein the circular arcs are convex relative to a center of the lens shape). In one embodiment, the putter face 7312 can comprise land portions 7324 with a similar shape in a direction extending from the toe end 7380 to the heel end 7390. In another embodiment, the putter face 7312 can comprise land portions 7324 with different shapes in a direction extending from the top rail 7382 to the sole 7392. In some embodiments, the putter face 7312 can comprise diamond or four-sided ridge shaped land portions 7324 near the top rail 7382 and/or the sole 7392, wherein the area of adjacent diamond shaped land portions 7324 is equal in a direction from the toe end 1880 to the heel end 1890. The putter face 7312 can comprise elliptical or lens shaped land portions 7324 along a centerline between the toe end 1880 and the heel end 1890. The area of adjacent elliptical/lens shaped land portions 7324 is equal in a direction extending from the toe end 1880 to the heel end 1890.

Patterned Grooves

Backtracking through the figures, FIGS. 72-75 illustrate another example of putter 100 with a ball striking face 1500 according to another embodiment of the present invention. When describing the new embodiment, some parts of the putter 100 are referred to with the same reference numbers as described above. Ball striking face 1500 comprises a pattern 1510 defining a plurality of lands 1515 and a plurality of elliptical grooves 1520. The lands 1515 and elliptical grooves 1520 begin at a geometrical center 1511 of the innermost land 1516 or innermost elliptical groove 1521. The lands 1515 and elliptical grooves 1520 alternate and continue outwards away from the geometrical center 1511. The geometrical center 1511 is positioned relative to the ball striking face 1500, which is aligned relative to the toe end 180, the top rail 182, the heel end 190, and the sole 192. The geometrical center 1511 may or may not be the actually geometrical center of the putter head 102.

Figure 72:
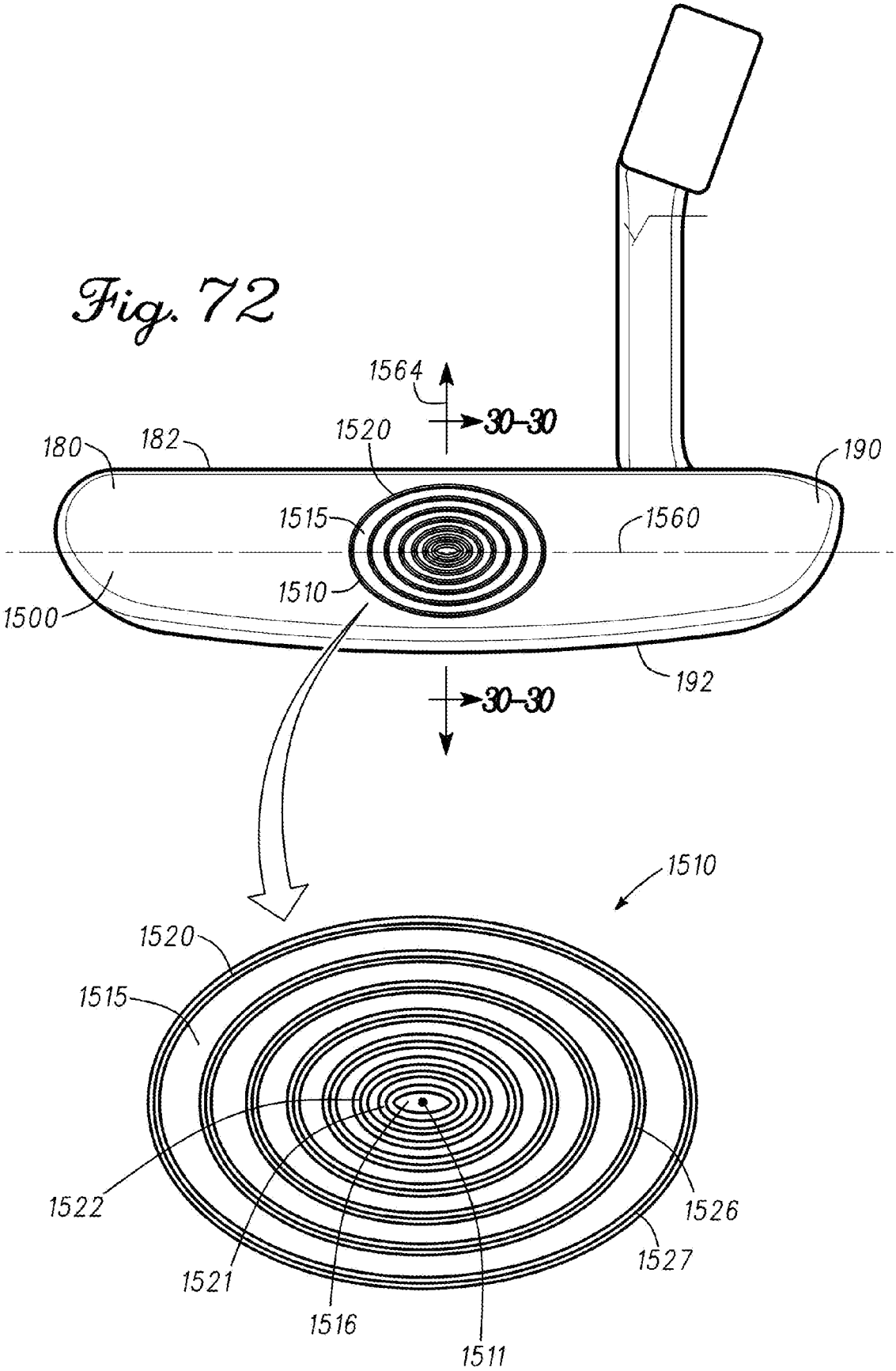
FIG. 72 shows a putter according to one example and a close-up of the elliptical pattern.

Referring to FIG. 72, the ball striking face 1500 comprises the pattern 1510 defining the plurality of lands 1515 and the plurality of elliptical grooves 1520. As illustrated in the figures, the ball striking face 1500 includes seven lands 1515 and seven elliptical grooves 1520. However, in other embodiments, the ball striking face 1500 can include more or less than the seven lands 1515 and more or less than the seven elliptical grooves 1520 illustrated. For example, the ball striking face 1500 may comprise 1 elliptical groove, 1 land 1515, 2 elliptical grooves, 2 lands 1515, 3 elliptical grooves, 3 lands 1515, 4 elliptical grooves, 4 lands 1515, 5 elliptical grooves, 5 lands 1515, 6 elliptical grooves, 6 lands 1515, 7 elliptical grooves, 7 lands 1515, 8 elliptical grooves, 8 lands 1515, 9 elliptical grooves, 9 lands 1515, 10 elliptical grooves, 10 lands 1515, 11 elliptical grooves, 11 lands 1515, 12 elliptical grooves, or 12 lands 1515, or more.

As illustrated in FIG. 72, the pattern 1510 defines a major axis 1560 and a minor axis 1564. The major axis 1560 is where the elliptical grooves 1520 are measured at the widest diameter; while the minor axis 1564 is where the elliptical grooves 1520 are measured at the shortest diameter. The major axis goes through the geometrical center 1511 and runs from the toe end 180 to the heel end 190. The minor axis 1564 goes through the geometrical center 1511 and runs from the top rail 182 to the sole 192. In other embodiments, the major axis 1560 may go through the geometrical center 1511 and runs along the top rail 182 and the sole 192; while the minor axis 1562 may go through the geometrical center 1511 and runs through the toe end 180 to the heel end 190.

Figure 73:
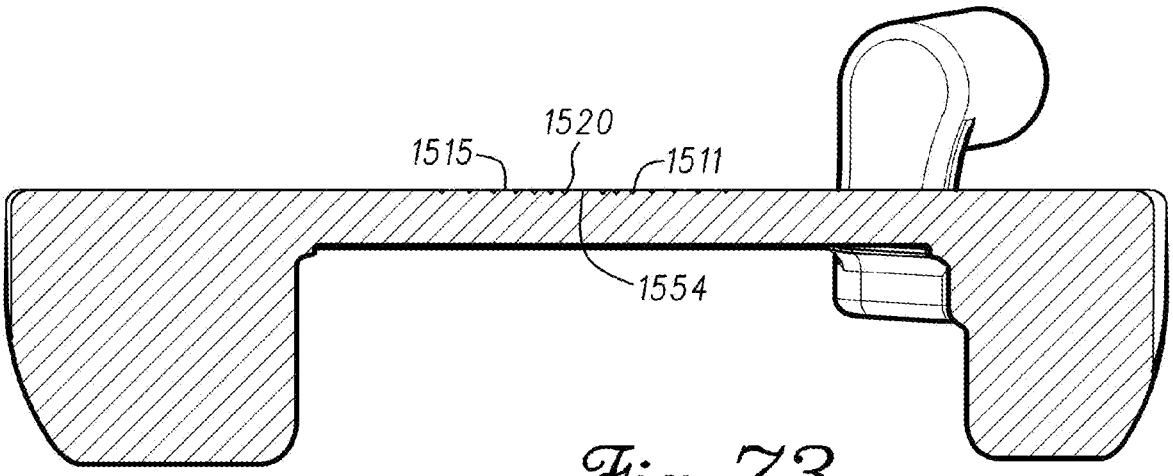
FIG. 73 shows a cross-sectional diagram of FIG. 72 from a bottom view.
Figure 74:
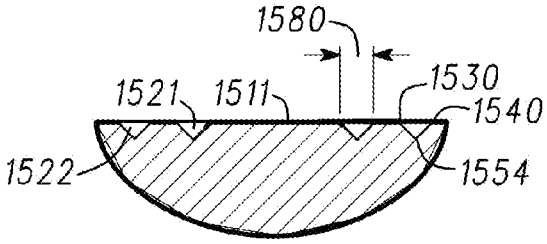
FIG. 74 shows a close-up of the two innermost elliptical grooves of FIG. 73.
Figure 75:
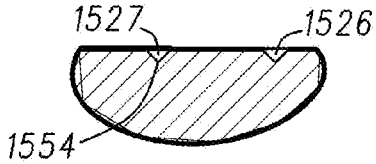
FIG. 75 shows a close-up of the two outermost elliptical grooves of FIG. 73.

As illustrated in FIGS. 73-75, each of the elliptical grooves 1520 has a bottom surface 1554, which defines a depth of the elliptical grooves 1520 relative to the surface of the ball striking face 1500. The depth of the elliptical grooves 1520 can range between 0.001 inches to 0.020 inches (e.g. 0.002, 0.004, 0.006, 0.008, 0.010, 0.012, 0.014, 0.016, 0.018, or 0.020). The depth of the elliptical grooves 1520 varies throughout the ball striking face 1500. The depth of the elliptical grooves 1520 progressively increases as the elliptical grooves 1520 move from the top rail 182 to the geometrical center 1511 and progressively decreases as the elliptical grooves move from the geometrical center 1511 to the sole 192. Similarly, the depth of the elliptical grooves 1520 progressively increase as the elliptical grooves 1520 move from the toe end 180 to the geometrical center 1511 and progressively decrease as the elliptical grooves 1520 move from the geometrical center 1511 to the heel end 190. The elliptical groove at the geometrical center 1511 has the greatest depth while the elliptical groove near the toe end 180, heel end 190, top rail 182 and sole 192 has the shallowest depth. The elliptical grooves 1520 may also be symmetric about the horizontal axis x, perpendicular to the vertical axis y on the ball striking face 1500. The depth of the elliptical grooves 1520 may be similar at the top rail 182 and the sole 192. Likewise, the depth of the elliptical grooves 1520 may be similar at the toe end 180 and the heel end 190.

In one embodiment, the depth of the elliptical grooves 1520 may have a uniform depth for each individual elliptical groove 1520, but vary from one elliptical groove 1520 to the next most outer elliptical groove 1520. In other embodiments, the depth of the elliptical grooves 1520 may vary within each individual elliptical groove 1520. Within one elliptical groove 1520, as the groove moves towards the toe end 180 and the heel end 190, the depth may decrease gradually. In examples where the major axis 1560 runs along the top rail 182 and the sole 192 and the minor axis runs along the toe end 180 and the heel end 190, the depth may gradually decrease moving towards the top rail 182 at the interface of crown and face and the sole 192. As the grooves move away from the geometrical center 1511, the next most outer elliptical groove 1520 may follow the same varying depth pattern but be shallower overall. Referring to FIGS. 74 and 75, the elliptical grooves 1521, and 1522 may have a greater varying depth than the elliptical grooves 1526, and 1527 with elliptical groove 1521 having the greatest depth and elliptical groove 1527 having the shallowest depth.

Each elliptical groove 1520 has an inner perimeter 1530 and an outer perimeter 1540. The inner perimeter 1530 is the perimeter closest to the geometrical center 1511 of an elliptical groove 1520; the outer perimeter 1540 is the perimeter farthest from the geometrical center 1511 of an elliptical groove 1520. The inner perimeter 1530 to the outer perimeter 1540 of an elliptical groove 1520 defines a width 1580. The width 1580 of the elliptical grooves 1520 can range between approximately 0.001 inches to approximately 0.035 inches (e.g. 0.001, 0.005, 0.010, 0.015, 0.020, 0.025, 0.030, or 0.035). The width 1580 may be constant within an elliptical groove 1520. The width 1580 may also vary within an elliptical groove 1520. Further, the width 1580 may remain constant with all the elliptical grooves 1520 on the ball striking face 1500. The width may also vary from elliptical groove 1520 to elliptical groove 1520 on the ball striking face 1500. In one embodiment, the width 1580 may increase from the innermost elliptical groove 1520 to the outermost elliptical groove 1520. For example, elliptical groove 1 may have a width of 0.015 inches while elliptical groove 7 may have a width of 0.035 inches. In another embodiment, the width 1580 may also decrease from the innermost elliptical groove 1520 to the outermost elliptical groove 1520. Other embodiments may include any combination of both a constant width and a varying width within each elliptical groove 1520 and from elliptical groove 1520 to a consecutive elliptical groove 1520.

The outer perimeter 1540 of one elliptical groove to the inner perimeter 1530 of an adjacent elliptical groove 1520 defines a land 1515. The land 1515 is the material between each elliptical groove 1520 on the ball striking face 1500 and defines a thickness. As illustrated in FIG. 72, the geometrical center 1511 is formed in the land 1515. The land at the geometrical center 1511 is a solid cylindrical formation with each land 1515 when moving further from the geometrical center 1511 being cylindrical in form and having a larger inner and outer diameter.

In one embodiment, the thickness of each land 1515 may be consistent throughout the pattern 1510. In another embodiment, the thickness of each land 1515 may also vary throughout the pattern 1510. Further, the thickness of the land 1515 may be constant between each elliptical groove 1520 or may vary between each elliptical groove 1520. The thickness of the land 1515 can range from approximately 0.001 inches to approximately 0.050 inches. In one example, the land 1515 may increase in increments moving from the geometrical center 1511 to the outermost elliptical groove 1527. In another example, the land 1515 may also decrease in increments moving from the geometrical center 1511 to the outermost elliptical groove 1527. The increase in increments may be 0.001, 0.005, 0.010, 0.015, 0.020, 0.025, 0.030, or 0.035 inches. Other embodiments may include any combination of both a constant area of land and varying area of land between each elliptical groove 1520, and from elliptical groove 1520 to an adjacent elliptical groove 1520.

As described above, FIGS. 24-26 show geometrical cross-sectional shapes of the elliptical grooves 1520 as viewed from section line 30-30 of FIG. 72. In FIG. 24, the geometric cross-sectional shape of the elliptical groove 1520 is box-shaped, rectangular or square. In FIG. 25, the geometric cross-sectional shape of the elliptical groove 1520 is V-shaped. In FIG. 26, the geometric cross-sectional shape of the elliptical grooves 1520 is U-shaped. The geometric cross-sectional shape may remain constant within an elliptical groove 1520. The geometric cross-sectional shape may also vary within an elliptical groove 1520. For example, an elliptical groove 1520 may have a geometric cross-sectional shape of a square from the top rail 182 to the sole 192 moving clockwise, and a geometric cross-sectional of a U-shape from the sole 192 to the top rail 182 moving clockwise. Furthermore, the geometric cross-sectional shape of the elliptical grooves 1520 may vary from one elliptical groove 1520 to another elliptical groove 1520. For example, one elliptical groove 1520 may have a geometric cross-sectional of a U-shape, while the consecutive elliptical groove 1520 may have a geometric cross-sectional of a V-shape. Other embodiments may include any combination of the three geometric cross-sectional shapes within each elliptical groove 1520 and from elliptical groove 1520 to elliptical groove 1520.

The varying depth pattern created by the elliptical grooves 1520 has a damping effect on the kinetic energy transferred to the ball. The greater the depth, the more kinetic energy is absorbed. Comparatively, the smaller the depth, the less kinetic energy is absorbed. Because the depth of the elliptical grooves 1520 are the greatest near the geometrical center 1511, this is where the damping is greatest. As the depth shallows as the elliptical grooves 1520 move away from the geometrical center 1511, the damping decreases. This varying depth pattern of the elliptical grooves 1520 allow for more consistent ball speeds across the ball striking face 1500. For example, the ball will experience similar speeds when the ball striking face 1500 impacts the ball at the toe end 180, geometric center 1511, as well as the heel end 190.

Protrusions

Figure 76:
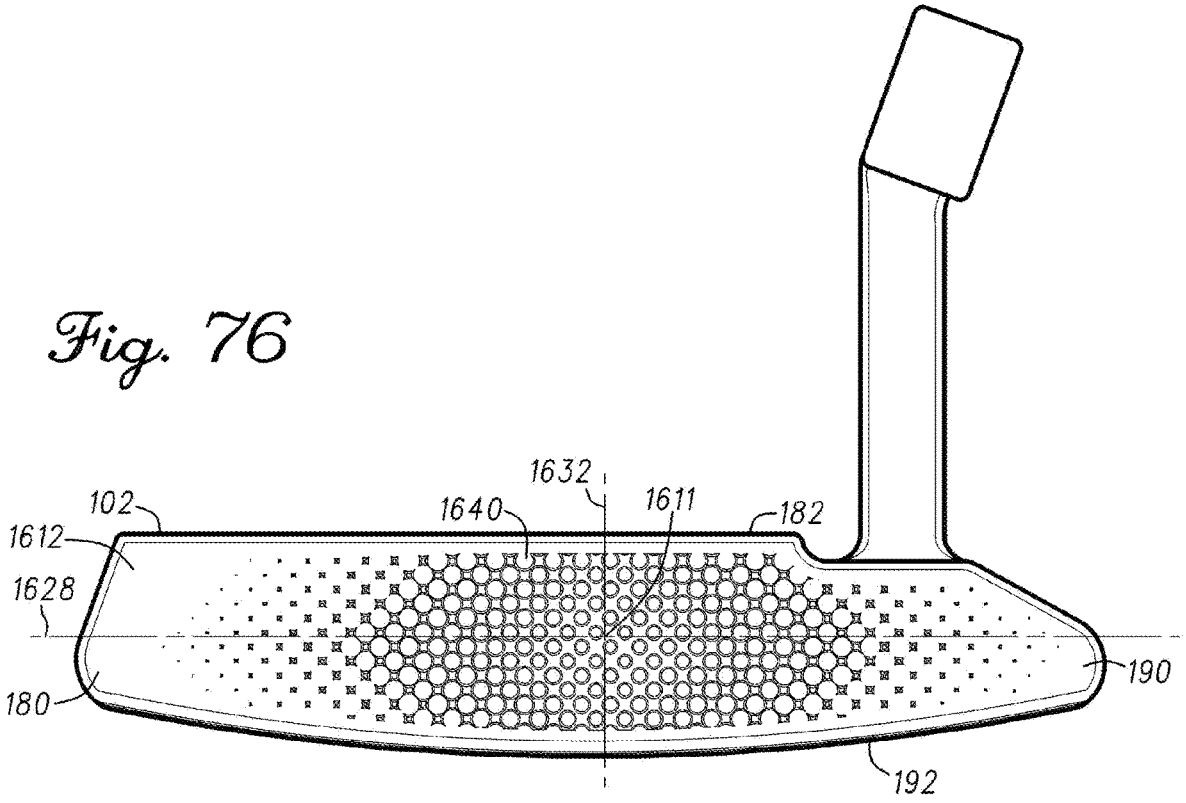
FIG. 76 shows a putter according to one example.
Figure 78:
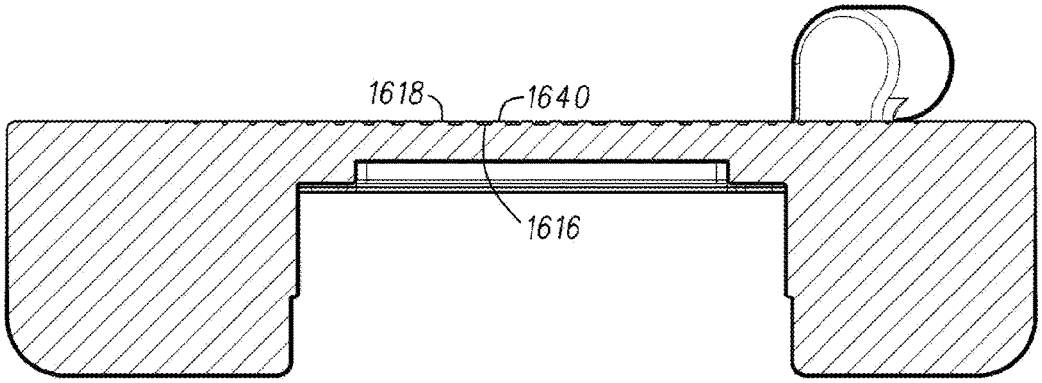
FIG. 78 shows a cross-sectional diagram of FIG. 76 from a bottom view.
Figure 77:
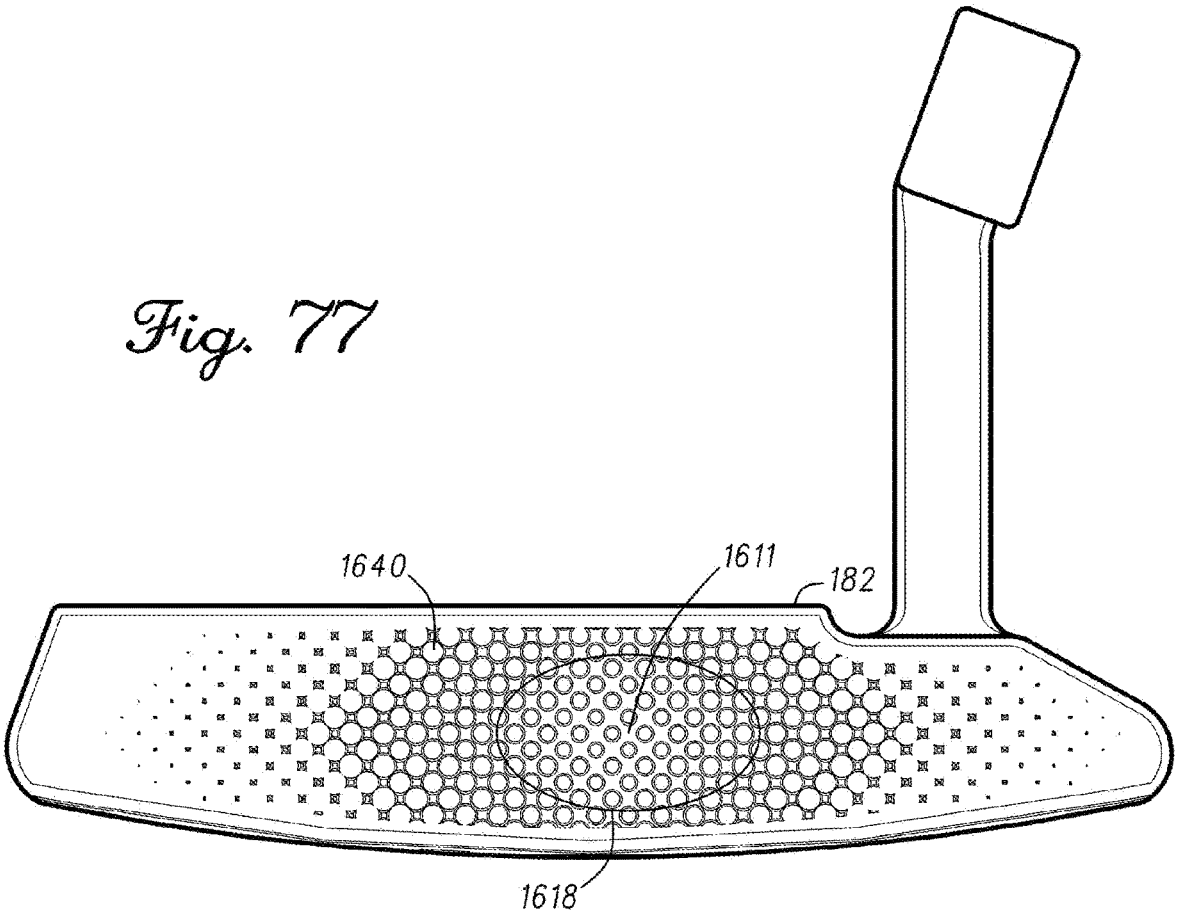
FIG. 77 shows a middle area of FIG. 76.
Figure 79:
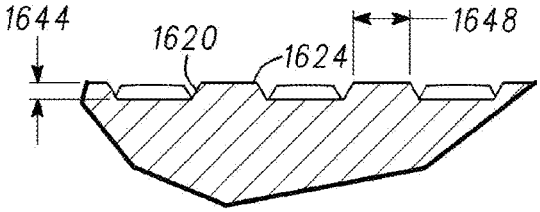
FIG. 79 shows a close-up of the protrusions near the geometrical center of FIG. 78.
Figure 80:
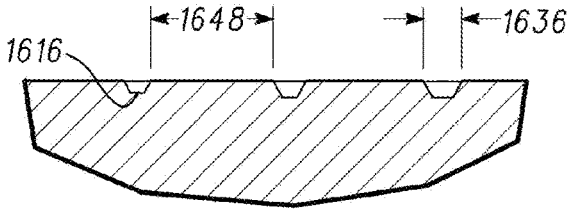
FIG. 80 shows a close-up of the protrusions near the toe end of FIG. 78.

FIGS. 76-80 illustrate another example of putter 100 with a ball striking surface 1612 according to another embodiment of the present invention. When describing the new embodiment, some parts of the putter 100 are referred to with the same reference numbers as described above. Ball striking surface 1612 comprises a plurality of protrusions 1640 extending from a bottom surface 1616. The bottom surface 1616 is contoured as illustrated in FIGS. 78-80. The bottom surface 1616 includes a depression or concavity in a middle area 1618 of the striking surface 1612. As illustrated in FIG. 77, the middle area 1618 may be an oval. In other embodiments, the middle area 1618 may be defined as a circle, an oval or other suitable shapes.

The protrusions 1640 are frustoconically-shaped and are variable in height and width. The protrusions 1640 further comprise a base portion 1620 and a top surface 1624. The base portion 1620 is connected to the bottom surface 1616 and the top surface 1624 forms a planar surface of the striking surface 1612. The protrusions 1640 span outward from a geometrical center 1611 of the striking surface 1612. The geometrical center 1611 is positioned relative to the ball striking surface 1612, which is aligned with the toe end 180, the top rail 182, the heel end 190, and the sole 192. The geometrical center 1611 may or may not be the actual geometrical center of the putter head 102.

As illustrated in FIG. 76, the ball striking surface 1612 defines an x-axis 1628 and a y-axis 1632. The x-axis 1628 goes through the geometrical center 1611 and runs from the toe end 180 to the heel end 190. The y-axis 1632 geos through the geometrical center 1611 and runs through the top rail 182 to the sole 192. Properties of the protrusions 1640 may be mirrored across the x-axis 1628, the y-axis 1632, or both the x-axis 1628 and the y-axis 1632.

With reference to FIGS. 79, and 80, the protrusions 1640 are variable in height and width. At the geometrical center, the protrusions 1640 have a greater height than the protrusions further away from the geometrical center 1611. In other words, the height of the protrusions 1640 gradually change when moving outward from the geometrical center toward the toe end 180, the top rail 182, the heel end 190, and the sole 192.

The height 1644 of the protrusions 1640 is measured from the bottom surface 1616 to the top surface 1624. The height 1644 of each protrusion 1640 is dependent on the bottom surface 1616. As the contour of the bottom surface 1616 varies, the height 1644 of the protrusions 1640 may also vary. For example, at the depression or concavity of the bottom surface 1616, the height 1644 of the protrusions is the greatest. In many embodiments, the height 1644 is greatest at the geometrical center 1611 and decreases as the protrusions 1640 move farther away from the geometrical center 1611. The height 1644 of the protrusions 1640 at the toe end 180 may be identical or similar to the height 1644 of the protrusions at the heel end 190. The height 1644 of the protrusions at the top rail 182 may be identical or similar to the height 1644 of the protrusions at the sole 192. The height 1644 of the protrusions at the toe end 180, the heel end 190, the top rail 182, and the sole 192 may be identical or similar. Further, the height 1644 of the protrusions 1640 may range between approximately 0.001 inches to 0.020 inches (e.g., 0.002, 0.004, 0.006, 0.008, 0.010, 0.012, 0.014, 0.016, 0.018, or 0.020 inches).

In addition, the protrusions 1640 have a greater gap or distance 1636 between adjacent protrusions at the geometrical center. The distance 1636 between adjacent protrusions 1640 gradually gets smaller when moving further away from the geometrical center 1611. Again, in other words, the distance between the protrusions gradually change when moving outward form the geometrical center toward the toe end 180, the top rail 182, the heel end 190, and the sole 192. The distance 1636 is illustrated as the space in between each top surface 1624 of the protrusions 1640. The distance 1636 between the protrusions 1640 is created by the frustoconical surface where the base portion 1620 tapers to the top surface 1624. The greater the tapering of the protrusions 1640, the greater the distance 1636 in between adjacent protrusions 1640. Similarly, the less tapering of the protrusions 1640, the less distance in between adjacent protrusions 1640.

As illustrated in FIGS. 79, and 80, each protrusion 1640 includes a diameter 1648 that varies along its height due to the frustoconical shape of the protrusions. The diameter 1648 at the base portion 1620 of each protrusion is greatest and gets smaller toward the top surface 1624. The diameter of each protrusion 1640 correlates to the height 1644 of each protrusion. The greater the height 1644, the more tapering of the protrusions 1640, and thus the smaller the diameter 1648 at the top surface 1624. In many embodiments, the diameter 1648 of the top surface 1624 is smallest at the geometrical center 1611. The diameter 1648 of the top surface 1624 may gradually increase as the protrusions 1640 move farther away from the geometrical center 1611. The diameter 1648 of the top surface 1624 of the protrusions 1640 at the toe end 180 may be identical or similar to the diameter 1648 of the top surface 1624 of the protrusions 1640 at the heel end 190. The diameter 1648 of the top surface 1624 of the protrusions 1640 at the top rail 182, may be identical or similar to the diameter 1648 of the top surface 1624 of the protrusions 1640 at the sole 192. The diameter 1648 of the top surface 1624 of the protrusions at the toe end 180, the heel end 190, the top rail 182, and the sole 192 may be identical or similar. The diameter 1648 of the top surfaces 1624 may range from approximately 0.001 inches to 0.035 inches (e.g., 0.005, 0.010, 0.015, 0.020, 0.025, 0.030, or 0.035 inches).

In other constructions, the protrusions 1640 may comprise an alternative shape and cross-section 1652. The cross-section 1652 may be of any suitable shape (e.g., circular, diamond, rectangular, triangular, pentagonal, hexagonal, etc.).

The distance 1636, the height 1644, and the diameter 1648 of the top surface 1624 of the protrusions 1640 have a dampening effect on the kinetic energy transferred to the golf ball. The greater the distance 1636 and the greater the height 1644, the more kinetic energy is absorbed. Likewise, the smaller the distance 1636 and the smaller the height 1644, the less kinetic energy is absorbed. Alternatively, the greater the diameter, the less kinetic energy is absorbed; the smaller the diameter, the more kinetic energy is absorbed. Because the distance 1636 and the height 1644 are the greatest, and the diameter 1648 is the smallest near the geometrical center 1611, this is where the damping is greatest. As the distance 1636 and the height 1644 decrease and the diameter increase moving farther away from the geometrical center 1611, the damping decreases. The varying properties of the protrusions 1640 allow for more consistent ball speeds across the ball striking surface 1612. For example, the ball will experience similar speeds when the ball striking surface 1612 impacts the ball at the toe end 180, geometrical center 1611, as well as the heel end 190.

Face Inserts

In many embodiments, a putter golf club head can comprise a face insert. The various face insert embodiments can have the grooves as described above (i.e. varying width, varying depth, or varying widths and depths). When describing embodiments below, some parts of the putter 100 are referred to with the same reference numbers as described above. The putter golf club head comprises a front end 196, a rear end 194 opposite the front end 196, a toe end 180, a heel end 190 opposite the toe end 180, a top rail 182, a sole 192 opposite the top rail 182, a leading edge positioned between the front end 196 and the sole 192. The exterior surface of the putter golf club head can form a recess. More specifically, in some embodiments, a top wall, a toe wall, a heel wall opposite the toe wall, and a back wall of the putter type golf club head can form a recess. In some embodiments, a top wall, a toe wall, a heel wall opposite the toe wall, a back wall, and a bottom wall opposite the top wall of the putter golf club head can form a recess. The front end 196 of the putter golf club head can be configured to strike a golf ball. The recess of the putter golf club head can extend rearward the front end 196 in a direction towards the rear end 194.

The recess of the putter golf club head comprises a depth measured as a perpendicular distance from the front end 196 to the rear end 194. In many embodiments, the depth of the recess can range from 0.150 to 0.250 inch. In some embodiments, the depth of the recess can range from 0.150 to 0.200 inch, 0.150 to 0.220 inch, 0.150 to 0.240 inch, 0.160 to 0.200 inch, 0.160 to 0.220 inch, 0.160 to 0.240 inch, 0.160 to 0.250 inch, 0.170 to 0.200 inch, 0.170 to 0.220 inch, 0.170 to 0.240 inch, 0.170 to 0.250 inch, 0.180 to 0.200 inch, 0.180 to 0.220 inch, 0.180 to 0.240 inch, or 0.180 to 0.250 inch. For example, the depth of the recess can be 0.150, 0.160, 0.170, 0.180, 0.190, 0.200, 0.210, 0.220, 0.230, 0.240, 0.250 inch.

In other embodiments, the depth of the recess can range from 0.20 to 0.80 inch. In some embodiments, the depth of the recess can range from 0.20 to 0.50 inch, 0.30 to 0.60 inch, 0.40 to 0.70, or 0.50 to 0.80 inch. In some embodiments, the depth of the recess can range from 0.20 to 0.40 inch, 0.30 to 0.50, 0.40 to 0.60 inch, 0.50 to 0.70 inch, or 0.60 to 0.80 inch. For example, the depth of the recess can be 0.20, 0.25, 0.30, 0.35, 0.40, 0.45, 0.50, 0.55, 0.60, 0.65, 0.70, 0.75, or 0.80.

The recess of the putter golf club head can be configured to receive the face insert. In many embodiments, the face insert may be shaped complementary to the recess of the putter golf club head. In other embodiments, the face insert may not be shaped complementary to the recess of the putter golf club head. When the recess receives the face insert, the face insert abuts the back wall of the recess. In many embodiments, the face insert can be coupled to the recess by an adhesive such as tape, very high bond tape, glue, epoxy, or any type of adhesive compound. In other embodiments, the face insert can be coupled to the recess by fasteners or pins (not shown). In other embodiments, the face insert can be coupled to the recess by a press-fit or a friction-fit. In some embodiments, the face insert can be coupled to the recess with a mechanical interlock structure such as an undercut or a plurality of hook structures.

The face insert can form a portion of the front end 196, the sole 192, the heel end 190, the toe end 180, the top rail 182, or any combination thereof of the putter golf club head. In many embodiments, the face insert forms a portion of the front end 196 and the sole 192 of the putter golf club head. In other embodiments, the face insert forms only a portion of the front end 196. In other embodiments, the face insert forms a portion of the front end 196, the sole 192, and the top rail 182 of the putter golf club head.

In many embodiments, the face insert comprises a thickness corresponding to the depth of the recess. Similar to the depth of the recess, the thickness of the face insert is measured as the perpendicular distance from the front end 196 to the rear end 194 of the putter golf club head. In many embodiments, the thickness of the face insert can range 0.150 to 0.250 inch. In some embodiments, the thickness of the face insert can range from 0.150 to 0.200 inch, 0.150 to 0.220 inch, 0.150 to 0.240 inch, 0.160 to 0.200 inch, 0.160 to 0.220 inch, 0.160 to 0.240 inch, 0.160 to 0.250 inch, 0.170 to 0.200 inch, 0.170 to 0.220 inch, 0.170 to 0.240 inch, 0.170 to 0.250 inch, 0.180 to 0.200 inch, 0.180 to 0.220 inch, 0.180 to 0.240 inch, or 0.180 to 0.250 inch. For example, the thickness of the face insert can be 0.150, 0.160, 0.170, 0.180, 0.190, 0.200, 0.210, 0.220, 0.230, 0.240, 0.250 inch.

In other embodiments, the thickness of the face insert can range from 0.20 to 0.80 inch. In some embodiments, the thickness of the face insert can range from 0.20 to 0.50 inch, 0.30 to 0.60 inch, 0.40 to 0.70, or 0.50 to 0.80 inch. In some embodiments, the thickness of the face insert can range from 0.20 to 0.40 inch, 0.30 to 0.50, 0.40 to 0.60 inch, 0.50 to 0.70 inch, or 0.60 to 0.80 inch. For example, the thickness of the face insert can be 0.20, 0.25, 0.30, 0.35, 0.40, 0.45, 0.50, 0.55, 0.60, 0.65, 0.70, 0.75, or 0.80 inch. In many embodiments, the depth of the recess can be the same as the thickness of the face insert. In some embodiments, the depth of the recess can be different from the thickness of the face insert. In some embodiments, the depth of the recess can be greater than the thickness of the face insert or vice versa. In some embodiments, the depth of the recess can be less than the thickness of the face insert or vice versa.

In many embodiments, the face insert can form a percentage of the front end 196, and/or the sole of the putter golf club head. In many embodiments, the face insert can form greater than or equal to 70% of the front end 196. In some embodiments, the face insert can form at least 70%, 75%, 80%, 85%, 90%, 95%, or 100% of the front end 196. In some embodiments, the face insert can form greater than or equal to 75%, 80%, 85%, 90%, 91%, 92%, 93%, 94%, 95%, 96%, 97%, 98%, 99%, or 100% of the front end 196. In many embodiments, the face insert can form at least 10% of the sole of the putter golf club head. In some embodiments, the face insert can form at least 12%, 14%, 16%, 18%, 20%, 22%, 24%, 25%, 26%, 28%, 30%, 35%, 40%, 45%, 50%, 55%, 60%, 65%, 70%, 75%, or 80% of the sole of the putter golf club head. In some embodiments, the face insert can form greater than or equal 10%, 15%, 20%, 25%, 30%, 35%, 40%, 45%, 50%, 55%, 60%, 65%, 70%, 75%, or 80% of the sole of the putter golf club head.

In many embodiments, the face insert can comprise a polymer type material. The polymer type material can comprise polyethylene, polypropylene, polytetrafluroethylene, polyisobutylene, polyvinlycloride, or any other polymer type material. In many embodiments, the face insert can comprise a PEBAX. More specifically, the PEBAX is a polyether block amide that comprises a thermoplastic elastomer made from a flexible polyether and rigid polyamide. The rigid polyamide can comprise Nylon. The PEBAX can comprise different compounds that correspond to different Shore D hardness values, polyether percentages, and/or polyamide percentages. In many embodiments, the PEBAX can comprise a PEBAX 4033 (Arkema, Paris France) or a PEBAX 6333 (Arkema, Paris France). The PEBAX 4033 (Arkema, Paris France) comprises a Tetramethylene oxide 53% wt and a Nylon 12. The PEBAX 6333 (Arkema, Paris France) comprises a Nylon 11.

The PEBAX can comprise a percentage of polyether by volume. In some embodiments, the PEBAX can comprise 0% to 10%, 10% to 20%, 15% to 30%, 20% to 30%, 30% to 40%, 30% to 50%, 30% to 60%, 40% to 50%, 40% to 60%, 50% to 60%, or 60% to 70% polyether by volume. For example, the PEBAX can comprise 0%, 5%, 10%, 15%, 20%, 25%, 30%, 35%, 40%, 45%, 50%, 55%, 60%, 65%, or 70% of polyether by volume. In some embodiments, the PEBAX can comprise 0% to 10%, 10% to 20%, 15% to 30%, 20% to 30%, 30% to 40%, 40% to 50%, 40% to 60%, 50% to 60%, or 60% to 70% of polyamide by volume. For example, the PEBAX can comprise 0%, 5%, 10%, 15%, 20%, 25%, 30%, 35%, 40%, 45%, 50%, 55%, 60%, 65%, or 70% of polyamide by volume. As the percentage of polyether percentage increases, the hardness of the PEBAX decreases. As the percentage of polyamide percentage increases, the hardness of the PEBAX increases. For example, the PEBAX 4033 (Arkema, Paris France) can comprise 40% to 60% polyether by volume and 15% to 30% polyamide by volume. For example, the PEBAX 6333 (Arkema, Paris France) can comprise 15% to 30% polyether by volume and 40% to 60% polyamide by volume.

In many embodiments, the PEBAX can comprise a hardness ranging from Shore D 25 to Shore D 75. In some embodiments, the hardness of the PEBAX can range from Shore D 25 to Shore D 35, Shore D 35 to Shore D 45, Shore D 36 to Shore D 44, Shore D 38 to Shore D 42, Shore D 45 to Shore D 55, Shore D 55 to Shore D 65, Shore D 56 to Shore D 64, Shore D 60 to Shore D 65, or Shore D 65 to Shore D 75. For example, the hardness of the PEBAX can be Shore D 25, 30, 35, 40, 45, 50, 55, 60, 65, or 70.

In many embodiments, the PEBAX 4033 (Arkema, Paris France) can comprise a lower hardness than the PEBAX 6333 (Arkema, Paris France). In many embodiments, the PEBAX 4033 (Arkema, Paris France) can comprise a hardness range of Shore D 35 to Shore D 55. In some embodiments, the PEBAX 4033 (Arkema, Paris France) can comprise a hardness range of Shore D 38 to Shore D42, or Shore D 39 to Shore D 41. For example, the PEBAX 4033 (Arkema, Paris France) can be comprise a Shore D hardness of 40. In many embodiments, the PEBAX 6333 (Arkema, Paris France) can comprise a hardness range of Shore D 50 to Shore D 75. In some embodiments, the PEBAX 6333 (Arkema, Paris France) can comprise a hardness range of Shore D 55 to Shore D 70, or Shore D 60 to Shore D 65. For example, the PEBAX 6333 (Arkema, Paris France) can comprise a Shore D hardness of 63.

In some embodiments, the face insert can comprise a material such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

The face insert can be formed by a number of different processes. The different forming processes include: injection molding, casting, blow molding, compression molding, co-molding, laser forming, film insert molding, gas assist molding, rotational molding, thermoforming, laser cutting, 3-D printing, forging, stamping, electroforming, machining, molding, or any combination thereof. Further, the face insert can have any combination of thicknesses and forming processes described above.

Single Component Face Insert

In some embodiments, the face insert can comprise a single component system. In these embodiments, the face insert can comprise a ball striking face plate, or any other single component. The face insert comprising the single component system can comprise the grooves described above.

FIGS. 85-88 illustrate another embodiment of a putter, putter 1700. The putter 1700 comprises a putter head 1702. Accordingly, when describing the putter head 1702, parts of the putter head 102 can be referred to with the same reference numbers described above. The putter head 1702 comprises a putter face 1710, wherein the putter face 1710 comprises a recess 1712. In other examples, the putter head can further comprise a slot (not shown) positioned on the top rail 182 or the sole 192, wherein the slot integrally extends into the recess 1712.

Figure 86:
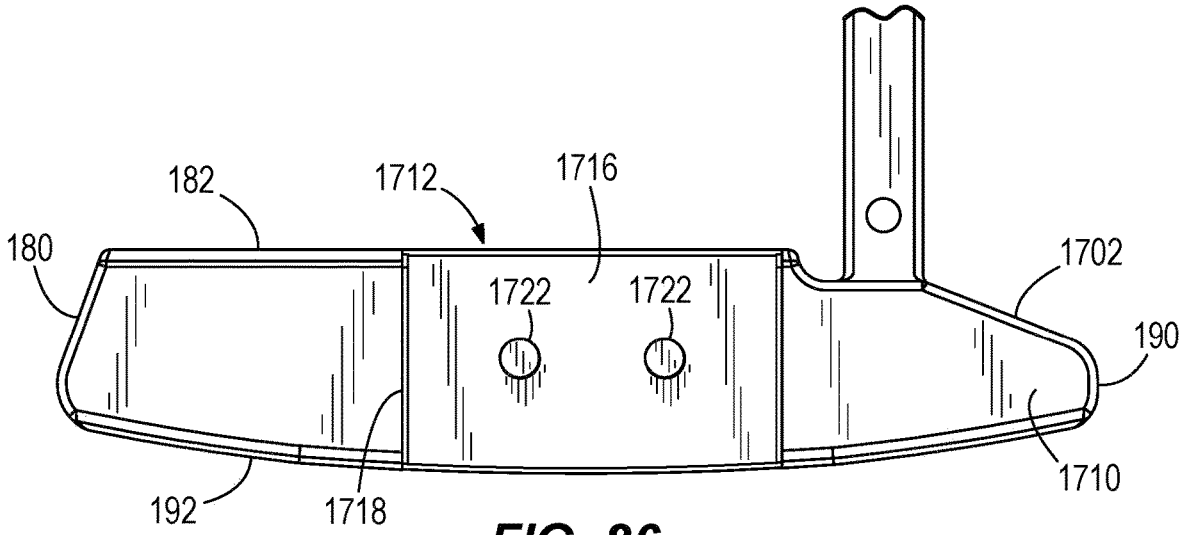
FIG. 86 shows an alternative view of the putter of FIG. 84.

As illustrated in FIG. 86, the recess 1712 comprises a flat surface 1716 and a perimeter 1718. In some examples, the flat surface 1716 of the recess 1712 can comprise bores 1722. The bores 1722 comprise a diameter and can further comprise threading. In other examples, the perimeter 1718 of the recess 1712 can comprise a lip (not shown), wherein the lip can extend along the entire perimeter 1718. Further in other examples, the lip can extend along a portion of the perimeter 1718. For example, the lip can extend along the top rail 182 and the sole 192. Further, the recess 1712 can receive a face insert 1726.

Figure 85:
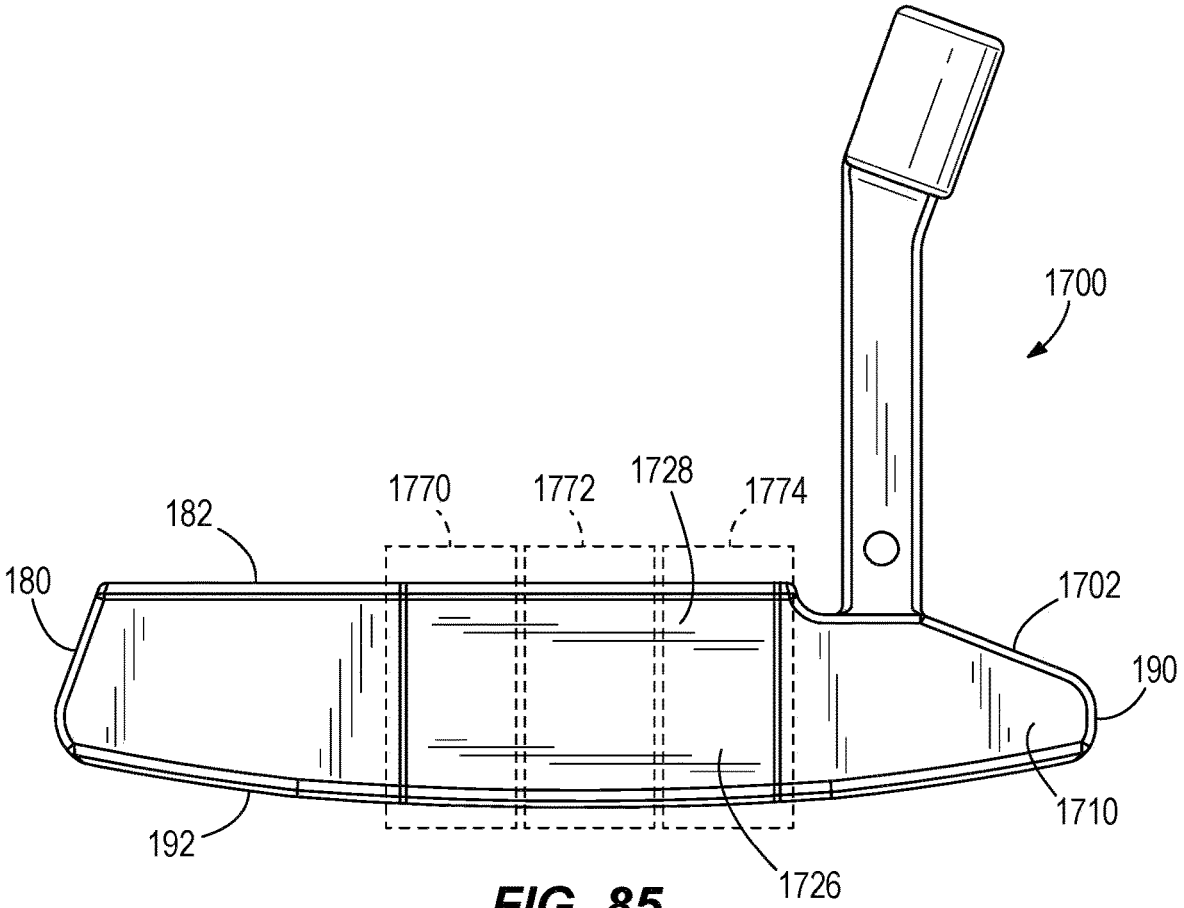
FIG. 85 shows a front view of a putter according to another embodiment.
Figure 87A:
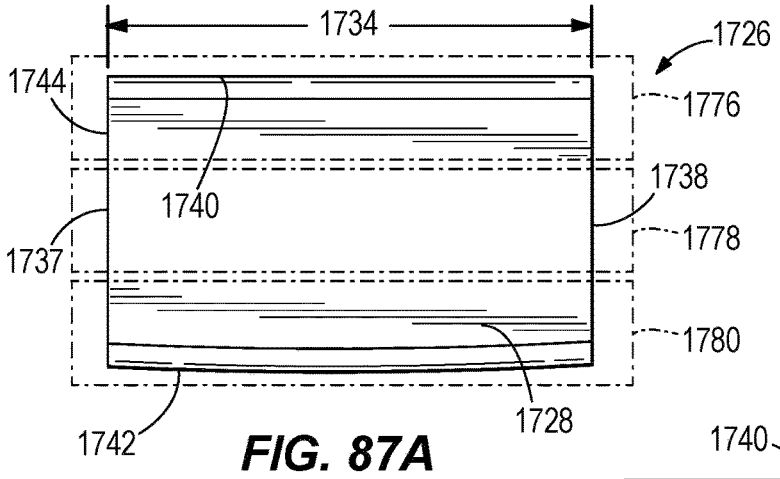
FIG. 87A shows a front view of a face insert of the putter of FIG. 84.
Figure 87B:
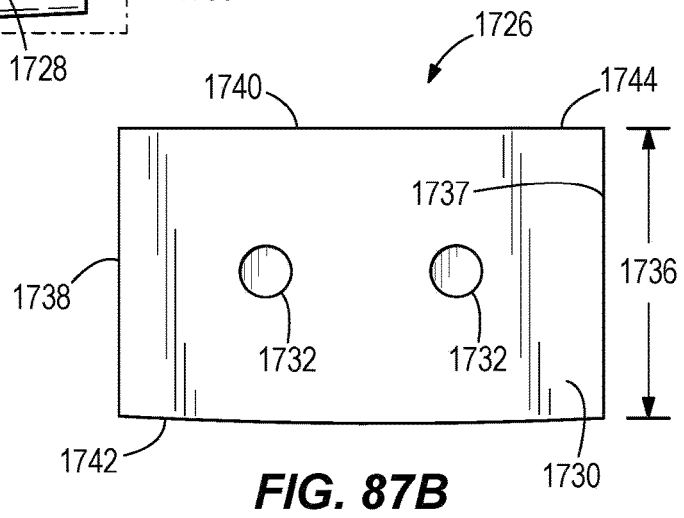
FIG. 87B shows a rear view of the face insert of FIG. 86A.

As illustrated in FIGS. 87A and 87B, the face insert 1726 comprises a ball striking surface 1728 and a back surface 1730, opposite the ball striking surface 1728. As illustrated in FIG. 85, the ball striking surface 1728 is horizontally separated into three portions, which are a toe portion 1770 proximate the toe end 180, a heel portion 1774 proximate the heel end 190, and a center portion 1772 positioned between the toe portion 1770 and the heel portion 1774. As illustrated in FIG. 87A, the ball striking face plate is further vertically separated into three portions, which are a top rail portion 1776 proximate the top rail 182, the sole portion 1780 proximate the sole 192, and a mid portion positioned between the top rail portion 1776 and the sole portion 1780. The ball striking surface 1728 of the face insert 1726 can comprise grooves. The grooves can comprise similar features to the groove examples of putter 100. More specifically, the grooves can be similar to the grooves of ball striking face/ball striking surface 112, 212, 312, 412, 512, 612, 712, 1012, 1412, 1500, 1612, 1812, 2212, 3212, 4212 and 5212. The grooves comprise a depth, wherein the depth of the grooves vary from the toe portion 1770 toward the heel portion 1774 and from the top rail portion 1776 toward the sole portion 1780. The depth of the groove increases from the toe portion 1770 and the heel portion 1774 toward the center portion 1772. Similarly, the depth of the grooves 1720 increases from the top rail portion 1776 and the sole portion 1780 toward the mid portion 1778. The deepest part of the grooves 1720 is at the center portion 1772 and mid portion 1778 of the grooves 1720. The varying depth of the grooves 1720 in the exemplary embodiment increase forgiveness by allowing for more normalized hits across the ball striking surface 1728.

The back surface 1730 of the face insert 1726 can comprise cylindrical protrusions 1732. The cylindrical protrusions 1732 comprise a diameter equal to the diameter of the bores 1722 of the recess 1712. Further, the cylindrical protrusion 1732 is complementary to the bores 1722. When the face insert 1726 is coupled to the recess 1712, the cylindrical protrusions 1732 can align concentrically with the bores 1722. Further, the face insert 1726 is complementary to the recess 1712, wherein the ball striking surface 1728 of the face insert 1726 is flush with the putter face 1710 when coupled within the recess 1712.

The face insert 1726 further comprises a width 1734, and a length 1736. As illustrated in FIG. 87A, the width 1734 of the face insert 1726 is the distance measured from a first side 1737 of the face insert 1726 to a second side 1738 of the face insert 1726. The width 1734 of the face insert 1726 can range from 1.65 inches to 2.10 inches. For example, the width 1734 of the face insert 1726 can be 1.68 inches, 1.72 inches, 1.76 inches, 1.80 inches, 1.84 inches, 1.88 inches, 1.92 inches, 1.96 inches, or 2.00 inches. In one example, the width 1734 of the face insert 1726 can be 1.68 inches, which is approximately the diameter of a ball. In examples where the face insert 1726 comprises a width 1734 of 1.68 inches, the width can act as a visual aid to align the ball.

Figure 88:
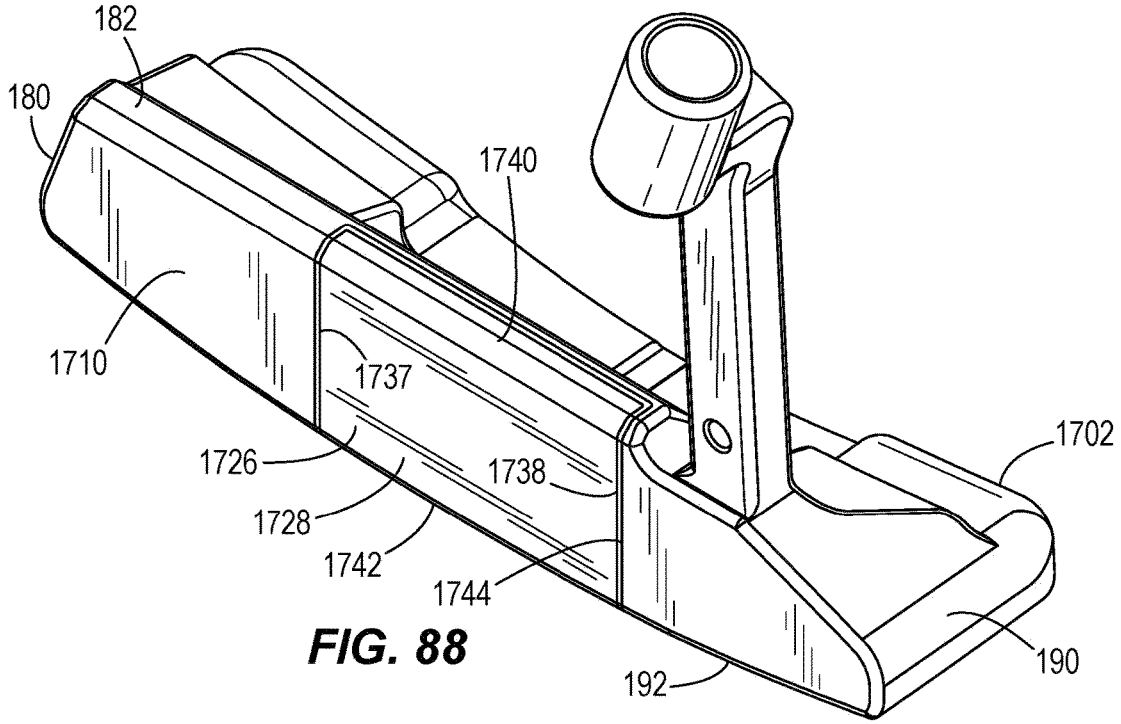
FIG. 88 shows a perspective view of the putter of FIG. 84.

As illustrated in FIG. 87B, the length 1736 of the face insert 1726 is the distance measured from a top end 1740 of the face insert 1726 to a bottom end 1742 of the face insert 1726. As illustrated in FIG. 85, the length 1736 of the face insert 1726 can span the complete distance from the sole 192 to the top rail 182 of the putter head 1702, wherein the top end 1740 can form a portion of the top rail 182, and the bottom end 1742 can form a portion of the sole 192. In some examples, the length 1736 of the face insert 1726 can span from the top rail 182 to proximate the sole 192, wherein the top end 1740 can form a portion of the top rail 182 as seen in FIG. 88. In other examples, the length 1736 of the face insert 1726 can span from the sole 192 to proximate the rail 182, wherein the bottom end 1742 can form a portion of the sole 192. The length 1736 of the face insert 1726 allows the ball to consistently strike the face insert 1726 during impact instead of the putter face 1710 or perimeter 1744 of the ball striking surface 1728. The ball consistently striking the face insert 1726 during impact allows for a consistent feel.

In other examples, the face insert 1726 can further comprise an edge indent. The edge indent can extend along the entire perimeter 1744 of the ball striking surface 1728. In other examples, the edge indent can extend along a portion of the perimeter 1744 of the ball striking surface 1728. For example, the edge indent can extend along the first side 1737 and the second side 1738. In another example, edge indent can extend along the first side 1737, the bottom end 1742, and the second side 1738. Further, the edge indent is complementary to the lip of the recess 1712.

In one example, the face insert 1726 can be coupled to the recess 1712 of the putter face 1710 by any adhesive such as epoxy, glue, tape, or any other securing compound. The face insert 1726 can further be coupled to the recess 1712 by a compression fit of the cylindrical protrusions 1732 positioned within the bores 1722.

In another example, the face insert 1726 can be coupled to the recess 1712 by inserting the face insert 1726 through the slot. A sheet (not shown) can then be inserted into the slot, positioned between the face insert 1726 and the recess 1712, wherein the sole 192/top rail 182 is flush with the face insert 1726 and the sheet disposed within the recess 1712. The sheet compresses the edge indent of the face insert 1726 against the lip of the recess 1712, securing the face insert 1726 within the recess 1712. The sheet can comprise a curved aperture (not shown) positioned on an exposed surface of the sheet when coupled within the recess 1712. The curved aperture can receive an extracting tool to remove the sheet from the slot. Removing the sheet allows the face insert 1726 to be loose within the recess 1712 and can then be removed to be interchanged with a face insert 1726 of a different material. Face inserts 1726 of different materials allow for different feel and sound during impact.

The face insert may be made of steel, tungsten, aluminum, titanium, composites, other metals, metal alloys, polymers, or any other material. The sheet may also be made of steel, tungsten, aluminum, titanium, composites, other metals, metal alloys, polymers, or any other material. Further, the sheet can be a dampening material. Further still, the sheet can be the same material as the face insert in some examples or be made of a separate material in other examples.

Figure 89:
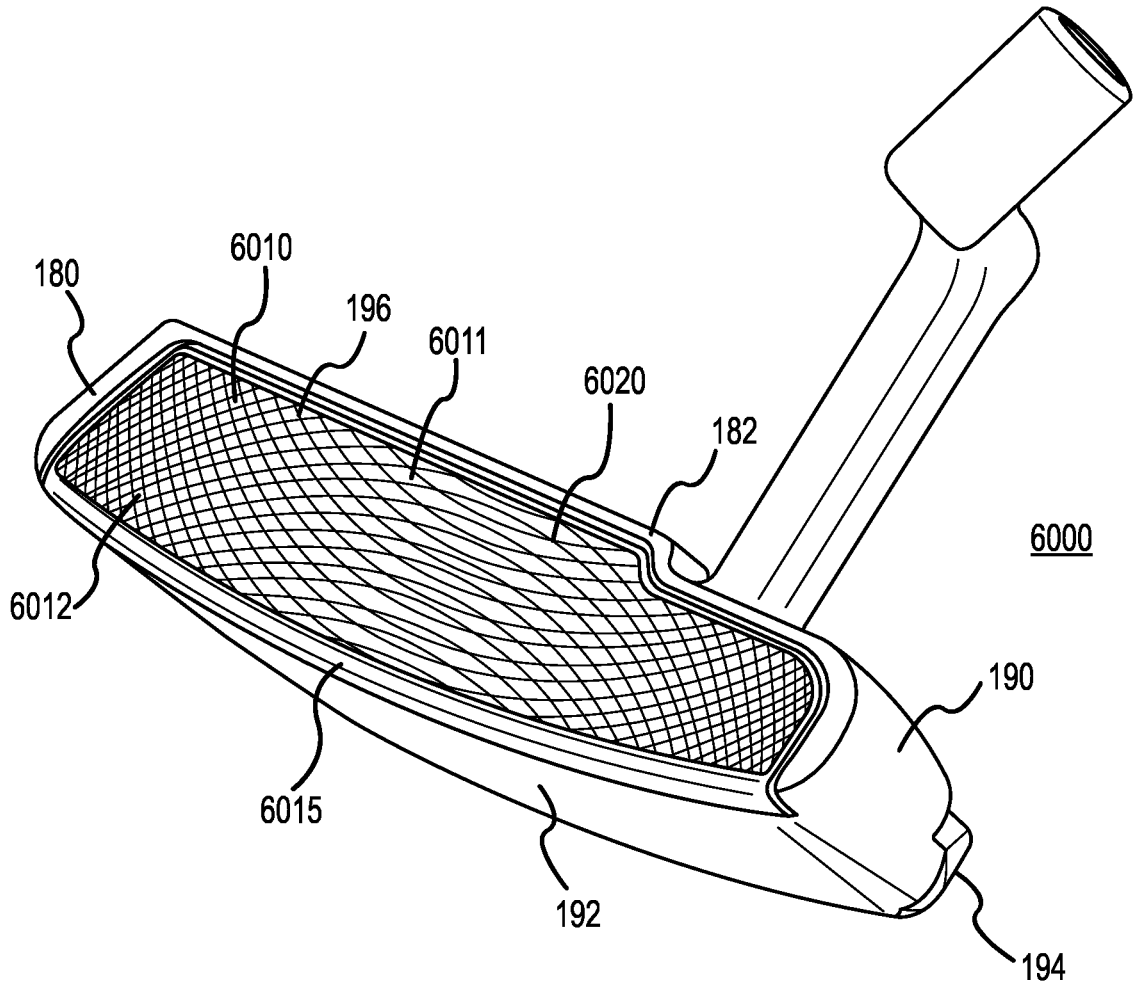
FIG. 89 shows a perspective view of a putter according to one embodiment.
Figure 90:
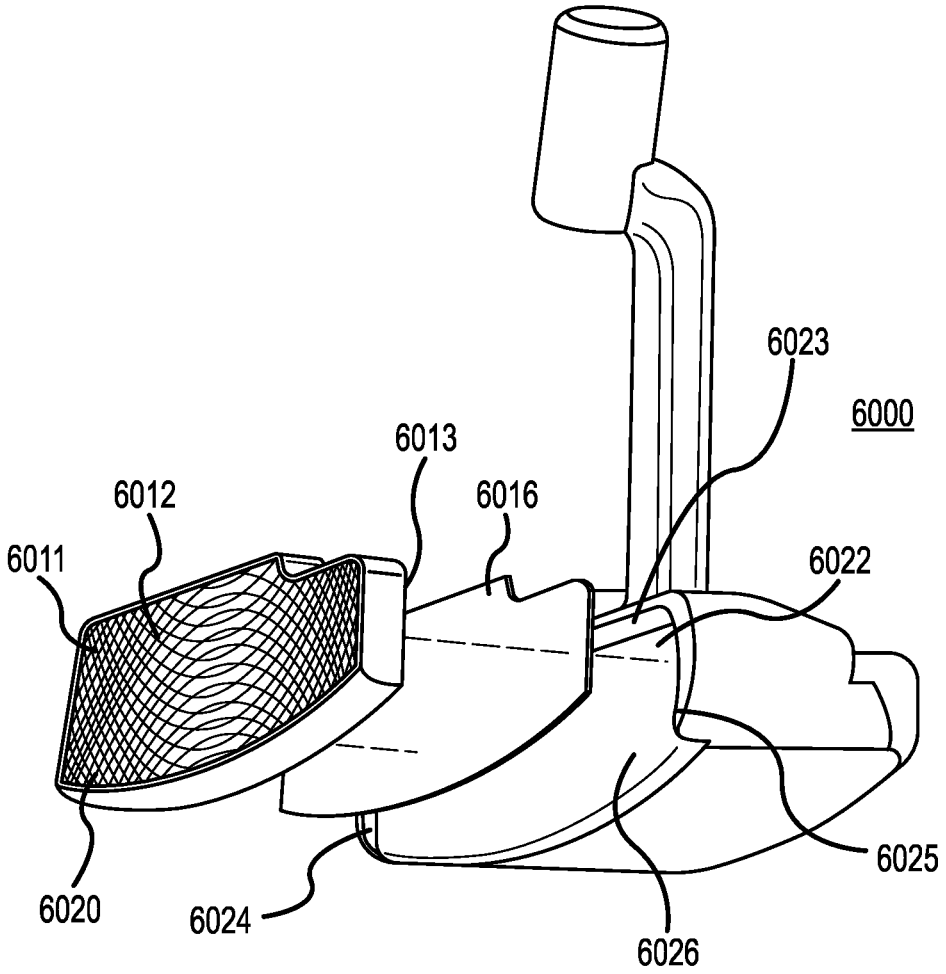
FIG. 90 shows an exploded view of the putter of FIG. 89.

In another embodiment, as illustrated in FIGS. 89 and 90, the putter golf club head 6000 comprises the front end 196, the rear end 194, the toe end 184, the heel end 190, the top rail 182, the sole 192, and a leading edge 6015. The exterior surface of the putter golf club head 6000 forms a recess 6022. More specifically, a top wall 6023, a toe wall 6024, a heel wall 6025 opposite the toe wall 6024, and a back wall 6026 of the putter golf club head 6000 all form the recess 6022. The recess 6022 of the putter golf club head 6000 can extend rearward from the front end 196 towards the rear end 194.

The putter golf club head 6000 can comprise the face insert 6010. In this embodiment, the face insert 6010 of the putter golf club head 6000 can comprise a ball striking face plate 6012. The ball striking face plate 6012 can comprise the front striking surface 6011 and a rear surface 6013 opposite the front striking surface 6011. The front striking surface 6011 of the ball striking face plate 6012 can comprise grooves 6020 similar to the grooves described above. The rear surface 6013 of the ball striking face plate 6012 is adjacent to and abuts the back wall 6026 of the recess 6022. In many embodiments, the face insert 6010 can be coupled to the recess 6022 by an adhesive 6016. The adhesive 6016 can be between the face insert 6010 and the recess 6022. The adhesive 6016 can be similar to the adhesives described above. In many embodiments, the face insert 6010 can form a portion of the front end 196 and the sole 192.

In many embodiments, the face insert 6010 can provide the advantage of a more softer and unique sound/feel during golf ball impacts over putter faces without face inserts. The softer and unique sound/feel during golf ball impacts corresponds to the hardness and the material of the face insert 6010. The material and the hardness of the face insert 6010 can be similar to the materials and hardness described above. The softer feel and sound can be pleasing to a player and prevent distractions that other golf club heads can provoke with louder impact sounds. This softer and unique sound/feel during golf ball impacts can help a player's mental focus thereby improving the player's score.

Multi-Component Face Insert

In some embodiments, the face insert can comprise a two component system. In these embodiments, the two component system of the face insert can comprise a ball striking face plate and a face insert base, a polymeric material and a frame, or a plurality of openings. The face insert comprising the two component system can comprise the grooves described above.

Ball Striking Face Plate and Face Insert Base

In one embodiment, the face insert can comprise a two component system. The two component system can comprise a ball striking face plate and a face insert base. The ball striking face plate of the face insert can comprise a first material. The face insert base of the face insert can comprise a second material. In many embodiments, the first material of the ball striking face plate and the second material of the face insert base can be different. In some embodiments, the first material of the ball striking face plate and the second material of the face insert base can be similar. In many embodiments, the first material of the ball striking face plate can comprise a polymer type material. In some embodiments, the first material of the ball striking face plate can comprise a metallic material. In many embodiments, the second material of the face insert base can comprise a polymer type material.

The first material or the second material can comprise a polymer type material. The polymer type material can comprise polyethylene, polypropylene, polytetrafluroethylene, polyisobutylene, polyvinlycloride, or any other polymer type material. In many embodiments, the face insert can comprise a PEBAX. More specifically, the PEBAX is a polyether block amide that is a thermoplastic elastomer made of a flexible polyether and rigid polyamide. The rigid polyamide can comprise Nylon. The PEBAX can comprise different compounds that correspond to different Shore D hardness values, polyether percentages, and/or polyamide percentages. In many embodiments, the PEBAX can comprise a PEBAX 4033 (Arkema, Paris France) or a PEBAX 6333 (Arkema, Paris France). The PEBAX 4033 (Arkema, Paris France) comprises a Tetramethylene oxide 53% wt and a Nylon 12. The PEBAX 6333 (Arkema, Paris France) comprises a Nylon 11. The first material and the second material can comprise similar polyether percentages, polyamide percentages, or Shore D hardness values as described above.

The first material can comprise a metal such as steel, steel alloys, tungsten, tungsten alloys, aluminum, aluminum alloys, titanium, titanium alloys, vanadium, vanadium alloys, chromium, chromium alloys, cobalt, cobalt alloys, nickel, nickel alloys, other metals, other metal alloys, composite polymer materials or any combination thereof.

In some embodiments, the first material of the ball striking face plate can comprise a translucent material and the second material of the face insert base can comprise a metallic material. In these embodiments, the second material can further comprise a design (e.g. print, etching, stamp, extrude, etc.). The second material can comprise a design that can be seen through the translucent first material. In many embodiments, the translucent material of the first material can be non-colored or blue. In other embodiments, the translucent material of the first material can comprise any translucent color.

The ball striking face plate of the face insert can comprise a thickness. In many embodiments, the thickness of the ball striking face plate can range from 0.015 to 0.115 inch. In some embodiments, the thickness of the ball striking face plate can range from 0.015 to 0.045 inch, 0.020 to 0.050 inch, 0.025 to 0.055 inch, 0.050 to 0.100 inch, 0.055 to 0.105 inch, 0.060 to 0.110, or 0.065 to 0.115 inch. In some embodiments, the thickness of the ball striking face plate can be at least 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate can be greater than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. In some embodiments, the thickness of the ball striking face plate can be less than or equal to 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch. For example, the thickness of the ball striking face plate can be 0.015, 0.020, 0.025, 0.030, 0.035, 0.040, 0.045, 0.050, 0.055, 0.060, 0.065, 0.070, 0.075, 0.080, 0.085, 0.090, 0.095, 0.10, 0.105, 0.110, or 0.115 inch.

In other embodiments, the thickness of the ball striking face plate can range from 0.115 to 0.40 inch. In some embodiments, the thickness of the ball striking face plate can range from 0.115 to 0.20 inch, 0.15 to 0.30 inch, 0.20 to 0.30 inch, 0.25 to 0.35 inch, or 0.30 to 0.40 inch. In some embodiments, the thickness of the ball striking face plate can be at least 0.15, 0.20, 0.25, 0.30, 0.35, or 0.40 inch. In some embodiments, the thickness of the ball striking face plate can be greater than or equal to 0.15, 0.20, 0.25, 0.30, 0.35, or 0.40. In some embodiments, the thickness of the ball striking face plate can be less than or equal to 0.15, 0.20, 0.25, 0.30, 0.35, or 0.40 inch. For example, the thickness of the ball striking face plate can be 0.15, 0.20, 0.25, 0.30, 0.35, or 0.40 inch.

The face insert base of the face insert can comprise a thickness. In many embodiments, the thickness of the face insert base can range from 0.05 to 0.20 inch. In some embodiment, the thickness of the face insert base can range from 0.05 to 0.10 inch, or 0.10 to 0.20 inch. In some embodiments, the thickness of the face insert base can be at least 0.05, 0.10, 0.15, or 0.20 inch. In some embodiments, the thickness of the face insert base can be greater than or equal to 0.05, 0.10, 0.15, or 0.20 inch. In some embodiments, the thickness of the face insert base can be less than or equal to 0.05, 0.10, 0.15, or 0.20 inch. For example, the thickness of the face insert base can be 0.05, 0.10, 0.15, or 0.20 inch.

In other embodiments, the thickness of the face insert base can range from 0.20 to 0.80 inch. In some embodiments, the thickness of the face insert base can range from 0.20 to 0.50 inch, 0.30 to 0.60 inch, 0.40 to 0.70 inch, or 0.50 to 0.80 inch. In some embodiment, the thickness of the face insert base can range from 0.20 to 0.40 inch, 0.30 to 0.50 inch, 0.40 to 0.60 inch, 0.50 to 0.70 inch, or 0.60 to 0.80 inch. In some embodiments, the face insert base of the face insert can be at least 0.20, 0.25, 0.30, 0.35, 0.40, 0.45, 0.50, 0.55, 0.60, 0.65, 0.70, 0.75, or 0.80 inch. In some embodiments, the face insert base of the face insert can be greater than or equal to 0.20, 0.25, 0.30, 0.35, 0.40, 0.45, 0.50, 0.55, 0.60, 0.65, 0.70, 0.75, or 0.80 inch. In some embodiments, the face insert base of the face insert can be less than or equal to 0.20, 0.25, 0.30, 0.35, 0.40, 0.45, 0.50, 0.55, 0.60, 0.65, 0.70, 0.75, or 0.80 inch. For example, the thickness of the face insert base can be 0.20, 0.25, 0.30, 0.35, 0.40, 0.45, 0.50, 0.55, 0.60, 0.65, 0.70, 0.75, or 0.80 inch.

I. Metal Ball Striking Face Plate and Polymer Face Insert Base

FIGS. 81-84 illustrate another embodiment of a putter head comprising a face insert 1910. The putter head further comprises a recess located on a front surface of the putter head (not shown). The face insert 1910 is positioned within the recess. The face insert 1910 can produce a unique feel and sound upon impact with a ball. A metal face insert alone creates a hard sound and feel. The face insert 1910 creates a softer sound and feel than metal face inserts because the face insert 1910 comprises a composition of metallic and/or non-metallic material as described herein.

The face insert 1910 comprises a ball striking face plate 1912 and a face insert base 1914. The ball striking face plate 1912 comprises a front striking surface 1911 and a rear surface 1913, opposite the front striking surface 1911. The face insert base 1914 comprises a front surface 1918. The rear surface 1913 of the ball striking face plate 1912 aligns with a portion of the front surface 1918 of the face insert base 1914. The front surface 1918 of the face insert base 1914 thereby is adjacent to the rear surface 1913 of the ball striking face plate 1912. When the rear surface 1913 of the ball striking face plate 1912 is positioned onto the front surface 1918 of the face insert base 1914, the ball striking face plate 1912 covers greater than 91%, greater than 92%, greater than 93%, greater than 94%, greater than 95%, greater than 96%, greater than 97%, greater than 98%, greater than 99%, or 100% of the front surface 1918 of the face insert base 1914.

Figure 81:
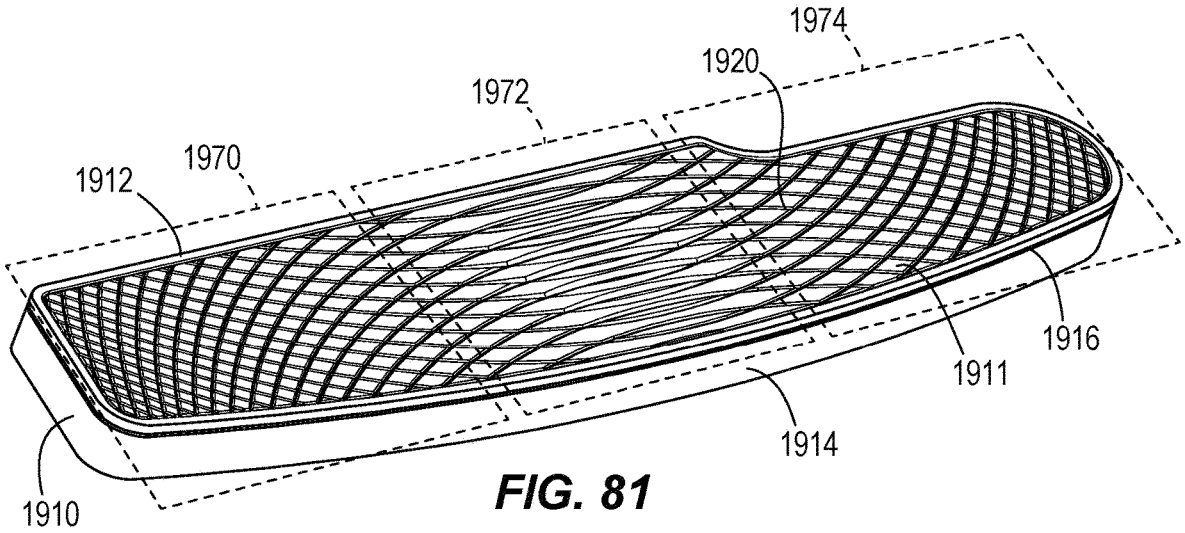
FIG. 81 shows a face insert of a golf club head according to one embodiment.
Figure 84:
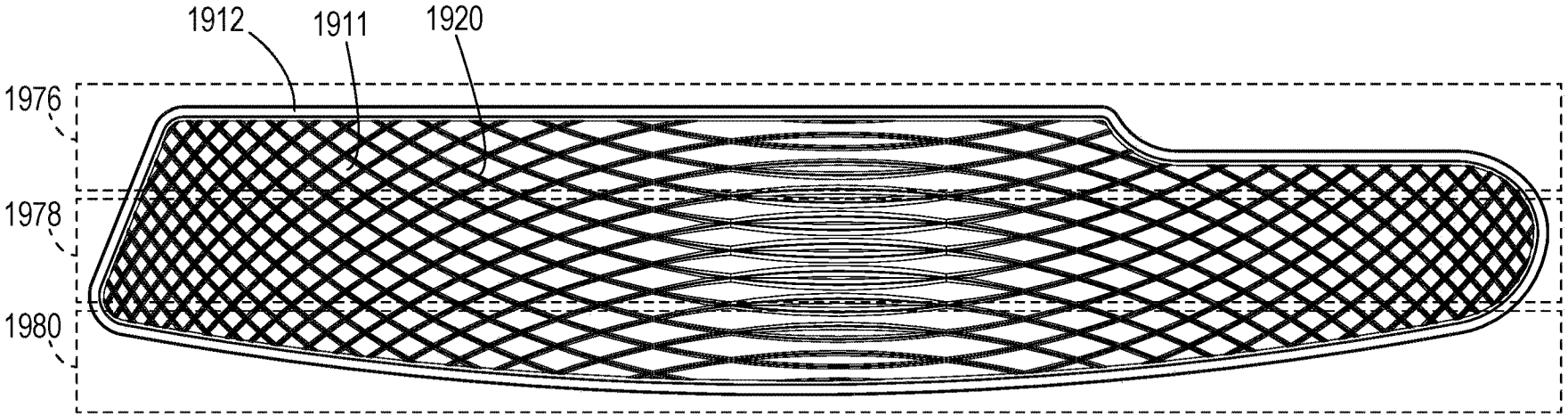
FIG. 84 shows a schematic diagram of a ball striking face of FIG. 82.

As illustrated in FIG. 81, the ball striking face plate 1912 is horizontally separated into three portions, which are a toe portion 1970 proximate the toe end 180, a heel portion 1974 proximate the heel end 190, and a center portion 1972 positioned between the toe portion 1970 and the heel portion 1974. As illustrated in FIG. 84, the ball striking face plate is further vertically separated into three portions, which are a top rail portion 1976 proximate the top rail 182, the sole portion 1980 proximate the sole 192, and a mid portion 1978 positioned between the top rail portion 1976 and the sole portion 1980.

The ball striking face plate 1912 further comprises grooves 1920 positioned on the front striking surface 1911, wherein the grooves 1920 are similar to the groove embodiments in ball striking face/ball striking surface: 112, 212, 312, 412, 512, 612, 712, 1012, 1312, 1412, 1500, 1612, 1812, 2212, 2312, 4212 and 5212. The grooves 1920 comprise a depth, wherein the depth of the grooves 1920 vary in a direction extending between the top rail 182 and the sole 192 in a direction extending between the heel end 190 and the toe end 180. More specifically, the grooves 1920 vary from the toe portion 1970 toward the heel portion 1974 and from the top rail portion 1976 toward the sole portion 1980. The depth of the groove 1920 increases from the toe portion 1970 and the heel portion 1974 toward the center portion 1972. Similarly, the depth of the grooves 1920 increases from the top rail portion 1976 and the sole portion 1980 toward the mid portion 1978. The deepest portion of at least one groove 1920 is defined by a general planar surface portion of the groove 1920. The general planar surface portion is located at a combined center portion 1972 and mid portion 1978 of the grooves 1920. The varying depth of the grooves 1920 in the exemplary embodiment increase forgiveness by allowing for more normalized hits across the ball striking face plate 1912.

Figure 82:
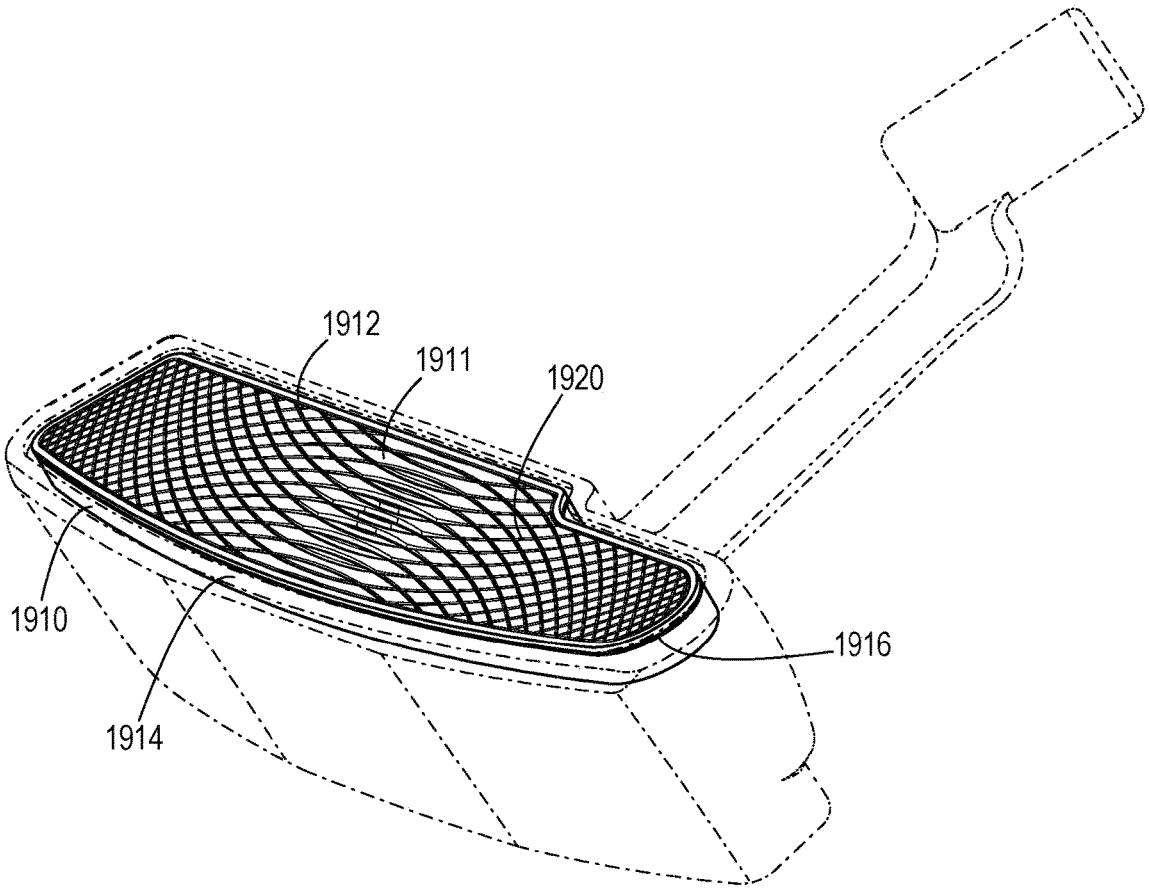
FIG. 82 shows another face insert of the golf club head of FIG. 81.

In some examples, the ball striking face plate 1912 and the face insert base 1914 of the face insert 1610 can be made of the same material. The materials can be steel, tungsten, aluminum, titanium, composites, other metals, metal alloys, polymers, copolymers or any other material. As illustrated in FIG. 81, both the ball striking face plate 1912 and the face insert base 1914 of the face insert 1910 are made of a polymer or copolymer such as a block of polyamide and polyether. In other examples, the ball striking face plate 1912 of the face insert 1910 can comprise a different material from the face insert base 1914. As illustrated in FIG. 82, the ball striking face plate 1912 is made of a metallic material and the face insert base 1914 is made of a non-metallic material. The metallic material of the ball striking face plate 1912 can be steel, tungsten, aluminum, nickel, titanium, metal alloy, composites, or other metals. The face insert base 1914 can be a non-metallic material such as a polymer, polymers with high specific gravity fillers or flakes, copolymer, composites or any kind of polymer. The copolymer or polymer can be a block copolymer of polyamide and polyether. The polymer is not a polyurethane or polymer with isocyanates. The ball striking face plate 1912 may be positioned onto the face insert base 1914 with the rear surface 1913 of the ball striking face plate 1912 adjacent to the front surface 1918 of the face insert base 1914.

In examples wherein the ball striking face plate 1912 and the face insert base 1914 comprises the same material, the overall face insert 1910 can have a thickness of 0.100 inches to 0.200 inches, 0.100 inches to 0.125 inches, 0.125 inches to 0.150 inches, 0.150 inches to 0.175 inches, 0.175 inches to 0.200 inches, 0.100 inches to 0.150 inches, or 0.150 inches to 0.200 inches. For example, the face insert 1910 can be 0.100 inches, 0.120 inches, 0.130 inches, 0.140 inches, 0.150 inches, 0.160 inches, 0.170 inches, 0.180 inches, 0.190 inches or 0.200 inches in thickness. In one example, the face insert 1910 can be 0.185 inches. In examples wherein the ball striking face plate 1912 and the face insert base 1914 comprise different materials, the ball striking face plate 1912 comprises a thickness and the face insert base 1914 comprises a thickness. The ball striking face can have a thickness ranging from 0.005 inches to 0.035 inches, 0.005 inches to 0.010 inches, 0.010 inches to 0.015 inches, 0.015 inches to 0.020 inches, 0.020 inches to 0.025 inches, 0.025 inches to 0.030 inches, 0.030 inches to 0.035 inches, or 0.013 inches to 0.025 inches. For example, the ball striking face plate 1912 can have a thickness of 0.005 inches, 0.010 inches, 0.015 inches, 0.020 inches, 0.025 inches, 0.030 inches, or 0.035 inches. The face insert base 1914 can have a thickness ranging from 0.095 inches to 0.200 inches, 0.095 inches to 0.115 inches, 0.115 inches to 0.135 inches, 0.135 inches to 0.155 inches, 0.155 inches to 0.175 inches, 0.175 inches to 0.200 inches, or 0.135 inches to 0.200 inches. For example, the face insert base 1914 can have a thickness of 0.095 inches, 0.105 inches, 0.115 inches, 0.125 inches, 0.135 inches, 0.145 inches, 0.155 inches, 0.165 inches, 0.175 inches, 0.185 inches, 0.195 inches, or 200 inches.

The face insert 1610 can be formed by a number of different processes. The different forming processes include: injection molding, casting, blow molding, compression molding, laser forming, film insert molding, gas assist molding, rotational molding, thermoforming, laser cutting, 3-D printing or any combination thereof. Further, the face insert can have any combination of thicknesses and forming processes described above. The ball striking face plate 1912 can be manufactured by a number of different processes, such as forging, forming, stamping, electroforming, casting, molding, machining, or a combination thereof. Similarly, the face insert base 1914 can be manufactured by a number of different processes, such as injection molding, casting, blow molding, compression molding, film insert molding, gas assist molding, rotational molding, thermoforming, laser cutting, 3-D printing or any combination thereof. Further, the ball striking face plate 1912 and the face insert base 1914 can have any combination of thicknesses and forming processes described above.

The face insert 1910 can be positioned within the recess on the front surface of the putter head by an adhesive 1922 such as tape, glue, epoxy or any type of adhesive compound. The face insert 1910 can further be positioned on the front surface of the putter head by fasteners or pins (not shown). In examples wherein the ball striking face plate 1912 comprises a different material than the face insert base 1914, the ball striking face plate 1912 can be secured onto the front surface 1918 of the face insert base 1914 by any adhesive 1916, such as epoxy, glue, tape, or any other securing compound, positioned between the rear surface 1913 of the ball striking face plate 1912 and the front surface 1918 of the face insert base 1914. For example, the ball striking face plate 1912 can be adhered onto the face insert base 1914 by very high bond (VHB) tape that is 0.010-0.015 inches thick, by a spray adhesive with a thickness of 0.003 inches, or by a brushed on adhesive.

The face insert 1910 can further comprise a coating. For example, the face insert 1910 can comprise a physical vapor deposition (PVD) or type II anodized finish, which can improve the wear performance of the face insert 1910. The PVD coating and type II anodized finish can be any material such as nickel, chrome, magnesium, zinc, zirconium, hafnium, tantalum, titanium or any other metal or material.

A. Metal Ball Striking Face Plate and Polymer Face Insert Base Coupled with VHB Tape Illustrated in FIG. 82, the ball striking face plate 1912 is made of a metallic material, forged from an aluminum sheet and has a thickness of 0.030 inches. The ball striking face plate 1912 further comprises grooves 1920 that vary, increasing from the toe portion 1970 and the heel portion 1974 toward the center portion 1972, and increasing from the top rail portion 1976 and the sole portion 1980 toward the mid portion 1978. The generally planar bottom surface portion of the grooves 1920 is where the depth of the grooves 1920 is the greatest. The generally planar bottom surface portion is located at the combination of the mid portion 1978 and center portion 1972. The face insert base 1914 is made of a block copolymer of polyamide and polyether, and has a thickness of 0.105 inches. The ball striking face plate 1912 is adhered by VHB tape to the face insert base 1914, and covers greater than 96% of the front surface 1918 of the face insert base 1914, but can cover greater than 91%, greater than 92%, greater than 93%, greater than 94%, greater than 95%, greater than 97%, greater than 98%, greater than 99%, or 100% of the front surface 1918 of the face insert base 1914. The face insert 1910 is coated with PVD. The combination of the metallic material of the ball striking face plate 1912 and the block copolymer of polyamide and polyether allows for a softer sound and feel during impact. Further, the varying depth of the grooves 1920, wherein the depth of the grooves 1920 are deepest at the mid portion 1978 and the center portion 1872 allow for more forgiving hits.

B. Metal Ball Striking Face Plate and Polymer Face Insert Base Coupled with Epoxy In other examples, the ball striking face plate 1912 is made of a metallic material, formed or stamped from an aluminum sheet and can have a thickness of 0.030 inches. The ball striking face plate 1912 further comprises grooves 1920 that vary, increasing from the toe portion 1970 and the heel portion 1974 toward the center portion 1972, and increasing from the top rail portion 1976 and the sole portion 1980 toward the mid portion 1978. The generally planar bottom surface portion of the grooves 1920 is where the depth of the grooves 1920 is the greatest. The generally planar bottom surface portion is located at the combination of the mid portion 1978 and center portion 1972. The face insert base 1914 is made of block copolymer of polyamide and polyether, and has a thickness of 0.113 inches. The ball striking face plate 1912 is adhered to the face insert base 1914 by an epoxy positioned between the rear surface 1913 of the ball striking face plate 1912 and the front surface 1918 of the face insert base 1914. The ball striking face plate covers greater than 92% of the front surface 1918 of the face insert base 1914, but can cover greater than 91%, greater than 93%, greater than 94%, greater than 95%, greater than 96%, greater than 97%, greater than 98%, greater than 99%, or 100% of the front surface 1918 of the face insert base 1914. The face insert 1910 is coated with type II anodized finish. The face insert 1910 is coated with PVD. The combination of the metallic material of the ball striking face plate 1912 and the block copolymer of polyamide and polyether allows for a softer sound and feel during impact. Further, the varying depth of the grooves 1920, wherein the depth of the grooves 1920 are deepest at the mid portion 1978 and the center portion 1872 allow for more forgiving hits.

C. Metal Ball Striking Face Plate and Polymer Face Insert Base Coupled with Adhesives In other examples, the ball striking face plate 1912 is made of a metallic material, electroformed from a nickel sheet, and has a thickness of 0.030 inches. The ball striking face plate 1912 further comprises grooves 1920 that vary, increasing from the toe portion 1970 and the heel portion 1974 toward the center portion 1972, and increasing from the top rail portion 1976 and the sole portion 1980 toward the mid portion 1978. The generally planar bottom surface portion of the grooves 1920 is where the depth of the grooves 1920 is the greatest. The generally planar bottom surface portion is located at the combination of the mid portion 1978 and center portion 1972. The face insert base 1914 is made of a block copolymer of polyamide and polyether, and has a thickness of 0.140 inches. The ball striking face plate 1912 is adhered to the face insert base 1914 by an adhesive positioned between the rear surface 1913 of the ball striking face plate 1912 and the front surface 1918 of the face insert base 1914. The ball striking face plate 1912 covers 100% of the front surface 1918 of the face insert base 1914, but can cover greater than 91%, greater than 92%, greater than 93%, greater than 94%, greater than 95%, greater than 96%, greater than 97%, greater than 98%, or greater than 99% of the front surface 1918 of the face insert base 1914. The face insert 1910 is coated with type II anodized finish. The face insert 1910 is coated with PVD. The combination of the metallic material of the ball striking face plate 1912 and the block copolymer of polyamide and polyether allows for a softer sound and feel during impact. Further, the varying depth of the grooves 1920, wherein the depth of the grooves 1920 are deepest at the mid portion 1978 and the center portion 1872 allow for more forgiving hits.

II. Polymer Ball Striking Face Plate and Polymer Face Insert Base

Figure 91:
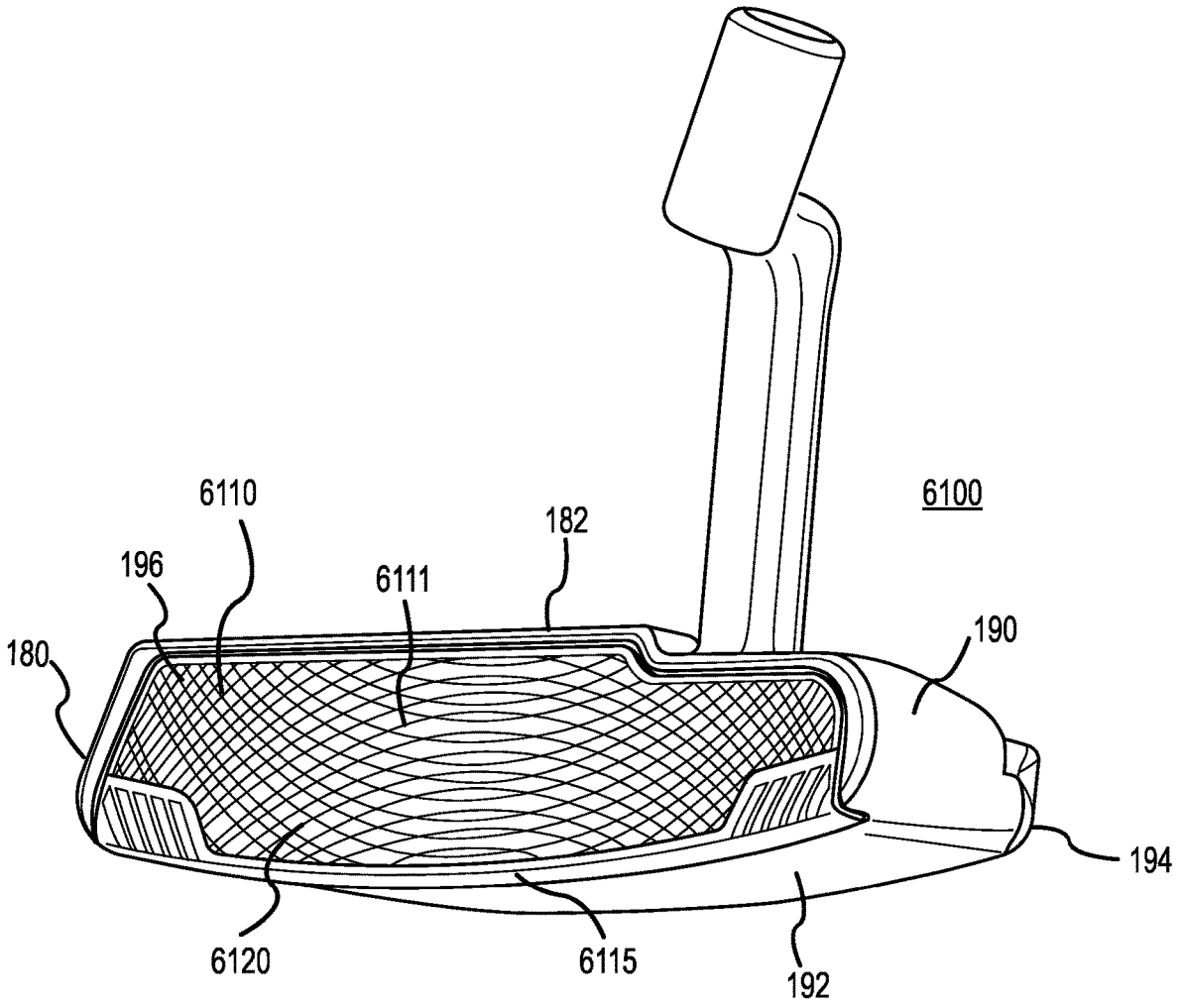
FIG. 91 shows a perspective view of a putter according to another embodiment.
Figure 92:
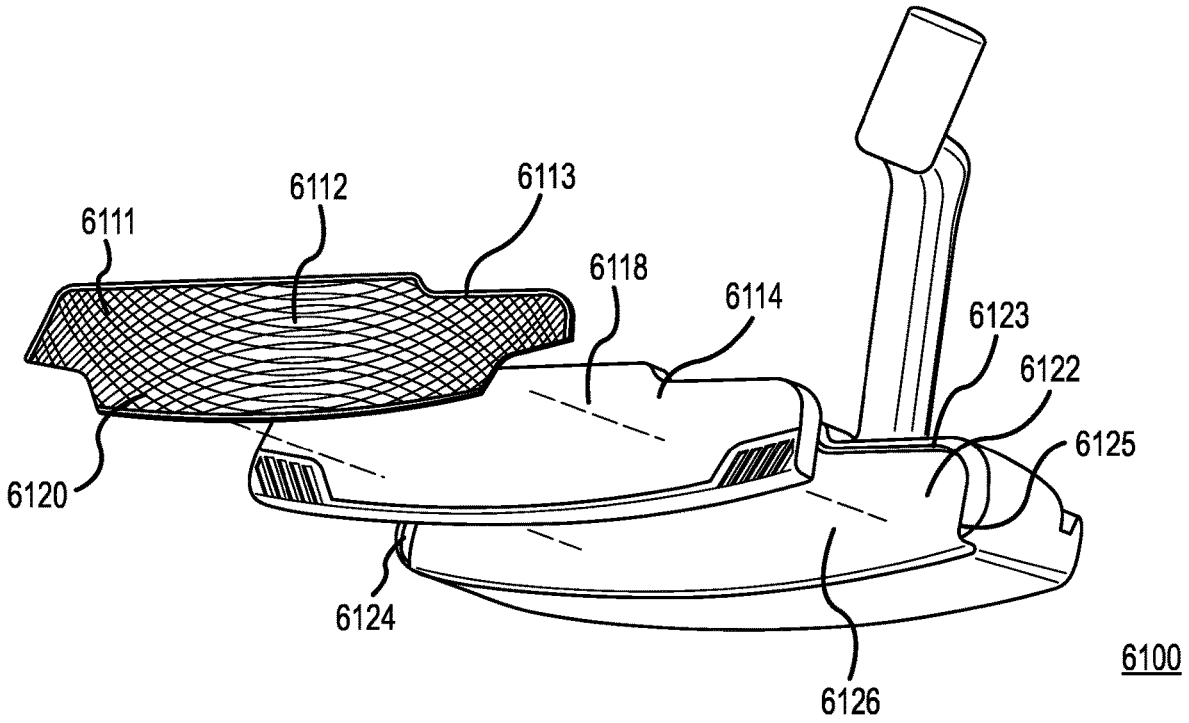
FIG. 92 shows an exploded view of the putter of FIG. 91.

In another embodiment, as illustrated in FIGS. 91 and 92, the putter golf club head 6100 comprises the front end 196, the rear end 194, the toe end 184, the heel end 190, the top rail 182, the sole 192, and a leading edge 6115. The exterior surface of the putter golf club head 6100 forms a recess 6122. More specifically, a top wall 6123, a toe wall 6124, a heel wall 6125 opposite the toe wall 6124, and a back wall 6126 of the putter golf club 6100 all form the recess 6122. The recess 6122 of the putter golf club head 6100 can extend rearward from the front end 196 towards the rear end 194.

Figure 83:
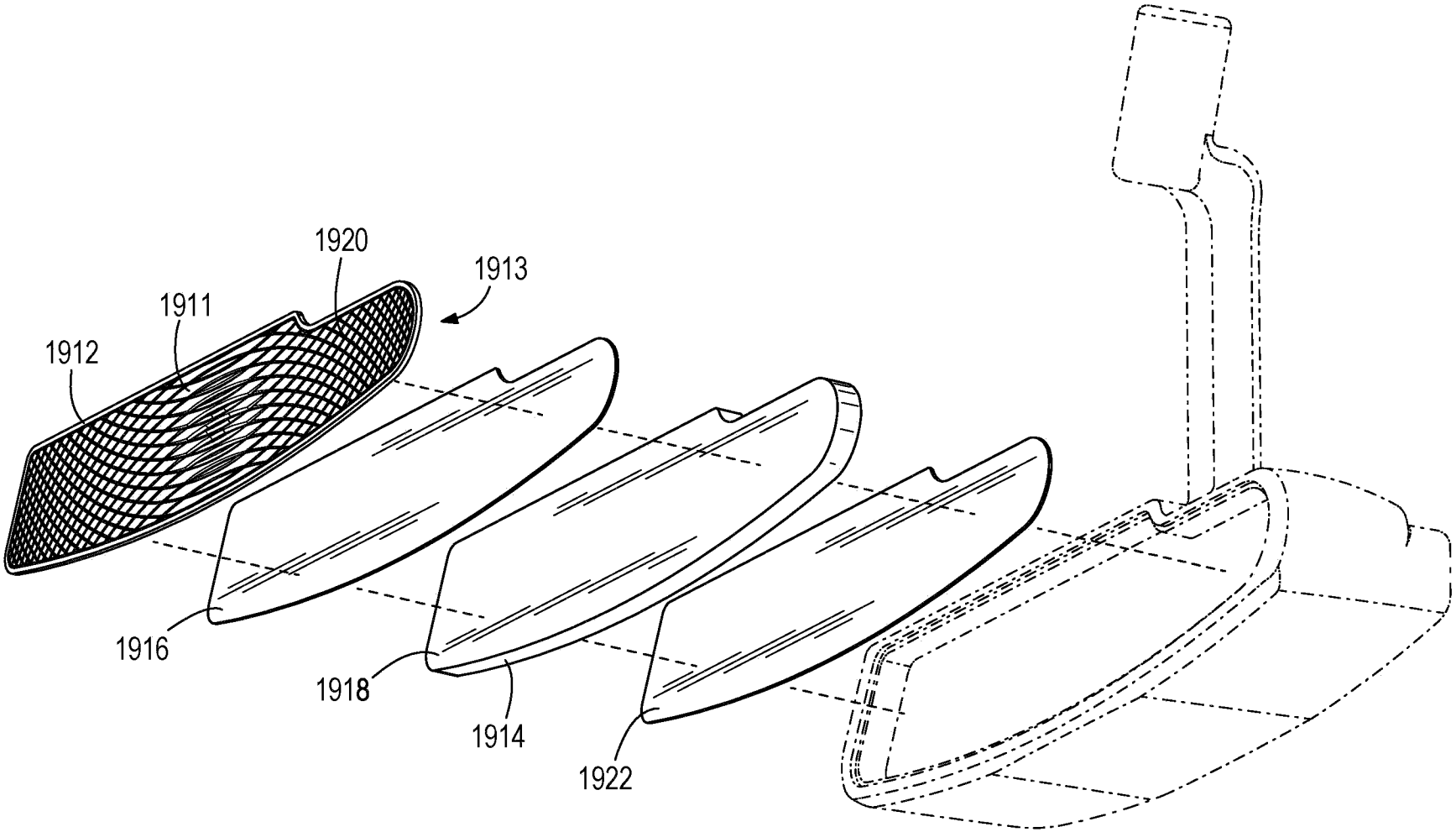
FIG. 83 shows an exploded view of the face insert of FIG. 82.

The putter golf club head 6100 can comprise the face insert 6110. The face insert 6110 forms a portion of the front end 196. In this embodiment, the face insert 6110 of the putter golf club head 6100 can comprise a ball striking face plate 6112 and a face insert base 6114. The ball striking face plate 6112 can comprise a front striking surface 6111 and a rear surface 6113 opposite the front striking surface 6111. The front striking surface 6111 of the ball striking face plate 6112 can comprise grooves 6120 similar to the grooves described above. The rear surface 6113 of the ball striking face plate 6112 can be similar to the rear surface 1913 of the ball striking face plate 1912 as illustrated in FIG. 83. The face insert base 6114 can comprise a front surface 6118. The front surface 6118 of the face insert base 6114 can be similar to the front surface 1918 of the face insert base 1914 as illustrated in FIG. 83. The rear surface 6113 of the ball striking face plate 6112 is adjacent a portion of the front surface 6118 of the face insert base 6114.

When the rear surface 6113 of the ball striking face plate 6112 is positioned onto the front surface 6118 of the face insert base 6114, the ball striking face plate 6112 covers greater than 70%, greater than 75%, greater than 80%, greater than 85%, greater than 90%, greater than 91%, greater than 92%, greater than 93%, greater than 94%, greater than 95%, greater than 96%, greater than 97%, greater than 98%, greater than 99%, or 100% of the front surface 6118 of the face insert base 6114. The front striking surface 6111 of the ball striking face plate 6112 can comprise grooves 6120 similar to the grooves described above.

In some embodiments, the ball striking face plate 6112 and the face insert base 6114 can comprise the same size and shape, where all the edges of the ball striking face plate 6112 and the face insert base 6114 are flush with one another. In some embodiments, the face insert base 6114 can form a continuous border or perimeter around the ball striking face plate 6112. In some embodiments, the face insert base 6114 can wrap around the ball striking plate 6112. In other embodiments, the face insert base 6114 can wrap around the ball striking plate 6112 at the sole 192, the toe end 180, the top rail 182, the heel end 190, or any combination thereof. In some embodiments, the face insert base 6114 can form the leading edge 6115. In other embodiments, the face insert base 6114 and the ball striking face plate 6112 can form the leading edge 6115. In other embodiments, the face insert base 6114 can form a partial border or perimeter around the ball striking face plate 6112. In these embodiments, the face insert base 6114 can form a partial border around the ball striking face plate 6112 at the toe end 180, the top rail 182, the heel end 190, the sole 192, the leading edge 6115, or any combination thereof. In one embodiment, the face insert base 6114 can border the ball striking face plate 6112 at the leading edge 6115.

When the recess 6112 of the putter golf club head 6100 receives the face insert 6110, the rear surface 6113 of the ball striking face plate 6112 abuts the front surface 6118 of the face insert base 6114, and the face insert base 6114 abuts the back wall 6126 of the recess 6122. In many embodiments, the ball striking face plate 6112 and the face insert base 6114 can be coupled together by an adhesive, similar to the ball striking face plate 1912, the face insert base 1914, and adhesive 1916 as illustrated in FIG. 83. In many embodiments, the face insert base 6114 can be coupled to the recess by an adhesive, similar to the face insert base 1914 and the adhesive 6122 as illustrated in FIG. 83. The type of adhesive used to couple the ball striking face plate 6112 and the face insert base 6114 to the putter golf club head 6000 can be similar to the adhesives described above.

Figure 93:
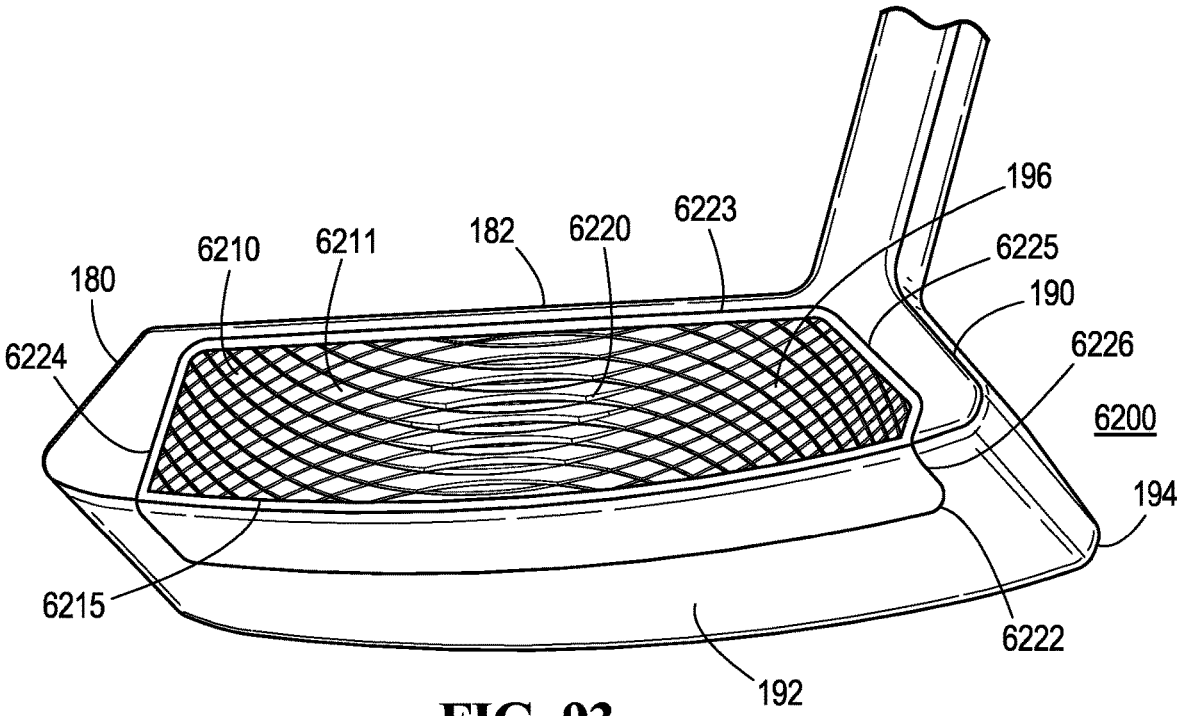
FIG. 93 shows a perspective view of a putter according to another embodiment.
Figure 94:
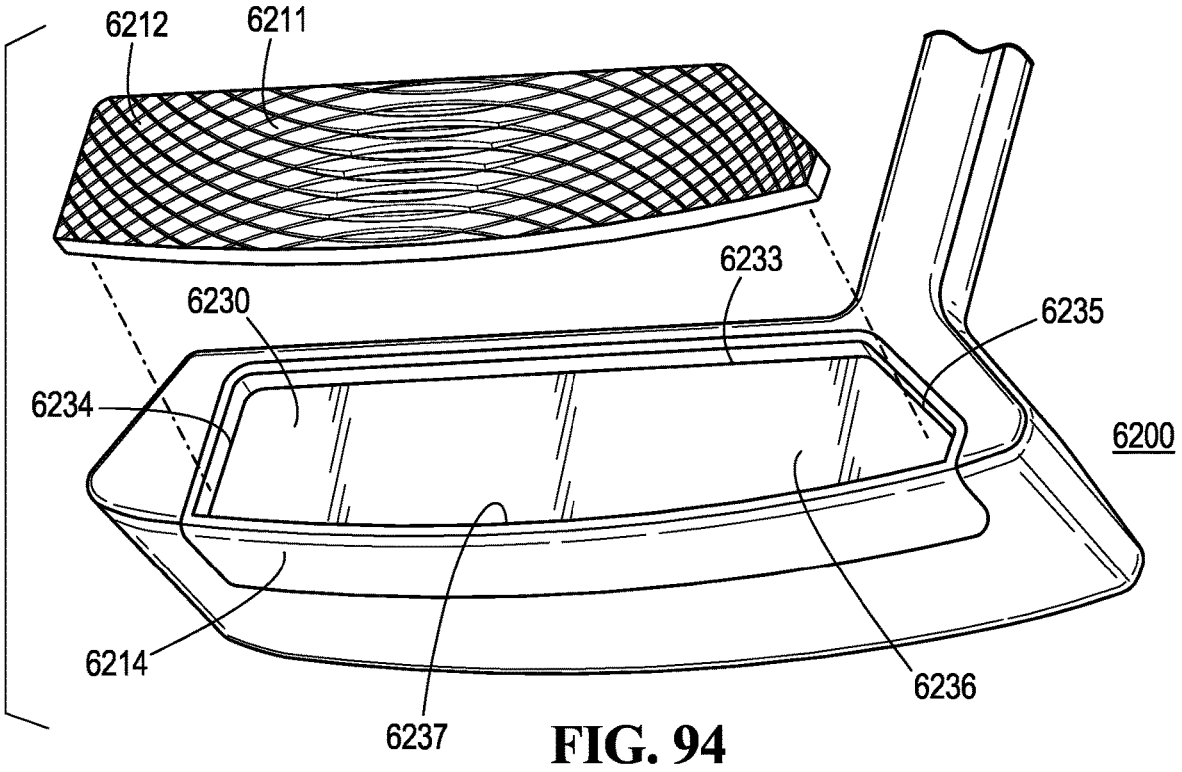
FIG. 94 shows an exploded view of the putter of FIG. 93.

III. Polymer Ball Striking Face Plate and Polymer Face Insert Base with a Recess In another embodiment, as illustrated in FIGS. 93 and 94, the putter golf club head 6200 comprises the front end 196, the rear end 194, the toe end 184, the heel end 190, the top rail 182, the sole 192, and a leading edge 6215. The exterior surface of the putter golf club head 6200 forms a recess 6222. More specifically, a top wall 6223, a toe wall 6228, a heel wall 6225, and a back wall 6226 of the putter golf club head 6200 all form the recess 6222. The recess 6222 of the putter golf club head 6200 can be extend rearward from the front end 196 towards the rear end 194.

The putter golf club head 6200 can comprise the face insert 6210. The face insert 6210 can form a portion of the front end 196. In this embodiment, the face insert 6210 of the putter golf club head 6200 can comprise a ball striking face plate 6212 and a face insert base 6114. The ball striking face plate 6312 can comprise a front striking surface 6211 and a rear surface 6213 opposite the front striking surface 6211.

The exterior surface of the face insert base 6214 forms a face insert base recess 6230. More specifically, a face insert base top wall 6233, a face insert base toe wall 6234, a face insert base heel wall 6235, a face insert base back wall 6236, and a face insert base bottom wall 6237 of the face insert base 6214 all form the face insert base recess 6230.

The face insert base recess 6230 can be configured to receive the ball striking face plate 6212. The rear surface 6213 of the ball striking face plate 6312 is adjacent to the face insert base recess 6230. Specifically, the face insert base top wall 6233, the face insert base toe wall 6234, the face insert base heel wall 6235, the face insert base back wall 6236, and the face insert base bottom wall 6237 of the face insert base 6214 are all configured to receive the ball striking face plate 6212. In this embodiment, the face insert base 6214 can form a border or perimeter around the ball striking face plate 6312. Further, the ball striking face plate 6312 can be shaped complimentary to the recess 6220 of the face insert base 6214 thereby having the front striking surface 6211 flush with the face insert base 6214. The front striking surface 6211 of the ball striking face plate 6212 can comprise grooves 6220 similar to the grooves described above.

When the recess 6222 receives the face insert 6210, the rear surface 6213 of the ball striking face plate 6212 is received within the face insert base recess 6230, and the face insert base 6214 abuts the back wall 6226 of the recess 6222. In many embodiments, the ball striking face plate 6212 and the face insert base 6214 can be coupled together by an adhesive, similar to the adhesive described above, or a press-fit. In many embodiments, the face insert base 6214 can be coupled to the recess by an adhesive as described above. In some embodiments, the face insert base recess 6230 can secure the ball striking face plate 6212 with a pinching force or press-fit. More specifically, the face insert base top wall 6233, the face insert base toe wall 6234, the face insert base heel wall 6235, the face insert base back wall 6236, and the face insert bottom wall 6237 of the face insert base 6214 can secure the ball striking face plate 6212 with a pinching force or press-fit.

IV. Ball Striking Face Plate and Face Insert Base Coupling Structures

Figure 95:
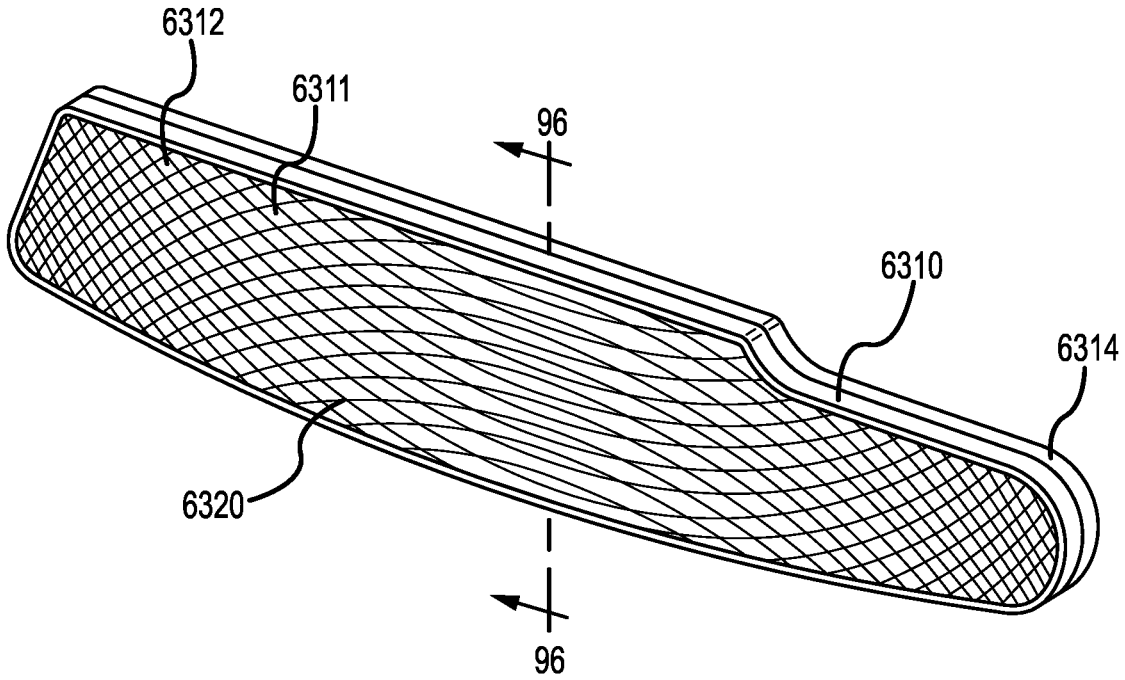
FIG. 95 shows a face insert of a putter according to another embodiment.
Figure 96:
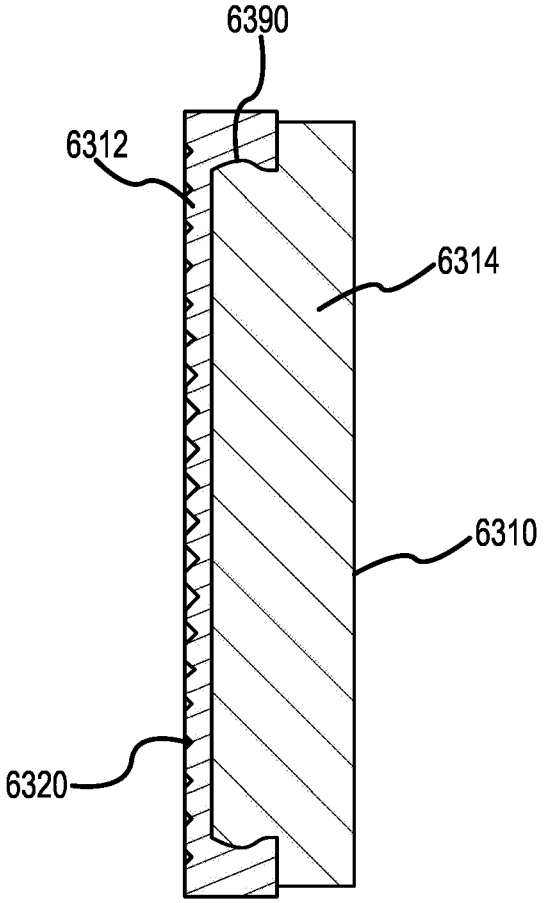
FIG. 96 shows a cross-sectional diagram of the face insert of FIG. 95.

In another embodiment, as illustrated in FIGS. 95 and 96, the putter golf club head can comprise the face insert 6310. In this embodiment, the face insert 6310 of the putter golf club head 6300 (not shown) can comprise a ball striking face plate 6312 and a face insert base 6314. The ball striking face plate 6312 can comprise a front striking surface 6312 and a rear surface 6313 the front striking surface 6312. The face insert base 6314 can comprise a front surface (not shown). The face insert 6310 can further comprise a coupling structure 6390 configured to couple the ball striking face plate 6312 and the face insert base 6314 together without the need for adhesives, tape, or any other non-mechanical interlock coupling. The coupling structure 6390 can comprise an undercut, a plurality of hooks, a plurality of tabs, a plurality of slots, a plurality of tabs and slots, or any other suitable mechanical interlocking structure. In an exemplary embodiment, the coupling structure 6390 of the face insert 6310 can comprise an undercut. In many embodiments, the ball striking face plate 6312 can comprise the undercut, where the ball striking face plate 6312 receives the complementary geometry of the face insert base 6314. In some embodiments, the face insert base 6314 can comprise the undercut (not shown), where the face insert base 6314 receives the complementary geometry of the ball striking face plate 6312. The front striking surface 6311 of the ball striking face plate 6312 can comprise grooves 6320 similar to the grooves described above.

Figure 97:
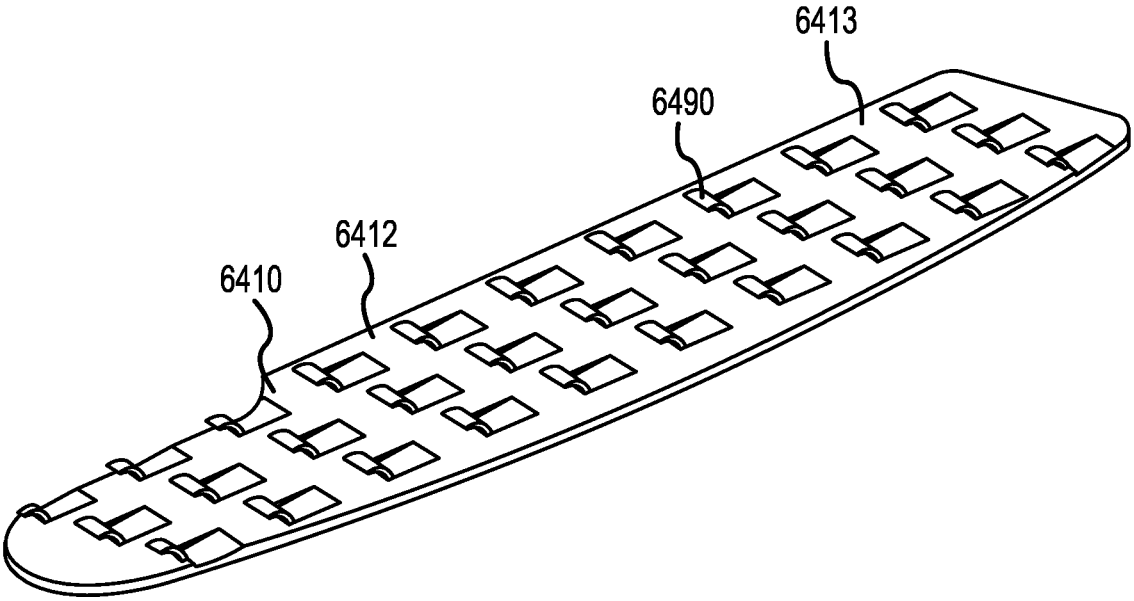
FIG. 97 shows a ball striking face plate of the face insert of FIG. 95.

Further, in another embodiment, as illustrated in FIG. 97, the coupling structure 6390 can comprise a plurality of hooks. In many embodiments, the plurality of hooks of the coupling structure 6390 can be positioned on the rear surface 6313 of the ball striking face plate 6312, where the face insert base 6310 can comprise complementary slots or recesses configured to receive the plurality of hooks of the ball striking face plate 6312. In some embodiments, the plurality of hooks of the coupling structure 6390 can be positioned on the front surface of the face insert base 6314, where the ball striking face plate 6312 can comprise complementary slots or recesses configured to receive the plurality of hooks of the face insert base 6314.

The face insert 1910, 6100, 6200, and 6300 can provide the advantage of a more softer and unique sound/feel during golf ball impacts. The softer and unique sound/feel during golf ball impacts corresponds to the hardness of the face insert. In many embodiments, the ball striking plate can comprise the PEBAX 4033 (Arkema, Paris France) having a lower hardness, and the face insert base can comprise the PEBAX 6333 (Arkema, Paris France) having a higher hardness as described above. The combination of the lower hardness of the ball striking face plate and the higher hardness of the face insert base provides the softer sound/feel during golf ball impacts. This softer feel is advantageous over metal face inserts because the softer feel and sound can be pleasing to a player and prevent distractions that metal face inserts can provoke with louder impact sounds. This softer and unique sound/feel during golf ball impacts can help a player's mental focus thereby improving the player's score.

Polymeric Material and Frame

In another embodiment of a face insert comprising a two component system, the putter golf club head can comprise a face insert comprising a polymeric material and a frame. The putter golf club head comprising the face insert having the polymeric material and the frame comprises the front end 196, the rear end 194, the toe end 184, the heel end 190, the top rail 182, the sole 192, and a leading edge. The exterior surface of the putter golf club head forms a recess (not shown). More specifically, a top wall (not shown), a toe wall (not shown), a heel wall (not shown) opposite the toe wall, and a back wall (not shown) of the putter golf club head all form the recess. The recess of the putter golf club head can be extend rearward from the front end 196 towards the rear end 194.

The polymeric material of the face insert can form a portion of the front end 196, the toe end 180, the top rail 182, the heel end 190, the sole 192, the leading edge, or any combination thereof. The frame of the face insert can form a portion of the front end 196, the toe end 180, the top rail 182, the heel end 190, the sole 192, a leading edge, or any combination thereof of the putter golf club head. The front end 196 of the putter golf club head comprises a front striking surface, where the front striking surface comprises grooves similar to the grooves described above.

In many embodiments, the frame can form a smaller portion of the face insert than the polymeric material. In some embodiments, the frame can form a greater portion of the face insert than the polymeric material. In some embodiments, the frame can form a larger portion of the front end 196 than the polymeric material of the face insert. In some embodiments, the frame can form a larger portion of the leading edge than the polymeric material of the face insert. In some embodiments, the frame can form a larger portion of the sole 192 than the polymeric material. In some embodiments, the polymeric material can form a larger portion of the front end 196 than the frame of the face insert. In some embodiments, the polymeric material can form a larger portion of the leading edge than the frame of the face insert. In some embodiments, the polymeric material can form a larger portion of the sole 192 than the frame of the face insert.

In many embodiments, the frame of the face insert forms a continuous border or perimeter around the polymeric material. In some embodiments, the frame of the face insert forms a partial border or perimeter around the polymeric material. In these embodiments, the frame of the face insert can form a partial border or perimeter at the toe end 180, the top rail 182, the heel end 190, the sole 192, the leading edge, or any combination thereof. The polymeric material of the face insert can comprise the polymer type materials described above such as PEBAX, polyethylene, polypropylene, polytetrafluroethylene, polyisobutylene, polyvinlycloride, or any other polymer type material described above. In some embodiments, the frame of the face insert can comprise a metal such as steel, aluminum, titanium, or any other metals described above. In some embodiments, the frame of the face insert can comprise a polymer type material such as PEBAX, polyethylene, polypropylene, polytetrafluroethylene, polyisobutylene, polyvinlycloride, or any other polymer type material described above.

In many embodiments, the face insert comprising the polymeric material and the frame can comprise a trapezoidal shape. In some embodiments, the face insert comprising the polymeric material and the frame can comprise a rectangular shape, a triangular shape, a pentagonal shape, a polygonal shape, or any other suitable shape. In many embodiments, the polymeric material of the face insert can comprise a similar shape as the face insert such as a trapezoidal shape, a rectangular shape, a triangular shape, a pentagonal shape, a polygonal shape, or any other suitable shape. Further, in many embodiments, the frame of the face insert can comprise a similar shape as the face insert such as a trapezoidal shape, a rectangular shape, a triangular shape, a pentagonal shape, a polygonal shape, or any other suitable shape. The shape of the frame and/or polymeric material of the face insert can be positioned on the front end 196, the toe end 180, the top rail 182, the heel end 190, or the sole 192 of the putter golf club head.

Figure 98:
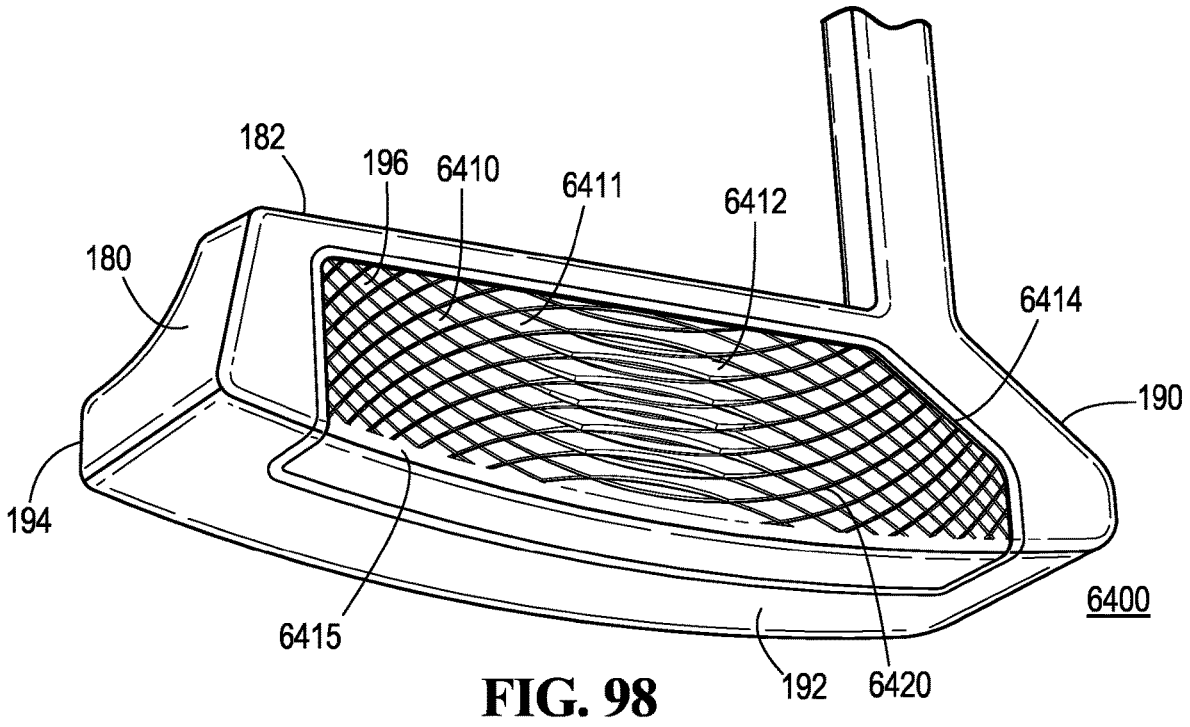
FIG. 98 shows a perspective view of a putter according to another embodiment.

In one embodiment, as illustrated in FIG. 98, the putter golf club head can comprise the face insert 6410. The face insert 6410 of the putter golf club head 6400 can comprise the polymeric material 6412 and the frame 6414. The putter golf club head 6400 can comprise a leading edge 6415 between the front end 196 and the sole 192. The front end 196 of the putter golf club head 6400 can comprise a front striking surface 6411. The front striking surface 6411 of the front end 196 can comprise grooves 6420 similar to the grooves described above. In this embodiment, the frame 6414 can form a border or perimeter around the polymeric material 6412. In this embodiment, the frame 6414 can form a trapezoidal shape, where the frame 6414 follows the contour of the putter golf club head 6400. More specifically, the frame 6414 can extend vertically across the front end 196 from the sole 192 to the top rail 182 at the toe end 180, extend parallel with the top rail 182 from the toe end 180 to the heel end 190, extend at an angle from the top rail 182 to the sole 192 at the heel end 190, and extend a distance on the sole 192 towards the rear end 194. The frame 6414 can be extend rearward from the front end 196 towards the rear end 194. In many embodiments, the frame 6414 and the polymeric material 6412 can wrap around the leading edge 6415 from the front end 196 to the sole 192 of the putter golf club head 6400. Further, the polymeric material 6412 and the frame 6414 of the face insert 6410 can form a portion of the front striking surface 6411, the leading edge 6415, and the sole 192. In this embodiment, the polymeric material 6412 can form a greater portion of the face insert 6410 than the frame 6414.

Figure 99:
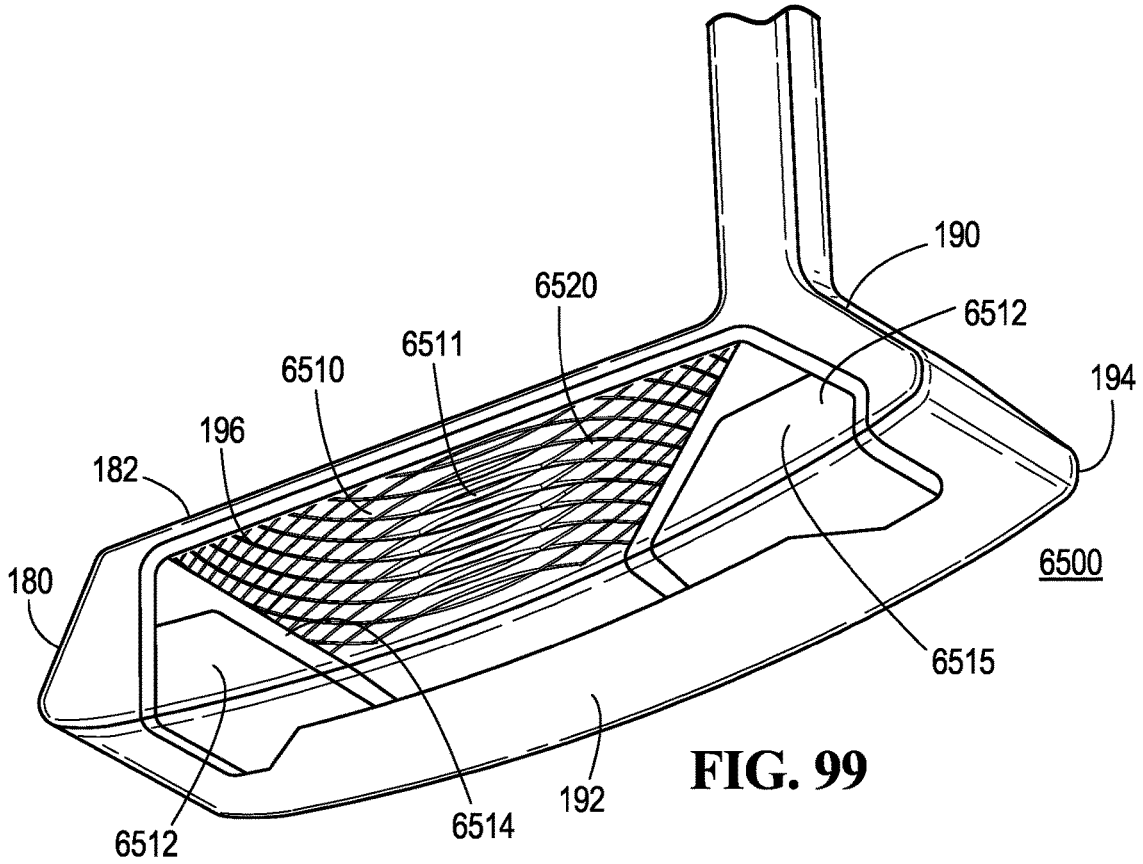
FIG. 99 shows a perspective view of a putter according to another embodiment.

In another embodiment, as illustrated in FIG. 99, the putter golf club head can comprise the face insert 6510. The face insert 6510 of the putter golf club head 6500 can comprise the polymeric material 6512 and the frame 6514. The putter golf club head 6500 can comprise a leading edge 6515 between the front end 196 and the sole 192. The front end 196 of the putter golf club head 6500 can comprise a front striking surface 6511. The front striking surface 6511 of the front end 196 can comprise grooves 6520 similar to the grooves described above. In this embodiment, the frame 6514 can separate the polymeric material 6512 into a toe end portion proximate the toe end 180 and a heel end portion proximate the heel end 190. In this embodiment, the frame 6514 can comprise a trapezoidal shape on the front end 196 and a rectangular shape on the sole 192. In this embodiment, the toe end portion and the heel end portion of the polymeric material 6512 can comprise a triangular shape on the front end 196 and a triangular shape on the sole 192. In many embodiments, the frame 6514 and the polymeric material 6512 can wrap around the leading edge 6615 from the front end 196 to the sole 192 of the putter golf club head 6500. In this embodiment, the frame 6514 can form a portion of the front striking surface 6511, the leading edge 6515, and the sole 192. In this embodiment, the frame 6514 can form a larger portion of the face insert 6510 and/or the front striking surface 6511 than the polymeric material 6512.

Figure 100:
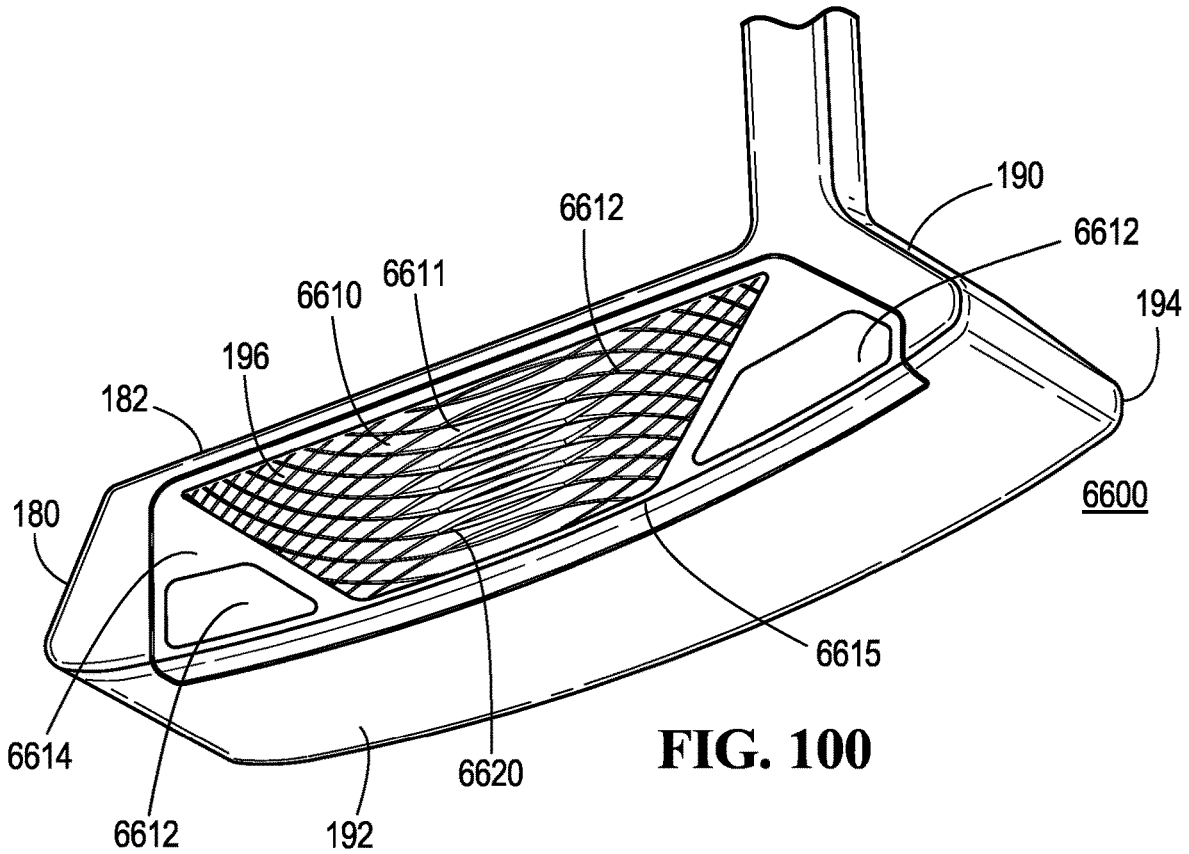
FIG. 100 shows a perspective view of a putter according to another embodiment.

In another embodiment, as illustrated in FIG. 100, the putter golf club head can comprise the face insert 6610. The face insert 6610 of the putter golf club head 6600 can comprise the polymeric material 6612 and the frame 6614. The putter golf club head 6600 can comprise a leading edge 6615 between the front end 196 and the sole 192. The front end 196 of the putter golf club head 6500 can comprise a front striking surface 6611. The front striking surface 6611 of the front end 196 can comprise grooves 6620 similar to the grooves described above. In this embodiment, the frame 6614 can form a border or perimeter around the polymeric material 6612. In this embodiment, the frame 6614 can separate the polymeric material 6612 into a toe end portion proximate the toe end 180, a heel end portion proximate the heel end 190, and a center portion proximate a center of the front striking surface 6611. The frame 6614 can extend around a perimeter of the front striking surface 6611. Further, portions of the frame 6614 can extend inwardly from the perimeter of the front striking surface 6611 towards a center of the front striking surface 6611. The portions of the frame 6614 that extend inwardly can separate the polymeric material 6612 into the toe end portion, the heel end portion, and the center portion. The toe end portion, the heel portion, and center portion of the polymeric material 6612 can comprise a trapezoidal shape. In this embodiment, the frame 6614 can from a portion of the front striking surface 6611, the leading edge 6615, and the sole 192. In this embodiment, the polymeric material 6612 can form a larger portion of the face insert 6610 and/or the front striking surface 6611 than the frame 6614.

Figure 101:
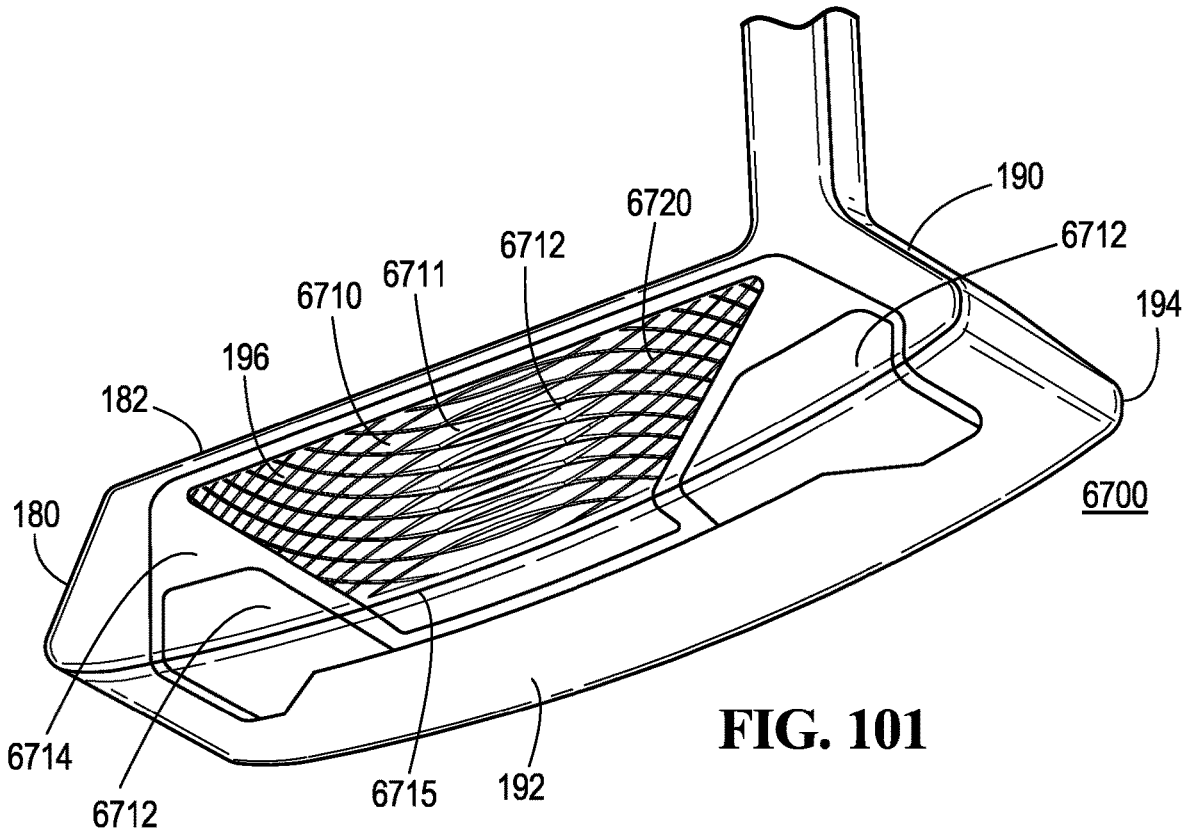
FIG. 101 shows a perspective view of a putter according to another embodiment.

In another embodiment, as illustrated in FIG. 101, the putter golf club head can comprise the face insert 6710. The face insert 6710 of the putter golf club head 6700 can comprise the polymeric material 6712 and the frame 6714. The putter golf club head 6700 can comprise a leading edge 6715 between the front end 196 and the sole 192. The front end 196 of the putter golf club head 6700 can comprise a front striking surface 6711. The front striking surface 6711 of the front end 196 can comprise grooves 6720 similar to the grooves described above. In this embodiment, the frame 6714 can separate the polymeric material 6712 into a toe end portion proximate the toe end 180, the heel end portion proximate the heel end 190, and a center portion proximate a center of the front striking surface 6711. Further, portions of the frame 6714 can extend inwardly from the perimeter of the front striking surface 6711 towards a center of the front striking surface 6711. The portions of the frame 6714 that extend inwardly can separate the polymeric material 6712 into the toe end portion, the heel end portion, and the center portion. The toe end portion, the heel end portion, and the center portion of the polymeric material 6712 can comprise a trapezoidal shape on the front striking surface 6711. The toe end portion and the heel portion of the polymeric material 6712 can comprise a triangular shape on the sole 192, and the center portion of the polymeric material 6712 can comprise a rectangular shape on the sole 192.

Further, the frame 6714 forms a border or perimeter around center portion of the polymeric material 6712 on the front striking surface 6711 and the sole 192. The frame 6714 forms a partial border or perimeter around the toe end portion and the heel end portion of the polymeric material 6712 on the sole 192. In this embodiment, the polymeric material 6712 and the frame 6714 can form a portion of the front striking surface 6711, the leading edge 6715, and the sole 192. In this embodiment, the polymeric material 6712 can from a larger portion of the face insert 6710, the front striking surface 6711, and/or the sole 192.

Figure 102:
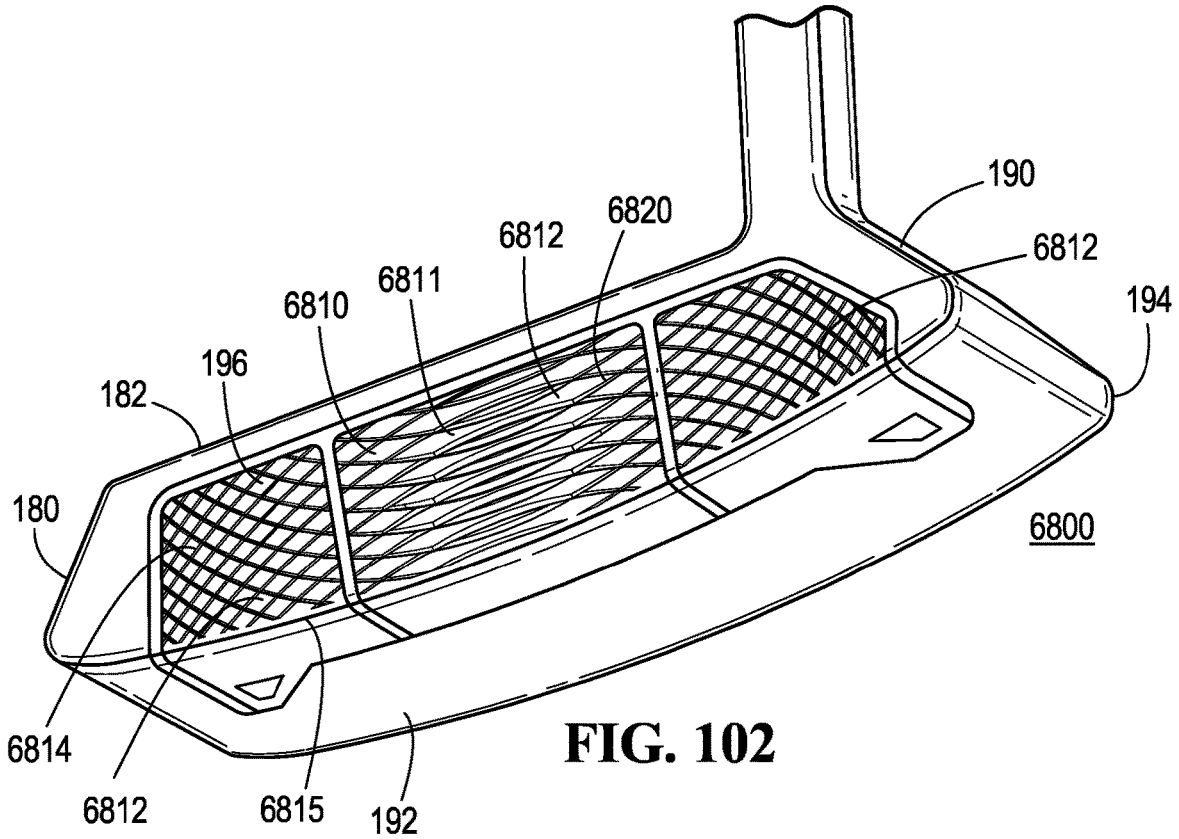
FIG. 102 shows a perspective view of a putter according to another embodiment.

In another embodiment, as illustrated in FIG. 102, the putter golf club head can comprise the face insert 6810. The face insert 6810 of the putter golf club head 6800 can comprise the polymeric material 6812 and the frame 6814. The putter golf club head 6800 can comprise the leading edge 6815 between the front end 196 and the sole 192. The front end 196 of the putter golf club head 6800 can comprise a front striking surface 6811. The front striking surface 6811 of the front end 196 can comprise grooves 6820 similar to the grooves described above. In this embodiment, the frame 6814 can separate the polymeric material 6812 into rectangular shapes and triangular shapes along the front striking surface 6811 and the sole 192. In this embodiment, the frame 6814 can form a border or perimeter around the polymeric material 6812 on the front striking surface 6811. The frame 6814 can form a partial border or perimeter around the polymeric material 6812 on the sole 192 at the toe end 180 and the heel end 190.

Further, the frame 6814 can follow the perimeter contour of the front striking surface 6811. The frame 6814 can further have two vertical portions extending from the top rail 182 towards the sole 192. The two vertical portions of the frame 6814 can separate the polymeric material 6812 into a toe end portion proximate the toe end 180, a heel end portion proximate the heel end 190, and a center portion proximate the center of the front striking surface 6811. The toe end portion, the heel portion, and the center portion of the polymeric material 6812 can have a rectangular shape at the front striking surface 6811. The toe end portion and the heel end portion of the polymeric material 6812 can have a triangular shape at the sole 192, and the center portion of the polymeric material 6812 can have a rectangular shape at the sole 192. In many embodiments, the frame 6814 and the polymeric material 6812 can wrap around the leading edge 6815 from the front end 196 to the sole 192. In this embodiment, the polymeric material 6812 and the frame 6814 can form a portion of the front striking surface 6811, the leading edge 6815, and the sole 192. In this embodiment, the polymeric material 6812 can form a larger portion of the face insert 6810, the front striking surface 6811, and/or the sole 192.

Figure 103:
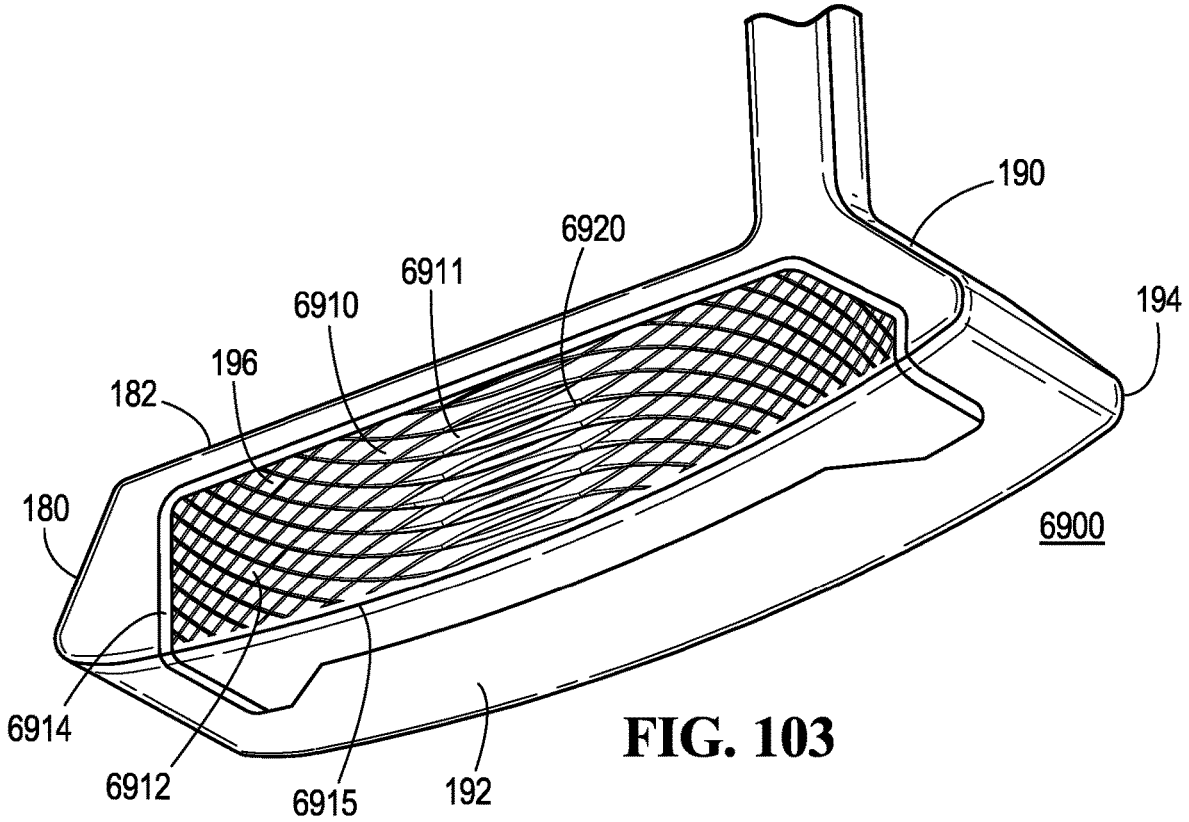
FIG. 103 shows a perspective view of a putter according to another embodiment.

In another embodiment, as illustrated in FIG. 103, the putter golf club head can comprise the face insert 6910. The face insert 6910 of the putter golf club head 6900 can comprise the polymeric material 6912 and the frame 6914. The putter golf club head 6900 can comprise the leading edge 6915 between the front end 196 and the sole 192. The front end 196 of the putter golf club head 6900 can comprise a front striking surface 6911. The front striking surface 6911 of the front end 196 can comprise grooves 6920 similar to the grooves described above. In this embodiment, the frame 6914 can form a border or perimeter around the polymeric material 6912 on the front striking surface 6911. In this embodiment, the frame 6914 can form a partial border or perimeter around the polymeric material 6912 on the sole 192. More specifically, the frame 6914 forms a partial border or perimeter around the polymeric material 6912 at the toe end 180 and the heel end 190 of the sole 192.

Further, the polymeric material 6912 can comprise a trapezoidal shape on the front striking surface 6911, a triangular shape at the toe end 180 and the heel end 190 of the sole 192, and a rectangular shape at the center of the sole 192 near the leading edge 6915. In many embodiments, the frame 6914 and the polymeric material 6912 can wrap around the leading edge 6915 from the front end 196 to the sole 192. In this embodiment, the polymeric material 6912 and the frame 6914 can form a portion of the front striking surface 6911, and the sole 192. In this embodiment, the polymeric material forms a larger portion of the face insert 6910, the front striking surface 6911, the leading edge 6915, and/or the sole 192.

The recess of the putter golf club head 6400, 6500, 6600, 6700, 6800, and 6900 is configured to receive the face insert 6410, 6510, 6610, 6710, 6810, and 6910 respectively. In many embodiments, the polymeric material and the frame of the face insert can be coupled to the recess together. In some embodiments, the polymeric material and the frame of the face insert can be coupled to the recess separately. In many embodiments, the face insert comprising the polymeric material and the frame can be coupled to the recess with an adhesive described above. In some embodiments, the frame of the face insert can secure the polymeric material with a pinching force or press-fit.

The face inserts 6410, 6510, 6610, 6710, 6810, and 6910 provide the advantage of improved sound, feel, and visuals during golf ball impacts. The polymeric material and the frame of the face insert can provide the advantage of a softer sound/feel during golf ball impacts. The softer sound/feel corresponds to the hardness of the face insert. In many embodiments, the polymeric material can comprise the PEBAX and the frame can comprise a metal described above. In some embodiments, the polymeric material can comprise the PEBAX and the frame can comprise the PEBAX described above. The combination of the PEBAX and the metal, or PEBAX and PEBAX of the polymeric material and the frame provides the softer feel/sound during golf ball impacts. This softer feel is advantageous over metal only face inserts because the softer feel and sound can be pleasing to a player and prevent distractions that the metal only face insert can provoke with louder impact sounds. Further, the frame of the face insert can act as a visual aid to the player. The frame of the face insert can help the player position the golf ball at the center of the front striking surface to optimize shot trajectory. In other scenarios, the frame of the face insert can help the player position the golf ball at the toe end or the heel end of the front striking surface to optimize shot trajectory.

Plurality of Openings

In another embodiment, the putter golf club head can comprise a face insert comprising a plurality of openings. The plurality of openings of the face insert can comprise apertures, fissures, grooves, slots, or gaps. The plurality of openings of the face insert can be positioned on the front end 196, the leading edge, the rear end 194, the toe end 180, the top rail 182, the heel end 190, the sole 192, or any combination thereof.

The plurality of openings of the face insert can be positioned linearly, non-linearly, or randomly from the heel end 190 to the toe end 180 and/or the sole 192 to the top rail 182 of the putter golf club head. Further, the plurality of openings can comprise the same, a progressively increasing, a progressively decreasing, varying, or any combination thereof size between the heel end 190 and the toe end 180 and/or the sole 192 to the top rail 182.

Further, the plurality of openings can comprise a density in the number of openings. The density in the number of openings can increase, decrease, vary, or any combination thereof towards a desired end of the putter golf club head. In some embodiments, the density in the number of openings can increase, decrease, vary, or any combination thereof towards the heel end 190, the toe end 180, the sole 192, and/or the top rail 182.

In many embodiments, the plurality of openings of the face insert can comprise a circular shape, a triangular shape, a rectangular shape, a square shape, a pentagonal shape, a polygonal shape, or any other suitable shape. In many embodiments, the plurality of openings can comprise a single shape. In some embodiments, the plurality of openings can comprise one or more, two or more, or three or more shapes. In some embodiments, the plurality of openings can comprise a plurality of shapes.

Figure 104:
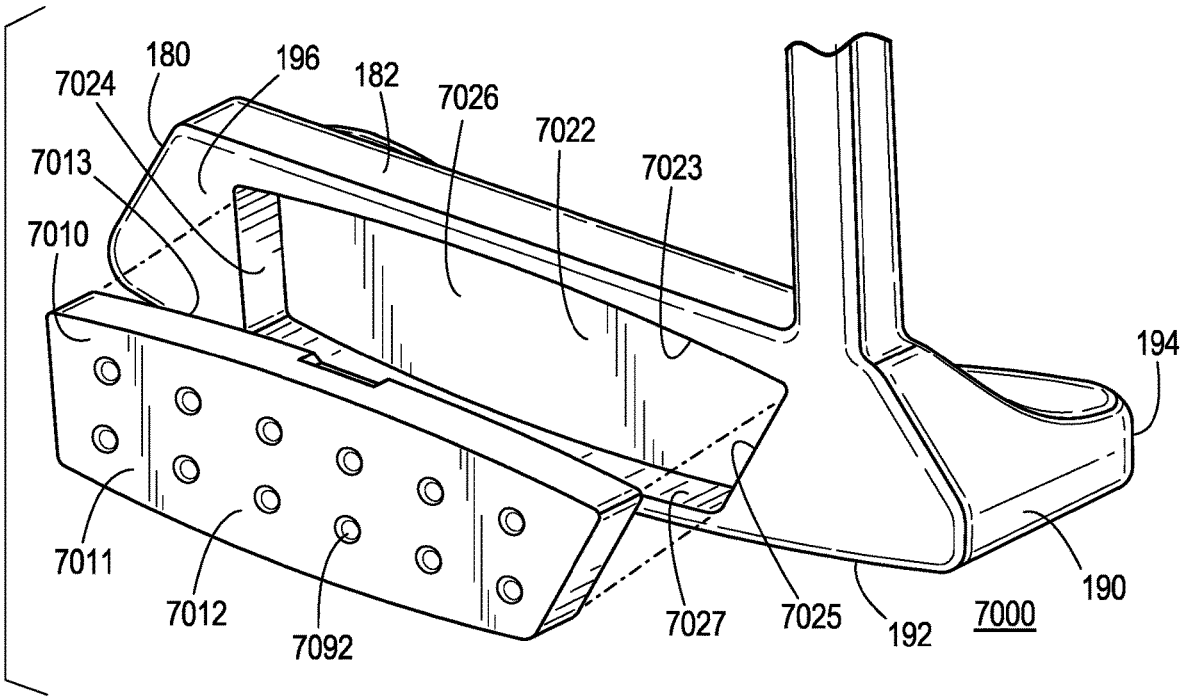
FIG. 104 shows a perspective view of a putter according to another embodiment.

In one embodiment, as illustrated in FIG. 104, the putter golf club head 7000 comprises the front end 196, the rear end 194, the toe end 184, the heel end 190, the top rail 182, and the sole 192. The exterior surface of the putter golf club head 7000 forms a recess 7022. More specifically, a top wall 7023, a toe wall 7024, a heel wall 7025 opposite the toe wall 7024, a back wall 7026, and a bottom wall 7027 of the putter golf club head 7000 all form the recess 7022. The recess 7022 of the putter golf club head 7000 can be extend rearward from the front end 196 towards the rear end 194.

The putter golf club head can comprise the face insert 7010. In this embodiment, the face insert 7010 of the putter golf club head 7000 can comprise a ball striking face plate 7012. The ball striking face plate 7012 can comprise the front striking surface 7011 and a rear surface 7013 opposite the front striking surface 7011. The front striking surface 7011 can further comprise the plurality of openings 7092. In this embodiment, the plurality of openings 7092 can be positioned linearly in rows between the toe end 180 and the heel end 190, and the sole 192 and the top rail 182. The rear surface 7013 of the ball striking face plate 7012 is adjacent to and abuts the back wall 7026 the recess 7022 of the putter golf club head 7000. In many embodiments, the face insert 7010 is coupled to the recess 7022 by an adhesive described above. The plurality of openings 7092 positioned on the front striking surface 7011 can function as grooves similar to the grooves described above.

Figure 105:
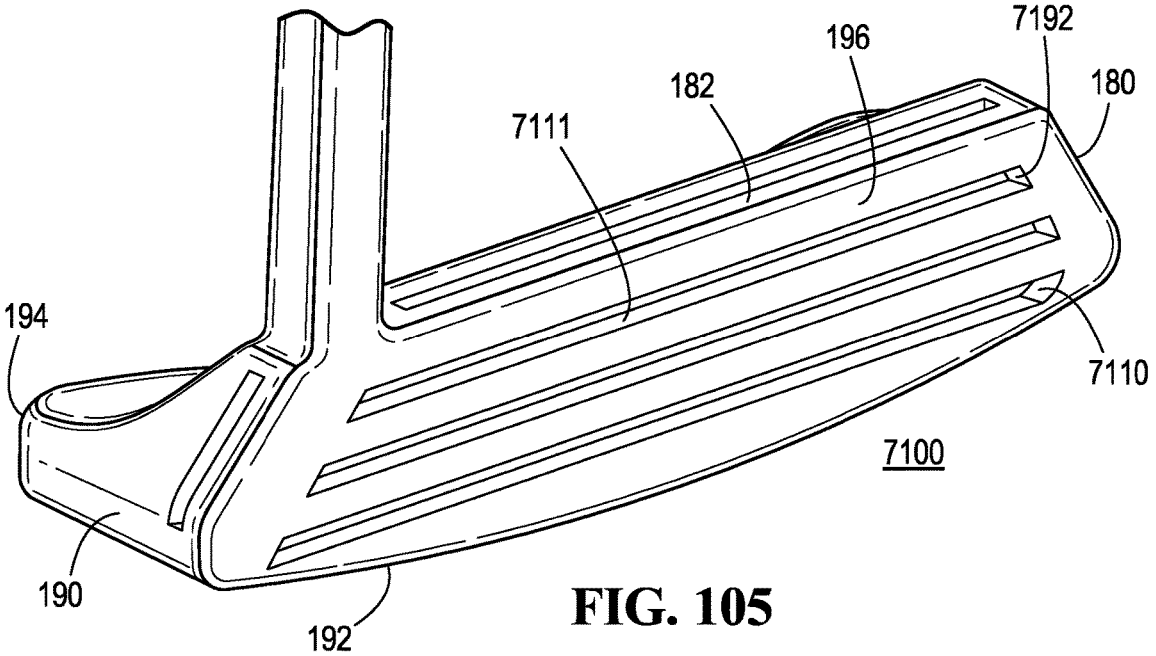
FIG. 105 shows a perspective view of a putter according to another embodiment.

In another embodiment, as illustrated in FIG. 105, the putter golf club head can comprise the face insert 7110. In this embodiment, the face insert 7110 of the putter golf club head 7100 can comprise the plurality of openings 7192. In this embodiment, the plurality of openings 7192 can be positioned on the front striking surface 7111, the heel end 190, and the top rail 182. The plurality of openings 7192 can extend the entire length of the front striking surface 7111 and the top rail 182 from the toe end 180 to the heel end 190. Further, the plurality of openings 7192 can wrap around the heel end 190 and/or the toe end 180 from the top rail 182 to the sole 192. In this embodiment, the plurality of openings 7192 positioned on the front striking surface 7111 can function as grooves similar to the grooves described above.

Figure 106:
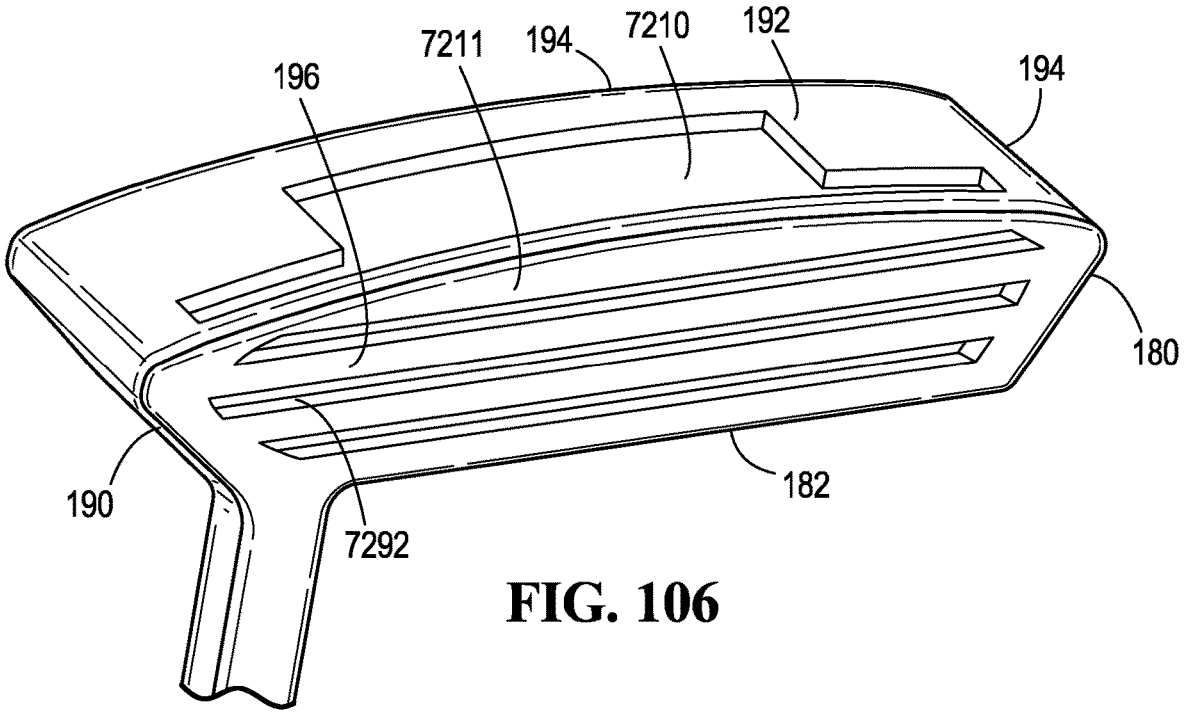
FIG. 106 shows a perspective view of a putter according to another embodiment.

In another embodiment, as illustrated in FIG. 106, the putter golf club head can comprise the face insert 7210. In this embodiment, the face insert 7210 of the putter golf club head 7200 can comprise the plurality of openings 7292. In this embodiment, the plurality of openings 7292 can be positioned on the front striking surface 7211 and the sole 192. The plurality of openings 7292 can extend the entire length of the front striking surface 7211 and the sole 192 from the toe end 180 to the heel end 190. In this embodiment, the plurality of openings 7292 positioned on the front striking surface 7211 can function as grooves similar to the grooves described above. In some embodiments, the plurality of openings 7292 can display a particular design on the sole 192 and/or front striking surface 7211 of the putter golf club head 7200.

Figure 107:
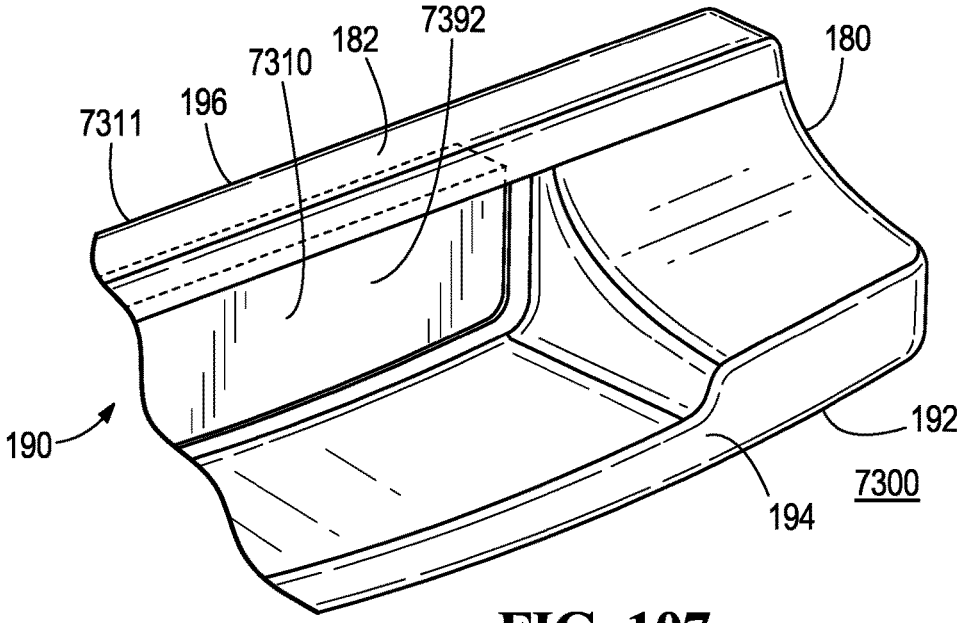
FIG. 107 shows a perspective view of a putter according to another embodiment.

In another embodiment, as illustrated in FIG. 107, the putter golf club head can comprise the face insert 7310. In this embodiment, the face insert 7310 of the putter golf club head 7300 can comprise an opening 7392 positioned on the rear end 194. In some embodiments, the putter golf club head 7300 can comprise a plurality of openings 7392 in similar positions as putter golf club head 7000, 7100, or 7200 described above. In many embodiments, the opening 7392 can display a particular design on the rear end 7325 of the putter golf club head 7310.

Referring to FIG. 52, a process 2000 of manufacturing a golf club head according to one example is shown. The process 2000 includes forming a golf club face (block 2002) defined by a toe end, a heel end, a top rail and a sole. A golf club face may be formed with a golf club head so that the golf club head and the golf club face are a one-piece continuous part. Alternatively, the golf club head and the golf club face may be formed separately. The golf club face may then be attached to the golf club face by using adhesive, tape, welding, soldering, fasteners and/or other suitable methods and devices. The golf club head and/or the golf club face may be manufactured from any material. For example, the golf club head and/or the golf club face may be made from titanium, titanium alloy, other titanium-based materials, steel, aluminum, aluminum alloy, other metals, metal alloys, plastic, wood, composite materials, or other suitable types of materials. The golf club head and/or the golf club face may be formed using various processes such as stamping (i.e., punching using a machine press or a stamping press, blanking, embossing, bending, flanging, or coining, casting), injection molding, forging, machining or a combination thereof, other processes used for manufacturing metal, plastic and/or composite parts, and/or other suitable processes. In one example, when manufacturing a putter head, the material of the putter face and/or the ball striking face may be determined so as to impart a certain ball strike and rolling characteristics to the putter face. In another example, when the ball striking face 112, 212, 312, 412, 512, 612, 712, 1012, 1312, 1412, 1812, 1500, 2212, 3212, 4212, and 5212 are separate from the putter face 110, 810, and 910 and are inserted and attached into a correspondingly shaped depression on the putter face 110, 810, and 910, the striking face 112, 212, 312, 412, 512, 612, 712, 1012, 1312, 1412, 1812, 1500, 2212, 3212, 4212, and 5212 may be constructed from a lighter material than the putter face 110, 810, and 910 to generally reduce the overall weight of the putter.

According to the process 2000, grooves are formed on the club face and/or club head between the top rail and the sole such that each groove extends between the toe end and the heel end and depths of the grooves vary in a direction extending between the top rail and the sole and in a direction extending between the heel end and the toe end (block 2004). The grooves may be formed using various processes such as casting, forging, machining, spin milled, and/or other suitable processes. The vertical cross-sectional shape of a groove may depend on the method by which a groove is manufactured. For example, the type of cutting bit when machining a groove may determine the vertical cross-sectional shape of the groove. The vertical cross sectional shape of a groove may be symmetric, such as the examples described above, or may be asymmetric (not shown). In one example, the width of a groove can be 0.032 inch, which may be the width of the cutting bit. Accordingly, when machining a groove, the shape and dimensions of the cutting bit may determine the shape and dimension of the groove.

The grooves may be manufactured by spin milling the ball strike face, or stamping or forging the grooves into the ball striking face. The grooves may also be manufactured direction on the putter head to create a ball striking face as described above directly on the putter head. A groove may be manufactured by press forming the groove on the putter head. For example, a press can deform and/or displace material on the putter head to create the groove. A groove may be manufacturing by a milling process where the rotating axis of the milling tool is normal to putter face. The rotating axis of the milling tool may be oriented at an angle other than normal to the putter face. A groove may be manufactured by overlaying one material that is cut clean through to form a through groove onto a base or solid material. A groove may be manufactured by laser and/or thermal etching or eroding of the putter face material. A groove may be manufactured by chemically eroding the putter face material using photo masks. A groove may be manufactured by electro/chemically eroding the putter face material using a chemical mask such as wax or a petrochemical substance. A groove may be manufactured by abrading the face material using air or water as the carry medium of the abrasion material such as sand. Any one or a combination of the methods discussed above can be used to manufacture one or more of the grooves on the putter head. Furthermore, other methods used to create depressions in any material may be used to manufacture the grooves.

Example 1—Polymeric Insert Vs. Metal-Polymeric Insert

An exemplary putter golf club head 6100 comprising a face insert 6110 having a PEBAX material was compared to a similar control putter golf club head, devoid of the PEBAX material on a ball striking face plate. The face insert 6010 of the exemplary putter golf club head comprises a ball striking face plate 6112 and a face insert base 6114. The ball striking face plate 6112 and the face insert base 6114 of the face insert 6110 comprise a PEBAX material, where the ball striking face plate 6112 comprises a PEBAX 4033 (Arkema, Paris France) and the face insert base 6114 comprises a PEBAX 6333 (Arkema, Paris France). The PEBAX 4033 (Arkema, Paris France) comprises a lower hardness than the PEBAX 6333 (Arkema, Paris France). The face insert of the control putter golf club head comprises a ball striking face plate and an aluminum screen. The aluminum screen of the control putter golf club head comprises an aluminum material, and the ball striking face plate of the control putter golf club head comprises a PEBAX material.

A player testing was conducted to measure the sound, feel, and overall satisfaction between the exemplary putter golf club head 6100 and the control putter golf club head. Based on the results, many players were satisfied with the impact feel, impact sound, impact feedback, ball speed, and overall stroke of the putter golf club head 6100 over the control putter golf club head. Based on a test of 81 players who play with putters with inserts and putters without inserts, 37 players were satisfied with the control putter golf club head, and 44 players were satisfied with the exemplary putter golf club head 6100. The test data was then filtered to include players who only play with putters with inserts. The filtered data including 43 players showed 84% of players prefer the exemplary putter golf club head 6100, and 16% of players prefer the control putter golf club head. This data shows that players prefer the face insert comprising the PEBAX material for all components (i.e. ball striking face plate and face insert base) of the face insert over the face insert comprising the aluminum material and the PEBAX material (i.e. ball striking face plate and aluminum screen).

Example 2—Face Insert with Vertical Curved Grooves Vs. Face Inserts with No Grooves An exemplary putter-type club head 1800 comprising a plurality of first curved grooves 1820 and a plurality of second curved grooves 1822 was compared to a similar control putter-type club head comprising no grooves. The exemplary putter-type club head 1800 comprises grooves 1820 and 1822 with variable width and depth, and land portions 1824 with variable area. The width of the grooves 1820 and 1822 increases in a direction extending from the toe end to the center portion of the putter face, and in a direction extending from the heel end to the center portion. The groove width ranges from 0.035 inch to 0.037 inch. The land portion 1824 area decreases in a direction extending from the toe end to the center portion of the putter face, and in a direction from the heel end to the center portion. The groove depth ranges from 0.003 inch to 0.006 inch near the toe end and heel end, and 0.014 inch to 0.018 inch at the center portion of the putter face.

A test was conducted to compare the golf ball speeds between the exemplary putter-type club head and the control putter-type club head for impacts at the center portion, the toe end, and the heel end of the putter face. The test used a robotic arm to strike a golf ball while keeping club head speed, club head swing path, and club head impact position constant between the tests. The test resulted in the exemplary putter-type club head 1800 averaging a golf ball speed of approximately 7.3 mph for center portion hits, and averaging a golf ball speed of approximately 7.4 mph for heel end/toe end hits. The test resulted in the control putter-type club head averaging a golf ball speed of approximately 7.8 mph for center portion hits, and averaging a golf ball speed of approximately 7.6 mph for heel end/toe end hits. The results show the exemplary putter-type club head 1800 having a smaller difference in ball speed between center portion hits and heel/toe end hits than the control putter-type club head. These results show that a putter-type club head with no grooves has a greater difference in ball speed between center portion hits and heel/toe end hits, which is undesirable in providing consistent ball travel distance on a putting surface. The exemplary putter-type club head 1800 with the first curved grooves 1820 and the second curved grooves 1822 provide a smaller differential in ball speed across the putter face, which is desirable in providing consistent ball speed and ball distance on a putting surface.

Example 3—Face Inserts with Vertical Curved Grooves Vs. Face Inserts with No Grooves An exemplary putter-type club head 7300 comprising a plurality of first curved grooves 7320 and a plurality of second curved grooves 7322 was compared to a similar control putter-type club head comprising no grooves. The exemplary putter-type club head 7300 comprises grooves 7320 and 7322 with equal groove width, grooves 7320 and 7322 with variable depth, and land portions 7324 with equal area. The width of the grooves 7320 and 7322 are equal. The groove width ranges from 0.035 inch to 0.037 inch. The land portion area is equal in a direction extending from the toe end to the center portion of the putter face, and in a direction extending from the heel end to the center portion. The groove depth ranges from 0.003 inch to 0.006 inch near the toe end and heel end, and 0.014 inch to 0.018 inch at the center portion of the putter face.

A test was conducted to compare the golf ball speeds between the exemplary putter-type club head 7300 and the control putter-type club head for impacts at the center portion, the toe end, and the heel end of the putter face. The test used a robotic arm to strike a golf ball while keeping club head speed, club head swing path, and club head impact position constant between the tests. The test resulted in the exemplary putter-type club head 7300 averaging a golf ball speed of approximately 7.6 mph for center portion hits, heel end hits, and toe end hits. The test resulted in the control putter-type club head averaging a golf ball speed of approximately 7.8 mph for center portion hits and averaging a golf ball speed of approximately 7.6 mph for heel end/toe end hits. The results show the exemplary putter-type club head 7300 having a smaller difference in ball speed between center portion hits and heel/toe end hits than the control putter-type club head. These results show that a putter-type club head with no grooves has a greater difference in ball speed between center portion hits and heel/toe end hits, which is undesirable in providing consistent ball travel distance on a putting surface. The exemplary putter-type club head 7300 with the first curved grooves 7320 and the second curved grooves 7322 provide a smaller differential or no differential in ball speeds across the putter face, which is desirable in providing consistent ball speed and ball distance on a putting surface.

As the rules to golf may change from time to time (e.g., new regulations may be adopted or old rules may be eliminated or modified by golf standard organizations and/or governing bodies), golf equipment related to the methods, apparatus, and/or articles of manufacture described herein may be conforming or non-conforming to the rules of golf at any particular time. Accordingly, golf equipment related to the methods, apparatus, and/or articles of manufacture described herein may be advertised, offered for sale, and/or sold as conforming or non-conforming golf equipment. The methods, apparatus, and/or articles of manufacture described herein are not limited in this regard.

Although a particular order of actions is described above, these actions may be performed in other temporal sequences. For example, two or more actions described above may be performed sequentially, concurrently, or simultaneously. Alternatively, two or more actions may be performed in reversed order. Further, one or more actions described above may not be performed at all. The apparatus, methods, and articles of manufacture described herein are not limited in this regard.

While the invention has been described in connection with various aspects, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

Clause 1. A putter type golf club head comprising: a putter face defined by a toe end, a heel end, a top rail and a sole, the putter type club face comprising a plurality of first curved grooves and a plurality of second curved grooves, each of the first curved grooves and the second curved grooves extend from the top rail to the sole, and a plurality of land portions between the first curved grooves and the second curved grooves; wherein: the plurality of first curved grooves are parallel to each other; the plurality of second curved grooves are parallel to each other; the plurality of first curved grooves intersect the plurality of second curved grooves at a plurality of points along the plurality of second curved grooves; the land portions form areas on the putter face that contact a golf ball during impact; and the area of the land portions at a center portion of the putter face are equal to the area of the land portions near the toe end.

Clause 2. The putter type golf club head of clause 1, wherein the area of the land portions at the center portion is equal to the area of the land portions near the heel end.

Clause 3. The putter type golf club head of clause 1, wherein a depth of the plurality of first curved grooves or the plurality of second curved grooves is greater at the center portion than near the heel end and near the toe end.

Clause 4. The putter type golf club head of clause 1, wherein a depth of a portion of the plurality of first curved grooves or the plurality of second curved grooves ranges from 0.003 inch to 0.017 inch.

Clause 5. The putter type golf club head of clause 1, wherein each first curved groove of the plurality of first curved grooves comprise a similar width; and wherein each second curved groove of the plurality of second curved grooves comprise a similar width.

Clause 6. The putter type golf club head of clause 1, wherein the area of the land portions varies in a direction extending from the top rail to the sole.

Clause 7. The putter type golf club head of clause 1, wherein the putter type club head has a loft angle less than 7 degrees.

Clause 8. The putter type golf club head of clause 1, wherein the putter face comprises a face insert and the plurality of first curved grooves and the plurality of second curved grooves are disposed on the insert.

Clause 9. A putter type golf club head comprising: a putter face defined by a toe end, a heel end, a top rail and a sole, the putter type club face comprising: a plurality of first curved grooves and a plurality of second curved grooves, each of the first curved grooves and the second curved grooves extend from the top rail to the sole; a plurality of land portions separating the plurality of first curved grooves and the plurality of second curved grooves; wherein: the plurality of first curved grooves are parallel to each other; the plurality of second curved grooves are parallel to each other; the plurality of first curved grooves intersect the plurality of second curved grooves at a plurality of points along the plurality of second curved grooves; the land portions form areas on the putter face that contact a golf ball during impact; and the area of the land portions varies in a direction extending from the top rail to the sole.

Clause 10. The putter type golf club head of clause 9, wherein each first curved groove of the plurality of first curved grooves comprise a similar width; and wherein each second curved groove of the plurality of second curved grooves comprise a similar width.

Clause 11. The putter type golf club head of clause 9, wherein the area of the land portions at a center portion of the putter face are equal to the area of the land portions near the toe end.

Clause 12. The putter type golf club head of clause 11, wherein the area of the land portions at the center portion of the putter face area equal to the area of the land portions near the heel end.

Clause 13. The putter type golf club head of clause 9, wherein the putter type club head has a loft angle less than 7 degrees.

Clause 14. The putter type golf club head of clause 9, wherein a depth of the plurality of first curved grooves or the plurality of second curved grooves is greater near a center portion of the putter face than near the heel end and near the toe end.

Clause 15. A putter type golf club head comprising: a putter face defined by a toe end, a heel end, a top rail and a sole, the putter type club face comprising: a plurality of first curved grooves and a plurality of second curved grooves, each of the first curved grooves and the second curved grooves extend from the top rail to the sole; a plurality of land portions separating the plurality of first curved grooves and the plurality of second curved grooves; wherein: the putter face defines a centerline extending through a geometric center of the putter face from the heel end to the toe end; the plurality of first curved grooves are parallel to each other; the plurality of second curved grooves are parallel to each other; the plurality of first curved grooves intersect the plurality of second curved grooves at a plurality of points along the plurality of second curved grooves; the land portions form areas on the putter face that contact a golf ball during impact; and the area of the land portions along the center line are greater than the area of the land portions near the top rail or sole.

Clause 16. The putter type golf club head of clause 15, wherein the area of the land portions varies in a direction extending from the sole to the top rail.

Clause 17. The putter type golf club head of clause 15, wherein each first curved groove of the plurality of first curved grooves comprises a similar width; and wherein each second curved groove of the plurality of second curved grooves comprises a similar width.

Clause 18. The putter type golf club head of clause 15, wherein a depth of a portion of the plurality of first curved grooves or the plurality of second curved grooves ranges from 0.003 inch to 0.017 inch.

Clause 19. The putter type golf club head of clause 15, wherein a depth of the plurality of first curved grooves or the second curved grooves increases in a direction extending from the toe end to a center portion of the putter face, and in a direction extending from the heel end to the center portion.

Clause 20. The putter type golf club head of clause 15, wherein the putter type club head has a loft angle less than 7 degrees.

What is claimed is:

1. A putter type golf club head comprising:

a putter face defined by a toe end, a heel end, a top rail and a sole, the putter face comprising a plurality of first curved grooves and a plurality of second curved grooves, each of the first curved grooves and the second curved grooves extend from the top rail to the sole, and a plurality of land portions between the first curved grooves and the second curved grooves; wherein:

the plurality of first curved grooves are parallel to each other;

the plurality of second curved grooves are parallel to each other;

the plurality of first curved grooves intersect the plurality of second curved grooves at a plurality of points along the plurality of second curved grooves;

the land portions form areas on the putter face that contact a golf ball during impact;

the area of the land portions at a center portion of the putter face are equal to the area of the land portions near the toe end;

the putter face is planar and extends in a vertical orientation from a ground plane; and a depth of at least one of the plurality of first curved grooves or the plurality of second curved grooves varies in a direction extending from the heel end to the toe end, and in a direction extending from the top rail to the sole.

2. The putter type golf club head of claim 1, wherein the area of the land portions at the center portion is equal to the area of the land portions near the heel end.

3. The putter type golf club head of claim 1, wherein a depth of the plurality of first curved grooves or the plurality of second curved grooves is greater at the center portion than near the heel end and near the toe end.

4. The putter type golf club head of claim 1, wherein a depth of a portion of the plurality of first curved grooves or the plurality of second curved grooves ranges from 0.003 inch to 0.017 inch.

5. The putter type golf club head of claim 1, wherein each first curved groove of the plurality of first curved grooves comprise an equal width; and wherein each second curved groove of the plurality of second curved grooves comprise an equal width.

6. The putter type golf club head of claim 1, wherein the area of the land portions varies in a direction extending from the top rail to the sole.

7. The putter type golf club head of claim 1, wherein the putter type golf club head has a loft angle less than 7 degrees.

8. The putter type golf club head of claim 1, wherein the putter face comprises a face insert and the plurality of first curved grooves and the plurality of second curved grooves are disposed on the face insert.

9. A putter type golf club head comprising:

a putter face defined by a toe end, a heel end, a top rail and a sole, the putter face comprising:

a plurality of first curved grooves and a plurality of second curved grooves, each of the first curved grooves and the second curved grooves extend from the top rail to the sole; and a plurality of land portions separating the plurality of first curved grooves and the plurality of second curved grooves; wherein:

the plurality of first curved grooves are parallel to each other;

the plurality of second curved grooves are parallel to each other;

the plurality of first curved grooves intersect the plurality of second curved grooves at a plurality of points along the plurality of second curved grooves;

the land portions form areas on the putter face that contact a golf ball during impact;

the area of the land portions varies in a direction extending from the top rail to the sole;

the putter face is planar and extends in a vertical orientation from a ground plane; and a depth of at least one of the plurality of first curved grooves or the plurality of second curved grooves varies in a direction extending from the heel end to the toe end, and in a direction extending from the top rail to the sole.

10. The putter type golf club head of claim 9, wherein each first curved groove of the plurality of first curved grooves comprise an equal width; and wherein each second curved groove of the plurality of second curved grooves comprise an equal width.

11. The putter type golf club head of claim 9, wherein the area of the land portions at a center portion of the putter face are equal to the area of the land portions near the toe end.

12. The putter type golf club head of claim 11, wherein the area of the land portions at the center portion of the putter face are equal to the area of the land portions near the heel end.

13. The putter type golf club head of claim 9, wherein the putter type golf club head has a loft angle less than 7 degrees.

14. The putter type golf club head of claim 9, wherein a depth of the plurality of first curved grooves or the plurality of second curved grooves is greater near a center portion of the putter face than near the heel end and near the toe end.

15. A putter type golf club head comprising:

a putter face defined by a toe end, a heel end, a top rail and a sole, the putter face comprising:

a plurality of first curved grooves and a plurality of second curved grooves, each of the first curved grooves and the second curved grooves extend from the top rail to the sole; and a plurality of land portions separating the plurality of first curved grooves and the plurality of second curved grooves; wherein:

the putter face defines a centerline extending through a geometric center of the putter face from the heel end to the toe end;

the plurality of first curved grooves are parallel to each other;

the plurality of second curved grooves are parallel to each other;

the plurality of first curved grooves intersect the plurality of second curved grooves at a plurality of points along the plurality of second curved grooves;

the land portions form areas on the putter face that contact a golf ball during impact;

the area of the land portions along the centerline are greater than the area of the land portions near the top rail or sole;

the putter face is planar and extends in a vertical orientation from a ground plane; and a depth of at least one of the plurality of first curved grooves or the plurality of second curved grooves varies in a direction extending from the heel end to the toe end, and in a direction extending from the top rail to the sole.

16. The putter type golf club head of claim 15, wherein the area of the land portions varies in a direction extending from the sole to the top rail.

17. The putter type golf club head of claim 15, wherein each first curved groove of the plurality of first curved grooves comprise an equal width; and wherein each second curved groove of the plurality of second curved grooves comprise an equal width.

18. The putter type golf club head of claim 15, wherein a depth of a portion of the plurality of first curved grooves or the plurality of second curved grooves ranges from 0.003 inch to 0.017 inch.

19. The putter type golf club head of claim 15, wherein a depth of the plurality of first curved grooves or the second curved grooves increases in a direction extending from the toe end to a center portion of the putter face, and in a direction extending from the heel end to the center portion.

20. The putter type golf club head of claim 15, wherein the putter type golf club head has a loft angle less than 7 degrees.

* * * * *